US008640637B2

(12) United States Patent
Takizawa et al.

(10) Patent No.: US 8,640,637 B2
(45) Date of Patent: Feb. 4, 2014

(54) SEWING-MACHINE BOBBIN THREAD TENSION CONTROLLER, AND SEWING MACHINE

(75) Inventors: Yoshichika Takizawa, Nagoya (JP); Masayoshi Ono, Nagoya (JP); Tatsuhiro Kurashima, Nagoya (JP)

(73) Assignee: NSD Corporation, Nagoya-shi (JP)

( * ) Notice: Subject to any disclaimer, the term of this patent is extended or adjusted under 35 U.S.C. 154(b) by 197 days.

(21) Appl. No.: 13/378,142

(22) PCT Filed: Jun. 8, 2010

(86) PCT No.: PCT/JP2010/059663

§ 371 (c)(1), (2), (4) Date: Dec. 14, 2011

(87) PCT Pub. No.: WO2010/147023

PCT Pub. Date: Dec. 23, 2010

(65) Prior Publication Data

US 2012/0097084 A1 Apr. 26, 2012

(30) Foreign Application Priority Data

Jun. 16, 2009 (JP) ..... 2009-143751
Feb. 15, 2010 (JP) ..... 2010-030603

(51) Int. Cl.
*D05B 3/02* (2006.01)
*D05B 19/00* (2006.01)

(52) U.S. Cl.
USPC ..... 112/229; 112/184

(58) Field of Classification Search
USPC ..... 112/184, 229, 254, 255, 475.01
See application file for complete search history.

(56) References Cited

U.S. PATENT DOCUMENTS 4,377,980 A * 3/1983 Hanyu et al. ..... 112/254
4,429,649 A * 2/1984 Eguchi et al. ..... 112/229
4,471,705 A * 9/1984 Takenoya et al. ..... 112/254
4,530,296 A * 7/1985 Takenoya et al. ..... 112/229
4,702,185 A * 10/1987 Hanyu et al. ..... 112/254

* cited by examiner

*Primary Examiner* — Danny Worrell
(74) *Attorney, Agent, or Firm* — Edwards Wildman Palmer LLP

(57) ABSTRACT

There is provided a sewing-machine bobbin thread tension controller capable of elaborately, accurately controlling bobbin thread tension without depending on frictional force. A bobbin thread tension controller includes an outer shuttle, a middle shuttle presser, a middle shuttle, a bobbin thread tension control mechanism, a shuttle actuation unit, and a bobbin. The middle shuttle has a magnet. A magnet is disposed, in close proximity to the magnet, on an arm attached to a rotary shaft of a shuttle actuation motor provided in the shuttle actuation unit. The middle shuttle is rotated by rotating the magnet by means of the motor. Further, a rotary disc is provided, in close proximity to the middle shuttle, on a rotary shaft of a bobbin thread tension control motor of the bobbin thread tension control mechanism and is provided with a magnet. A magnet is disposed on a part of the bobbin facing the rotary disc.

20 Claims, 28 Drawing Sheets

FIG. 10

VIRTUAL MAIN SPINDLE DATA (POSITION)

| TIME | ANGLE |
|---|---|
| t0 | a0 (=0) |
| t1 | a1 |
| t2 | a2 |
| . | . |
| . | . |
| . | . |
| . | . |
| . | . |
| tn | an |

FIG. 11

NEEDLE BAR DATA

| MAIN SPINDLE ANGLE | NEEDLE BAR ANGLE |
|---|---|
| a0 | b0 |
| a1 | b1 |
| a2 | b2 |
| . | . |
| . | . |
| . | . |
| . | . |
| . | . |
| an | bn |

FIG. 12

SHUTTLE ACTUATION DATA

| MAIN SPINDLE ANGLE | MIDDLE SHUTTLE ANGLE |
|---|---|
| a0 | d0 |
| a1 | d1 |
| a2 | d2 |
| . | . |
| . | . |
| . | . |
| . | . |
| . | . |
| an | dn |

FIG. 13

BOBBIN THREAD TENSION CONTROL DATA

| MAIN SPINDLE ANGLE | TORQUE |
|---|---|
| a0 | c0 |
| a1 | c1 |
| a2 | c2 |
| . | . |
| . | . |
| . | . |
| . | . |
| . | . |
| an | cn |

| | | |
|---|---|---|
| (a) | FOUR POLES ON BOTH SIDES |  |
| (b) | TWO POLES ON ONE SIDE |  |
| (c) | FOUR POLES ON BOTH SIDES |  |
| (d) | TWO POLES ON ONE SIDE |  |

| | | |
|---|---|---|
| (a) | FOUR POLES ON BOTH SIDES |  |
| (b) | TWO POLES ON ONE SIDE |  |
| (c) | MULTIPLE POLES ON BOTH SIDES |  |
| (d) | MULTIPLE POLES ON ONE SIDE |  |

| | | |
|---|---|---|
| (a) | TWO POLES IN RADIAL DIRECTION |  |
| (b) | TWO POLES ON OUTER PERIPHERY |  |
| (c) | MULTIPLE POLES IN RADIAL DIRECTION (MULTIPLE POLES ON OUTER PERIPHERY) |  |
| (d) | MULTIPLE POLES ON OUTER PERIPHERY |  |

SEWING-MACHINE BOBBIN THREAD TENSION CONTROLLER, AND SEWING MACHINE

TECHNICAL FIELD

The present invention relates to a sewing-machine bobbin thread tension controller.

BACKGROUND ART

A method for controlling presser-bar pressure of a leaf spring provided on a bobbin case by use of a screw has hitherto been well known as a method for controlling bobbin thread tension of a sewing machine.

A sewing-machine bobbin thread controller described in Patent Document 1 has a permanent magnet placed in a bobbin case and an electromagnet whose pole and magnetic force are made changeable so as to selectively attract or repel the permanent magnet. The electromagnet is placed so as to be able to contact and leave the bobbin case. An electric current is caused to flow into a coil of the electromagnetic, thereby energizing the electromagnet. The electromagnet is thereby actuated so as to repel the permanent magnet. The permanent magnet is thereby pressed, to thus exert compression on a bobbin. A braking force commensurate with a sewing speed consequently acts on the bobbin, thereby imparting predetermined tension to a bobbin thread.

Moreover, a sewing-machine bobbin thread tension controller described in Patent Document 2 includes a magnetic body 6, an electromagnet, and current conduction control means. The magnetic body 6, formed within a middle shuttle that retains a bobbin around which a bobbin thread is wound, is placed so as to be able to advance toward or recede from a bobbin thread guide that guides the bobbin thread and can impart tension to or release tension from the bobbin thread guided by the bobbin thread guide. The electromagnet, disposed at a position opposing the magnetic body with the bobbin thread guide interposed therebetween, generates in its surroundings a magnetic field upon energization, thereby letting the magnetic body advance toward or recede from the bobbin thread guide. The current conduction control means changes a direction and magnitude of an electric current supplied to the electromagnet according to tension to be imparted to the bobbin thread.

RELATED ART DOCUMENTS

Patent Documents

Patent Document 1: JP-A-5-68764
Patent Document 2: JP-A-2008-119078

SUMMARY OF THE INVENTION

Problems that the Invention is to Solve

However, in the sewing-machine bobbin thread controller described in connection with Patent Document 1, the permanent magnet exerts compression on the bobbin, thereby bringing an end of the bobbin into press contact with a large-diameter portion of a spindle, to thus cause tension in the bobbin thread. Therefore, the tension of the bobbin thread comes to depend on frictional force between the bobbin and the spindle. This makes it difficult to elaborately and accurately control the bobbin thread tension.

In the sewing-machine bobbin thread tension controller described in connection with Patent Document 2, the bobbin thread tension is controlled by means of letting the magnetic body guide advance toward and recede from the bobbin thread guide by means of the electromagnet, so that the tension of the bobbin thread becomes dependent on frictional force developing between the bobbin thread and the magnetic. Therefore, bobbin thread tension cannot be elaborately nor accurately controlled.

In particular, in the embroidery sewing machine, bobbin thread tension greatly affects workmanship of an embroidery to be prepared. For this reason, elaborate and accurate control of bobbin thread tension is desired.

A challenge to be met by the present invention is to provide a bobbin thread tension controller for a sewing machine; in particular, an embroidery sewing machine capable of elaborately, accurately controlling bobbin thread tension without depending on frictional force.

Means for Solving the Problem

The present inventions have been conceived to solve the above-mentioned drawbacks. A first configuration provides a sewing-machine bobbin thread tension controller, comprising:

an outer shuttle (110) that has a circular-arc inner peripheral surface and includes a guide groove formed on a front side which is one side of the inner peripheral surface in an axial direction;

a middle shuttle (150) that rotates along the guide groove of the outer shuttle, to thus hook a needle thread, and that includes

- a race (152) formed into a circular arc along a circumferential edge of the middle shuttle and slidably supported by the guide groove,
- a rear portion (161) continually extending from a rear-side edge of an inner circumferential edge of the race, and
- a shaft (184) formed on a front surface of the rear portion and along a center of rotation of the rear portion, wherein at least the rear portion and the shaft are made of a non-magnetic substance;

a middle shuttle presser (130) that is provided on a front side of the outer shuttle in order to prevent the middle shuttle accommodated in the outer shuttle from falling from the outer shuttle;

a bobbin (300) that has a hole through which the shaft of the middle shuttle passes, that is axially supported in the middle shuttle as a result of the shaft being inserted into the hole, and that has a first magnet (310) provided on a rear surface which is a surface opposing a rear portion of the middle shuttle when the bobbin is axially supported by the shaft; and a bobbin thread tension control mechanism (200, 1200) that includes

- a bobbin thread tension control motor (202, 1202) which is provided at a rear of the middle shuttle, which has a rotary shaft concentric to the center of rotation of the middle shuttle, and which rotates the rotary shaft in a direction opposite to a rotating direction of the bobbin achieved when a bobbin thread wound around the bobbin is withdrawn and
- a second magnet (214, 1214) which is rotated by the bobbin thread tension control motor, which is disposed in close proximity to the rear portion of the middle shuttle, and which rotates the first magnet.

In the sewing-machine bobbin thread tension controller having the first configuration, the second magnet rotates as a result of actuation of the bobbin thread tension control motor, whereby the first magnet provided on the bobbin is rotated, to thus rotate the bobbin. Namely, rotational force is imparted to the bobbin in a direction opposite to the rotating direction of the bobbin when bobbin thread wound around the bobbin is withdrawn.

Thus, since the bobbin thread tension is controlled by means of the second magnet rotated by the bobbin thread tension control motor and the first magnets provided in the bobbin, the bobbin thread tension can be controlled without depending on frictional force. When compared with a case where tension is controlled by means of friction occurring between a bobbin thread and another member, the tension can be controlled with superior accuracy. Tension imparted to the bobbin thread is controlled by means of a value of an electric current applied to the bobbin thread tension control motor, and bobbin thread tension is proportional to the current value. Consequently, the bobbin thread tension can elaborately be controlled by elaborate control of the current value. Moreover, the bobbin thread tension can freely be controlled by means of the bobbin thread tension control motor during operation of the sewing machine. In a case where the sewing machine is an embroidery sewing machine and where the embroidery sewing machine is a multi-head embroidery sewing machine including a plurality of embroidery heads, the respective embroidery heads can equally control the bobbin thread tension by means of making equal to each other bobbin thread tension control data that are data used for controlling the respective bobbin thread tension control motors.

Further, the middle shuttle is equipped with the shaft, and the bobbin axially supported on the shaft is stably accommodated in the corresponding middle shuttle as a result of the second magnet attracting the first magnet, which obviates a necessity to additionally provide a mechanism for attaching a bobbin to a corresponding middle shuttle. Moreover, it is possible to easily let the shaft axially support and attach the bobbin by means of attractor force developing from the first magnet and the second magnet. It is also possible to easily remove the bobbin from the shaft by means of removing the bobbin in defiance of the attractor force or rotating the bobbin through about 180 degrees to thereby let the first magnet and the second magnet repel each other. Easy removal and attachment of the bobbin from and to the corresponding middle shuttle consequently becomes feasible.

In the first configuration, a second configuration is characterized by further comprising:

a third magnet (190) that is put on an outer periphery side of a portion of the rear of the middle shuttle opposing the surface of the bobbin provided with the first magnet; and a shuttle actuation unit (250, 1250) that has a fourth magnet (270, 1270) disposed in close proximity to the third magnet and a shuttle actuation motor (252, 1252) for rotating the fourth magnet around an axial line that is to serve as a center of rotation of the middle shuttle. Accordingly, the fourth magnet rotates around the axial line serving as a center of rotation of the corresponding middle shuttle as a result of actuation of the corresponding shuttle actuation motor. The third magnet positioned close to the fourth magnet is thereby rotated, whereupon the corresponding middle shuttle rotates. Thereby, the middle shuttle can also be rotated by means of the attractor force of the magnets.

In the second configuration, a third configuration is characterized in that the rear portion of the middle shuttle has a substantially circular plate-like rear-side body (162) that is perpendicular to the axial line serving as the center of rotation of the middle shuttle and that has an outer diameter smaller than an inner diameter of the race; and a rear-side tapered portion (164) that is formed between a surrounding area of the rear-side body and the race and that is tapered so as to have a smaller diameter from the race toward the rear-side body; and wherein the third magnet is disposed on a front surface or a rear surface of the rear-side tapered portion. The fourth magnet can be caused to approach the corresponding third magnet without interfering with the bobbin thread tension control mechanism.

In the second or third configuration, a fourth configuration is characterized in that there is provided a control section (40) for controlling rotation of the shuttle actuation motor in such a way that the middle shuttle makes substantially half forward and backward rotations; and wherein the shuttle actuation unit includes a shuttle actuation motor coaxially disposed at a rear of the bobbin thread tension control motor, a substantially L-shaped arm (260) that is provided on a second rotary shaft which is a rotary shaft of the shuttle actuation motor, and that has a base end (262) perpendicular to an axial center core of the second rotary shaft and also a leading end (264) continually extending from the base end and provided in parallel to the axial center core of the second rotary shaft; and wherein the fourth magnet is disposed at an extremity of the arm.

Consequently, the middle shuttle can be used as a half-turn shuttle. The middle shuttle is actuated by the corresponding shuttle actuation unit, so that the fourth magnet and the third magnet attract each other. The middle shuttle rotates along with circumferential rotation of the fourth magnet; therefore, operation sound resultant of actuation of the middle shuttle can be lessened. Specifically, in contrast with the related art half-turn middle shuttle, a driver that contacts both sides of the middle shuttle is not employed. Hence, it is possible to prevent generation of sound, which would otherwise occur when the driver contacts the middle shuttle.

In the second or third configuration, a fifth configuration is characterized in that there is provided a control section (40) for controlling rotation of the shuttle actuation motor in such a way that the middle shuttle makes a full rotation; wherein the shuttle actuation motor is interposed between the bobbin thread tension control motor and the middle shuttle and has an insert hole that enables insertion of a rotary shaft of the bobbin thread tension control motor; wherein a second rotary shaft, which is a rotary shaft of the shuttle actuation motor, is formed into a tubular shape so as to enable insertion of the rotary shaft of the bobbin thread tension control motor; wherein an axial line of the second rotary shaft is concentric to an axial line of the rotary shaft of the bobbin thread tension control motor; wherein there are provided on the second rotary shaft a substantially L-shaped arm (1260) including a base end (1262) perpendicular to an axial center core of the second rotary shaft and a leading end (1264) that continually extends from the base end and that is provided parallel to the axial center core of the second rotary shaft; and wherein the fourth magnet is disposed at an extremity of the arm.

Consequently, the middle shuttle can be used as a full-turn shuttle. In particular, the bobbin thread tension control motor is put on the other side of the middle shuttle of the shuttle actuation motor and can be configured such that a surrounding area of the third magnet is opened. Hence, the arm can be fully rotated, and the middle shuttle can be used as a full turn shuttle.

In any one of the first through fifth configurations, a sixth configuration is characterized in that a cylindrical tubular portion (182) is provided on a front surface of the rear portion of the middle shuttle in order to accommodate the bobbin axially supported on the shaft. Therefore, a bobbin thread wound around the bobbin can be prevented from falling from the bobbin axially supported in the middle shuttle.

In any one of the first through sixth configurations, a seventh configuration is characterized in that a plate-like rotor plate (212) is disposed on the rotary shaft of the bobbin thread tension control motor and in close proximity to the rear portion of the middle shuttle, and the second magnet (214) is disposed on a front of a rotor plate.

An eighth configuration provides a sewing-machine bobbin thread tension controller, comprising:

an outer shuttle (110) that includes a guide groove formed on an inner peripheral surface thereof;

a middle shuttle (150) that rotates along the guide groove of the outer shuttle, to thus hook a needle thread, and that includes a race (152) formed into a circular arc along a circumferential edge of the middle shuttle and slidably supported by the guide groove, a main middle shuttle (160) that continually extends from an inner end of the race and that includes a rear portion (161) continually extending from a rear-side end which is one end of an inner circumferential edge of the race achieved in an axial direction, and a front-side tapered portion (166) which continually extends from a front-side end which is a remaining end of the inner circumferential edge of the race, and which is tapered so as to have a smaller diameter toward the front, wherein the rear portion (161) further includes a substantially circular plate-like rear-side body (162) which is perpendicular to an axial line serving as a center of rotation of the middle shuttle and whose outer diameter is smaller than an inner diameter of the race and a rear-side tapered portion (164) which is formed between a surrounding area of the rear-side body and the race and which is tapered so as to have a smaller diameter from the race toward the rear-side body, a bobbin accommodation section (180) that is formed in a front surface of the rear-side body and that includes a shaft (184) formed so as to extend from a center of the rear-side body along the center of rotation of the middle shuttle and a cylindrical tubular portion (182) provided on a front surface of the rear-side body, and a third magnet (190) disposed on a front or rear surface of the rear-side tapered portion, wherein the middle shuttle except the third magnet is made of a non-magnetic substance;

a middle shuttle presser (130) that is disposed on a front side of the outer shuttle in order to prevent the middle shuttle accommodated in the outer shuttle from falling from the outer shuttle;

a bobbin (300) that is accommodated in the bobbin accommodation section of the middle shuttle and that has a first magnet (310) disposed on a plane perpendicular to an axial line serving as a center of rotation;

a bobbin thread tension control mechanism (200) that includes a bobbin thread tension control motor (202) which is disposed at a rear of the middle shuttle, which has a rotary shaft concentric to the center of rotation of the middle shuttle, and which rotates the rotary shaft in a direction opposite to a rotating direction of the bobbin achieved when a bobbin thread wound around the bobbin is withdrawn, and a rotary disc (210) which is attached to a rotary shaft of the bobbin thread tension control motor and positioned in close proximity to the rear portion of the middle shuttle and which has a second magnet (214) for rotating the first magnet as a result of rotation of the rotary disc;

a shuttle actuation unit (250) that includes a shuttle actuation motor (252) which is provided at a rear of the bobbin thread tension control motor and which has a second rotary shaft serving as a rotary shaft concentric to the center of rotation of the middle shuttle, a substantially L-shaped arm (260) attached to the second rotary shaft and including a base end (262) attached to the secondary shaft and perpendicular to an axial center core of the second rotary shaft and a leading end (264) continually extending from the base end in parallel to the axial center core of the second rotary shaft, and a fourth magnet (270) attached to an extremity of the arm and in close proximity to the third magnet; and a control section (40) for controlling rotation of the shuttle actuation motor such that the middle shuttle makes substantially half forward and backward rotations.

In the sewing-machine bobbin thread tension controller having the eighth configuration, the arm rotates as a result of actuation of the shuttle actuation motor, and the fourth magnet rotates around an axial line that is to serve as a center of rotation of the middle shuttle. Thereby, the third magnet closely approached the fourth magnet rotates, whereby the middle shuttle rotates. Moreover, the rotary disc rotates as a result of actuation of the bobbin thread tension control motor, whereupon the second magnet rotates. Thereby, the first magnet provided in the bobbin rotates, so that the bobbin rotates. Specifically, rotational force is imparted to the bobbin in a direction opposite to the rotating direction of the bobbin achieved when the bobbin thread wound around the bobbin is withdrawn.

Accordingly, since the bobbin thread tension is controlled by means of the second magnet rotated by the bobbin thread tension control motor and the first magnet provided in the bobbin, the bobbin thread tension can be controlled without depending on frictional force. When compared with a case where tension is controlled by means of friction occurring between a bobbin thread and another member, the tension can be controlled with superior accuracy. Tension imparted to the bobbin thread is controlled by means of the value of the electric current applied to the bobbin thread tension control motor, and bobbin thread tension is proportional to the current value. Consequently, the bobbin thread tension can elaborately be controlled by elaborate control of the current value. Moreover, the bobbin thread tension can freely be controlled by means of the bobbin thread tension control motor during operation of the sewing machine.

In a case where the sewing machine is an embroidery sewing machine and where the embroidery sewing machine is a multi-head embroidery sewing machine including a plurality of embroidery heads, the respective embroidery heads can equally control the bobbin thread tension by means of making equal to each other bobbin thread tension control data that are data used for controlling the respective bobbin thread tension control motors.

Further, the middle shuttle is equipped with the bobbin accommodation section, and the bobbin accommodated in the bobbin accommodation section is stably accommodated in the corresponding bobbin accommodation section as a result of the second magnet attracting the first magnet, which obviates a necessity to additionally provide a mechanism for attaching a bobbin to a corresponding middle shuttle. Moreover, it is possible to easily accommodate the bobbin in the bobbin accommodation section by means of attractor force developing from the first magnet and the second magnet. It is also possible to easily remove the bobbin from the bobbin accommodation section by means of removing the bobbin in defiance of the attractor force or rotating the bobbin through about 180 degrees to thereby let the first magnet and the second magnet repel each other. Easy removal and attachment of the bobbin from and to the corresponding bobbin accommodation section consequently becomes feasible.

Further, the middle shuttle can be used as a half-turn shuttle. The middle shuttle is actuated by the corresponding shuttle actuation unit, so that the fourth magnet and the third magnet attract each other. The middle shuttle rotates along with circumferential rotation of the fourth magnet; therefore, operation sound resultant of actuation of the middle shuttle can be lessened. Specifically, in contrast with the related art half-turn middle shuttle, a driver that contacts both sides of the middle shuttle is not employed. Hence, it is possible to prevent generation of sound, which would otherwise occur when the driver contacts the middle shuttle.

A ninth configuration also provides a sewing-machine bobbin thread tension controller, comprising:

an outer shuttle (110) that includes a guide groove formed on an inner peripheral surface thereof;

a middle shuttle (150) that rotate along the guide groove of the outer shuttle, to thus hook a needle thread, and that includes

- a race (152) formed into a circular arc along a circumferential edge of the middle shuttle and slidably supported by the guide groove,
- a main middle shuttle (160) that continually extends from an inner end of the race and that includes
  - a rear portion (161) continually extending from a rear-side end which is one end of an inner circumferential edge of the race achieved in an axial direction, and
  - a front-side tapered portion (166) which continually extends from a front-side end which is a remaining end of the inner circumferential edge of the race, and which is tapered so as to have a smaller diameter toward the front, wherein the rear portion (161) further includes
  - a substantially circular plate-like rear-side body (162), perpendicular to an axial line serving as a center of rotation of the middle shuttle, that has an outer diameter which is smaller than an inner diameter of the race and
  - a rear-side tapered portion (164) that is formed between a surrounding area of the rear-side body and the race and that is tapered so as to have a smaller diameter from the race toward the rear-side body,
- a bobbin accommodation section (180) formed in a front surface of the rear-side body and that includes
  - a shaft (184) formed so as to extend from a center of the rear-side body along the center of rotation of the middle shuttle and
  - a cylindrical tubular portion (182) provided on a front surface of the rear-side body, and
- a third magnet (190) disposed on a front or rear surface of the rear-side tapered portion, wherein the middle shuttle except the third magnet is made of a non-magnetic substance;

a middle shuttle presser (130) disposed on a front side of the outer shuttle in order to prevent the middle shuttle accommodated in the outer shuttle from falling from the outer shuttle;

a bobbin (300) that is accommodated in the bobbin accommodation section of the middle shuttle and that has a first magnet (310) disposed on a plane perpendicular to an axial line serving as a center of rotation;

a bobbin thread tension control mechanism (1200) that includes

- a bobbin thread tension control motor (1202) which is disposed at a rear of the middle shuttle, which has a rotary shaft concentric to the center of rotation of the middle shuttle and which rotates the rotary shaft in a direction opposite to a rotating direction of the bobbin achieved when a bobbin thread wound around the bobbin is withdrawn, and
- a rotary disc (1210) which is attached to a rotary shaft of the bobbin thread tension control motor and positioned in close proximity to the rear portion of the middle shuttle and which has a second magnet (1214) for rotating the first magnet as a result of rotation of the rotary disc;
- a shuttle actuation unit (1250) that includes
- a shuttle actuation motor (1252) which is interposed between the bobbin thread tension control motor and the middle shuttle and which has
  - an insert hole enabling insertion of a rotary shaft of the bobbin thread tension control motor and
  - a second rotary shaft, which is a rotary shaft of the shuttle actuation motor, is formed into a tubular shape so as to enable insertion of the rotary shaft of the bobbin thread tension control motor; wherein an axial line of the second rotary shaft is concentric to an axial line of the rotary shaft of the bobbin thread tension control motor,
- a substantially L-shaped arm (1260) which is attached to the second rotary shaft and which includes
  - a base end (1262) attached to the secondary rotary shaft perpendicular to an axial center core of the second rotary shaft and
  - a leading end (1264) continually extending from the base end in parallel to the axial center core of the second rotary shaft, and
- a fourth magnet (1270) attached to an extremity of the arm and in close proximity to the third magnet; and a control section (40) for controlling rotation of the shuttle actuation motor such that the middle shuttle makes a full rotation.

In the sewing-machine bobbin thread tension controller having the ninth configuration, the arm rotates as a result of actuation of the shuttle actuation motor, and the fourth magnet rotates around an axial line that is to serve as a center of rotation of the middle shuttle. Thereby, the third magnet closely approached the fourth magnet rotates, whereby the middle shuttle rotates. Moreover, the rotary disc rotates as a result of actuation of the bobbin thread tension control motor, whereupon the second magnet rotates. Thereby, the first magnet provided in the bobbin rotates, so that the bobbin rotates. Specifically, rotational force is imparted to the bobbin in a direction opposite to the rotating direction of the bobbin achieved when the bobbin thread wound around the bobbin is withdrawn.

Accordingly, since the bobbin thread tension is controlled by means of the second magnet rotated by the bobbin thread tension control motor and the first magnet provided in the bobbin, the bobbin thread tension can be controlled without depending on frictional force. When compared with a case where tension is controlled by means of friction occurring between a bobbin thread and another member, the tension can be controlled with superior accuracy. Tension imparted to the bobbin thread is controlled by means of the value of the electric current applied to the bobbin thread tension control motor, and bobbin thread tension is proportional to the current value. Consequently, the bobbin thread tension can elaborately be controlled by elaborate control of the current value. Moreover, the bobbin thread tension can freely be controlled by means of the bobbin thread tension control motor during operation of the sewing machine.

In a case where the sewing machine is an embroidery sewing machine and where the embroidery sewing machine is a multi-head embroidery sewing machine including a plurality of embroidery heads, the respective embroidery heads can equally control the bobbin thread tension by means of making equal to each other bobbin thread tension control data that are data used for controlling the respective bobbin thread tension control motors.

Further, the middle shuttle is equipped with the bobbin accommodation section, and the bobbin accommodated in the bobbin accommodation section is stably accommodated in the corresponding bobbin accommodation section as a result of the second magnet attracting the first magnet, which obviates a necessity to additionally provide a mechanism for attaching a bobbin to a corresponding middle shuttle. Moreover, it is possible to easily accommodate the bobbin in the bobbin accommodations section by means of attractor force developing from the first magnet and the second magnet. It is also possible to easily remove the bobbin from the bobbin accommodation section by means of removing the bobbin in defiance of the attractor force or rotating the bobbin through about 180 degrees to thereby let the first magnet and the second magnet repel each other. Easy removal and attachment of the bobbin from and to the corresponding bobbin accommodation section consequently becomes feasible.

Further, the middle shuttle can be used as a full-turn shuttle. In particular, the bobbin thread tension control motor is put on the other side of the middle shuttle of the shuttle actuation motor and can be configured such that a surrounding area of the second magnet is opened. Hence, the arm can be fully rotated, and the middle shuttle can be used as a full turn shuttle.

In any one of the first through ninth configurations, a tenth configuration is characterized in that the first magnet is a permanent magnet that assumes a ring shape and that is magnetized in a plane direction substantially perpendicular to a radial direction; and wherein the second magnet is a permanent magnet that assumes a ring shape or a columnar shape and that is magnetized in the plane direction.

In the tenth configuration, the number of poles on one side of the first magnet and the number of poles on one side of the second magnet may also be set to "m" ["m is the "n" power of 2 ("n" is an integer of one or more)].

In any one of the first through ninth configurations, an eleventh configuration is characterized in that the rear portion of the middle shuttle includes a circular rear plate-like portion (162*a*) that continually extends from a rear-side end of the inner circumferential edge of the race and that has an aperture formed at a center thereof and a rear recess (162*b*) formed in the aperture of the rear plate-like portion; wherein the first magnet provided in the bobbin is a permanent magnet that assumes a ring shape and that is magnetized in a plane direction substantially perpendicular to a radial direction; and wherein the second magnet provided in the bobbin thread tension control mechanism is a permanent magnet that has an outer diameter smaller than an inner diameter of the first magnet, that is magnetized in the radial direction, and that is placed in the rear recess and spaced apart from the rear recess such that a front-side end of the second magnet is situated at a front side than is a front surface of the rear plate-like portion of the rear portion of the middle shuttle.

Consequently, the direction of magnetization of the first magnet lies in a plane direction, and the direction of magnetization of the second magnet lies in a radial direction. The inner diameter of the first magnet is made greater than the outer diameter of the second magnet. A front surface of the second magnet is set so as to come to the front side than is a front surface of the rear plate-like portion of the rear portion in the middle shuttle. Hence, with the rear surface of the first magnet and the front surface of the second magnet aligned to each other in the longitudinal direction, a balance of magnetic force between the magnets is achieved. The first magnet of the bobbin does not contact the front surface of the plate-like portion of the rear portion in the middle shuttle, so that it is possible to prevent occurrence of friction, which would otherwise arise when the first magnet contacts the plate-like portion of the middle shuttle. Therefore, rotation of the bobbin can be made smooth, and more elaborate control of bobbin thread tension becomes possible.

The eleventh configuration can also be realized as follows. Specifically, there may also be provided a sewing-machine bobbin thread tension controller, comprising:

an outer shuttle (110) that has a circular-arc inner peripheral surface and includes a guide groove formed on a front side which is one side of the inner peripheral surface in an axial direction;

a middle shuttle (150) that rotates along the guide groove of the outer shuttle, to thus hook a needle thread, and that includes

- a race (152) formed into a circular arc along a circumferential edge of the middle shuttle and slidably supported by the guide groove,
- a rear portion (161) that continually extends from a rear-side edge of an inner circumferential edge of the race and that includes
  - a circular rear plate-like portion (162*a*) continually extending from a rear-side end of the inner circumferential edge of the race and having an aperture formed at a center thereof and
  - a rear recess (162*b*) formed in the aperture of the rear plate-like portion, and
- a shaft (184) formed on a front surface of the rear portion and along a center of rotation of the rear portion, wherein at least the rear portion and the shaft are made of a non-magnetic substance;

a middle shuttle presser (130) that is provided on a front side of the outer shuttle in order to prevent the middle shuttle accommodated in the outer shuttle from falling from the outer shuttle;

a bobbin (300) that has a hole through which the shaft of the middle shuttle passes, that is axially supported in the middle shuttle as a result of the shaft being inserted into the hole, and that has a first magnet (310) which is provided on a rear surface opposing a rear portion of the middle shuttle when the bobbin is axially supported by the shaft, and which is made of a permanent magnet assuming a ring shape and being magnetized in a plane direction substantially perpendicular to a radial direction; and a bobbin thread tension control mechanism (200) that includes

- a bobbin thread tension control motor (202) which is provided on back of the middle shuttle, which has a rotary shaft concentric to a center of rotation of the middle shuttle, and which rotates in a direction opposite to a rotating direction of the bobbin achieved when a bobbin thread wound around the bobbin is withdrawn and
- a second magnet (214) which is rotated by the bobbin thread tension control motor, which is disposed in close proximity to the rear portion of the middle shuttle, which rotates the first magnet, which is made of a permanent magnet having an outer diameter smaller than an inner diameter of the first magnet and being magnetized in the radial direction, and which is placed in the rear recess and spaced apart from the rear recess such that a front-side end of the second magnet is situated further toward the front than is a front surface of the rear plate-like portion of the rear portion of the middle shuttle.

In the eleventh configuration, the number of poles on one side of the first magnet can also be set to "m" ["m is the "n" power of 2 ("n" is an integer of one or more)], and the number of poles on one side of the second magnet can also be set to "m" ["m is the "n" power of 2 ("n" is an integer of one or more)].

In the eleventh configuration, a twelfth configuration is characterized in that the rear recess includes a tapered tubular recessed periphery (162*b*-1) that continually extends from the aperture of the rear plate-like portion and that has a gradually smaller diameter toward a front side and a recessed depth (162*b*-2) that closes an end of the recessed periphery opposite to the rear plate-like portion;

wherein a rotating body (212) has a substantially-circular-truncated-cone-shaped peripheral surface substantially parallel to a peripheral surface of the recessed periphery and, on a front side thereof, a recess for attachment of the second magnet and is attached to the rotary shaft of the bobbin thread tension control motor; and wherein the second magnet is provided in the recess of the rotating body. Accordingly, when passing by the rear side of the middle shuttle, the needle thread can smoothly pass by the same.

In the eleventh or twelfth configuration, a thirteenth configuration is characterized in that the shaft provided in the middle shuttle is situated on a front side of the corresponding recess and that the first magnet is formed to a thickness such that there is achieved a balance between magnetic force of the first magnet and magnetic force of the second magnet and that, in a state where a rear surface of the first magnet and a front surface of the second magnet are substantially aligned to each other in a longitudinal direction, a rear-side end of the part except the first magnet in the bobbin, is situated further toward the front than is a rear-side end of the shaft.

Accordingly, a rear-side end of the part except the first magnet in the bobbin, does not contact an interior of the rear recess. Therefore, friction does not occur between the rear recess and the part except the first magnet in the bobbin. The bobbin can be smoothly rotated, and bobbin thread tension can be controlled more elaborately.

A fourteenth configuration provides a sewing machine with the sewing-machine bobbin thread tension controller having any one of the first, second, third, fourth, fifth, sixth, seventh, eighth, ninth, tenth, eleventh, twelfth, and thirteenth configurations characterized in that, in a certain period that is a period including a duration from when a sewing needle has penetrated through a processed fabric until when a thread take-up lever ascends to a top dead center or at least a part of the period, the control section (40) controls rotation of the bobbin thread tension control motor in such a way that the second magnet rotates in a direction opposite to a rotating direction achieved when a bobbin thread is withdrawn from the bobbin, thereby imparting rotational force to the bobbin in the opposite direction. A degree of tightening of the needle thread and the bobbin thread can thereby be controlled elaborately and accurately.

Advantages of the Invention

In the sewing-machine bobbin thread tension controller of the present invention, the tension of a bobbin thread is controlled by means of the second magnet rotated by the bobbin thread tension control motor and the first magnet provided in the bobbin. The tension of the bobbin thread can be controlled without depending on the frictional force. When compared with a case where tension is controlled by means of friction between the bobbin thread and another member, tension control can be performed more accurately. Moreover, the tension imparted to the bobbin thread is controlled by means of a value of an electric current applied to the bobbin thread tension control motor. The bobbin thread tension is proportional to a current value, and hence bobbin thread tension can be elaborately controlled by elaborate control of the current value. Moreover, the bobbin thread tension can be freely controlled by means of the bobbin thread tension control motor during operation of the sewing machine.

Further, in a case where the sewing machine is an embroidery sawing machine, even when the embroidery sewing machine is a multi-head embroidery sewing machine including a plurality of embroidery heads, the respective embroidery heads can equally control the bobbin thread tension by means of making equal bobbin thread tension control data that are data for controlling the respective bobbin thread tension control motors.

The middle shuttle has the bobbin accommodation section, and the bobbin accommodated in the bobbin accommodation section remains stably accommodated in the bobbin accommodation section as a result of the first magnet being attracted by the second magnet. Therefore, there is no necessity to additionally provide the middle shuttle with a mechanism for attaching a bobbin. Moreover, the bobbin can be easily accommodated in the bobbin accommodation section by means of attractor force stemming from the first magnet and the second magnet.

BRIEF DESCRIPTION OF THE DRAWINGS

FIG. 10 It is a descriptive view showing virtual main spindle data.

FIG. 11 It is a descriptive view showing needle bar data.

FIG. 12 It is a descriptive view showing shuttle actuation data.

FIG. 13 It is a descriptive view showing bobbin thread tension control data.

MODE FOR IMPLEMENTING THE INVENTION

Figure 1:
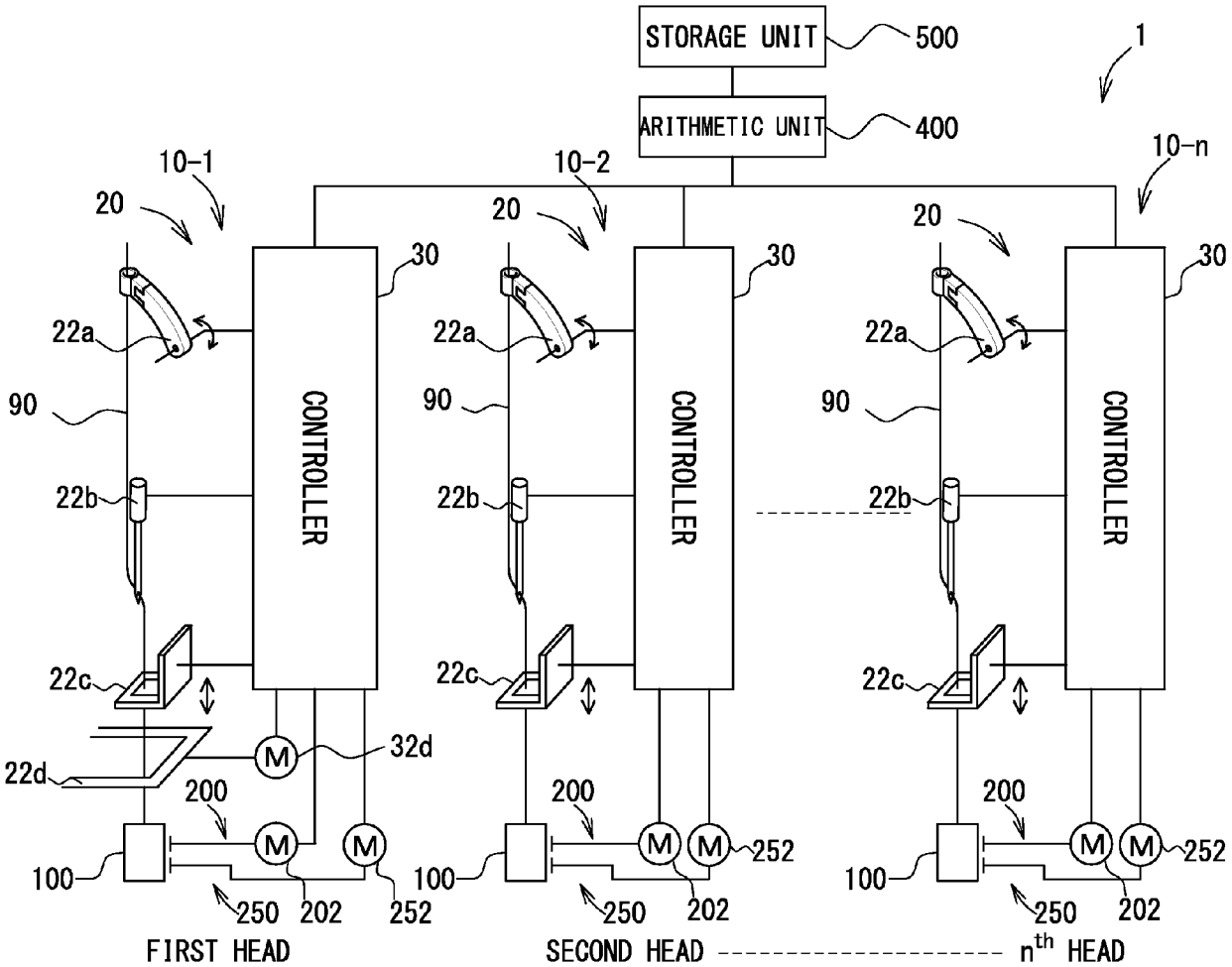
FIG. 1 It is a descriptive view showing a configuration of embroidery sewing machines of first and second embodiments.

The present invention accomplishes as follows an objective of providing a sewing-machine bobbin thread tension controller capable of effecting elaborate and accurate control of bobbin thread tension without depending on frictional force.

First Embodiment

An embroidery sewing machine 1 serving as a sewing machine based on the present invention is configured as shown in FIGS. 1 through 13. The sewing machine includes a sewing machine table 3; embroidery heads 10-1 to **10-*n*; a sewing frame (which can also be embodied as a holder frame or an embroidery frame) 22*d*; a frame actuation motor 32*d*; shuttles 100; bobbin thread tension control mechanisms 200; shuttle actuation units 250; bobbins 300; an arithmetic unit 400; and a storage unit 500**.

Figure 4:
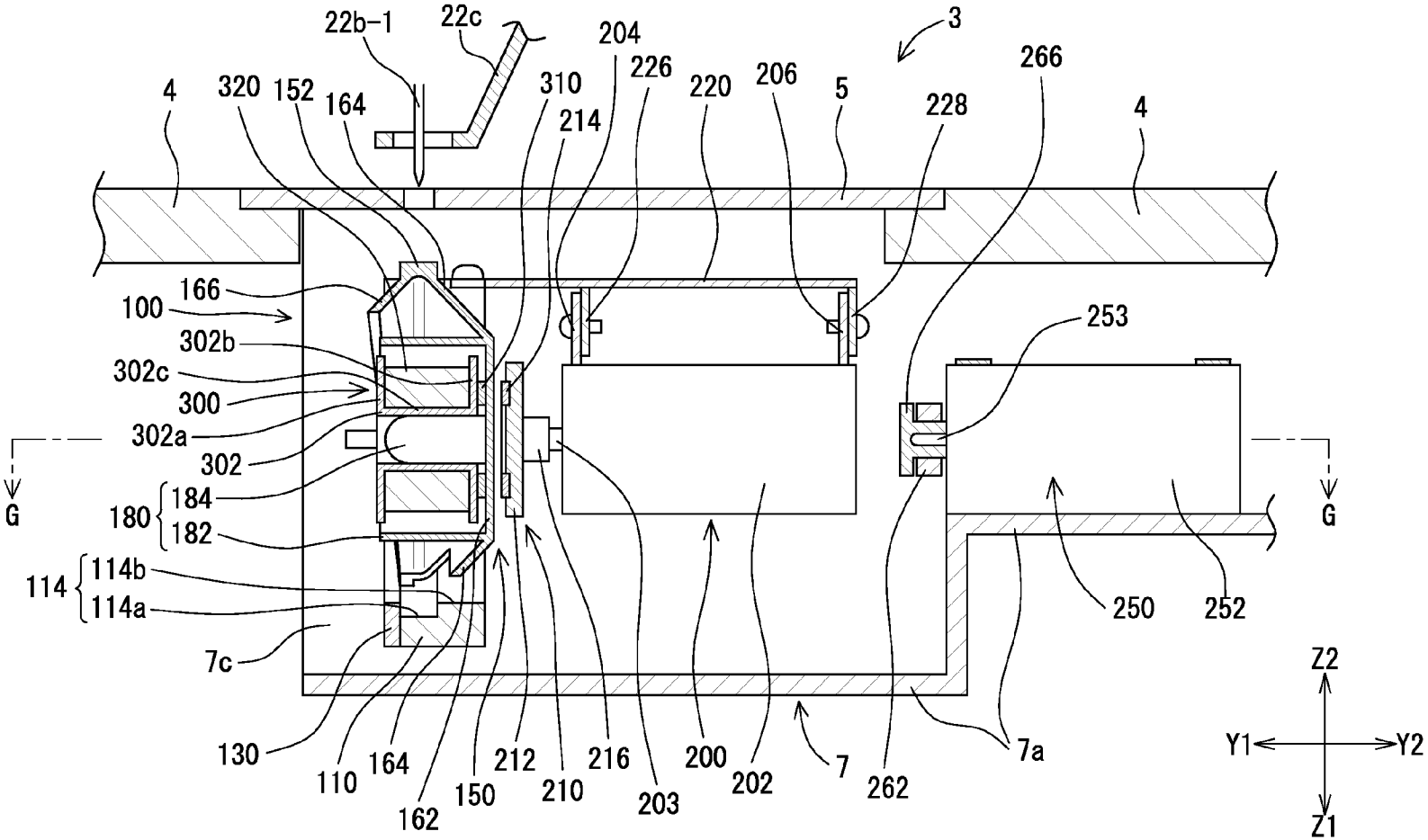
FIG. 4 It is a longitudinal sectional view of the embroidery sewing machine of the first embodiment.
Figure 5:
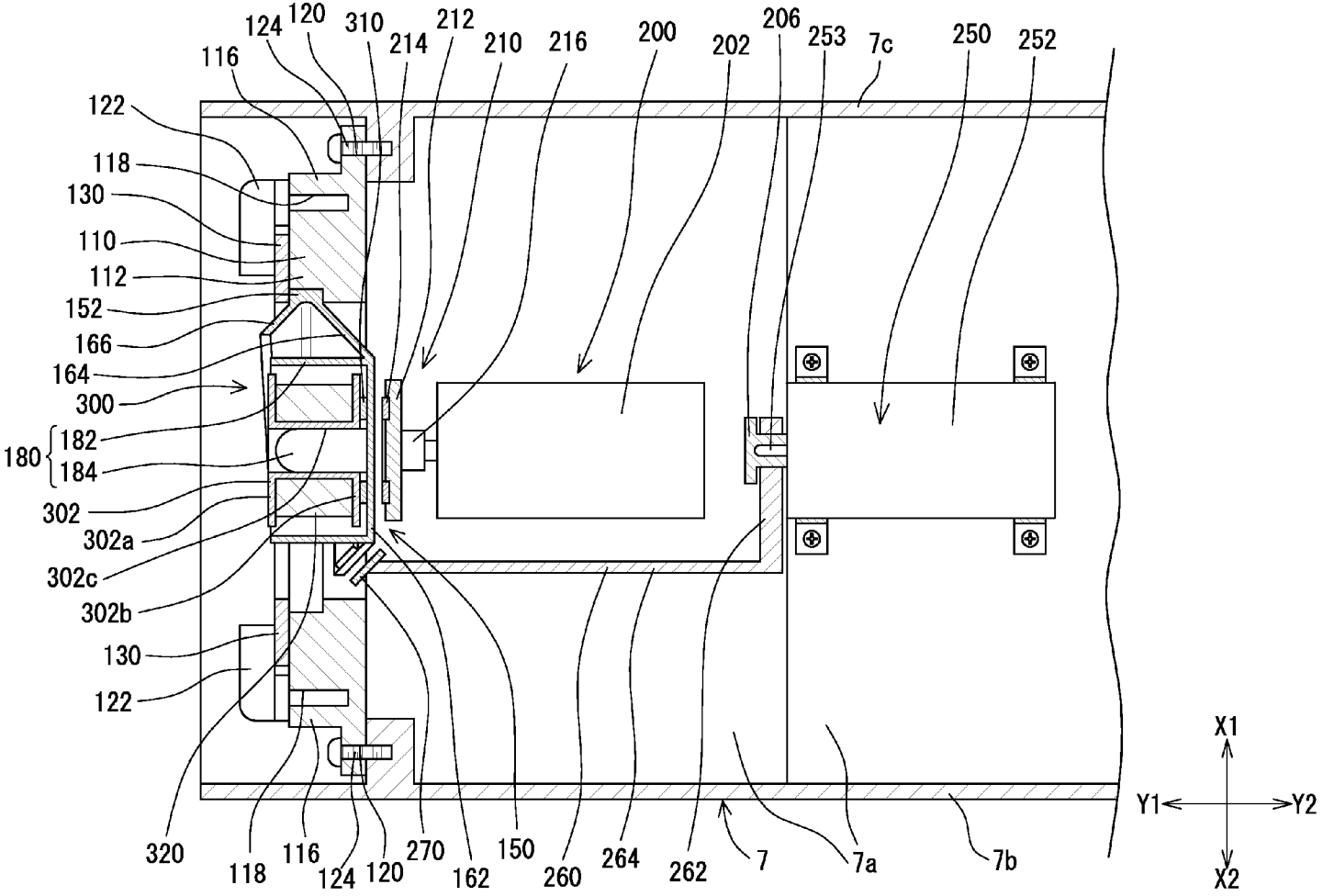
FIG. 5 It is a transverse sectional view of the embroidery sewing machine of the first embodiment; namely, a cross sectional view of the same taken along line G-G shown in FIG. 4.
Figure 6:
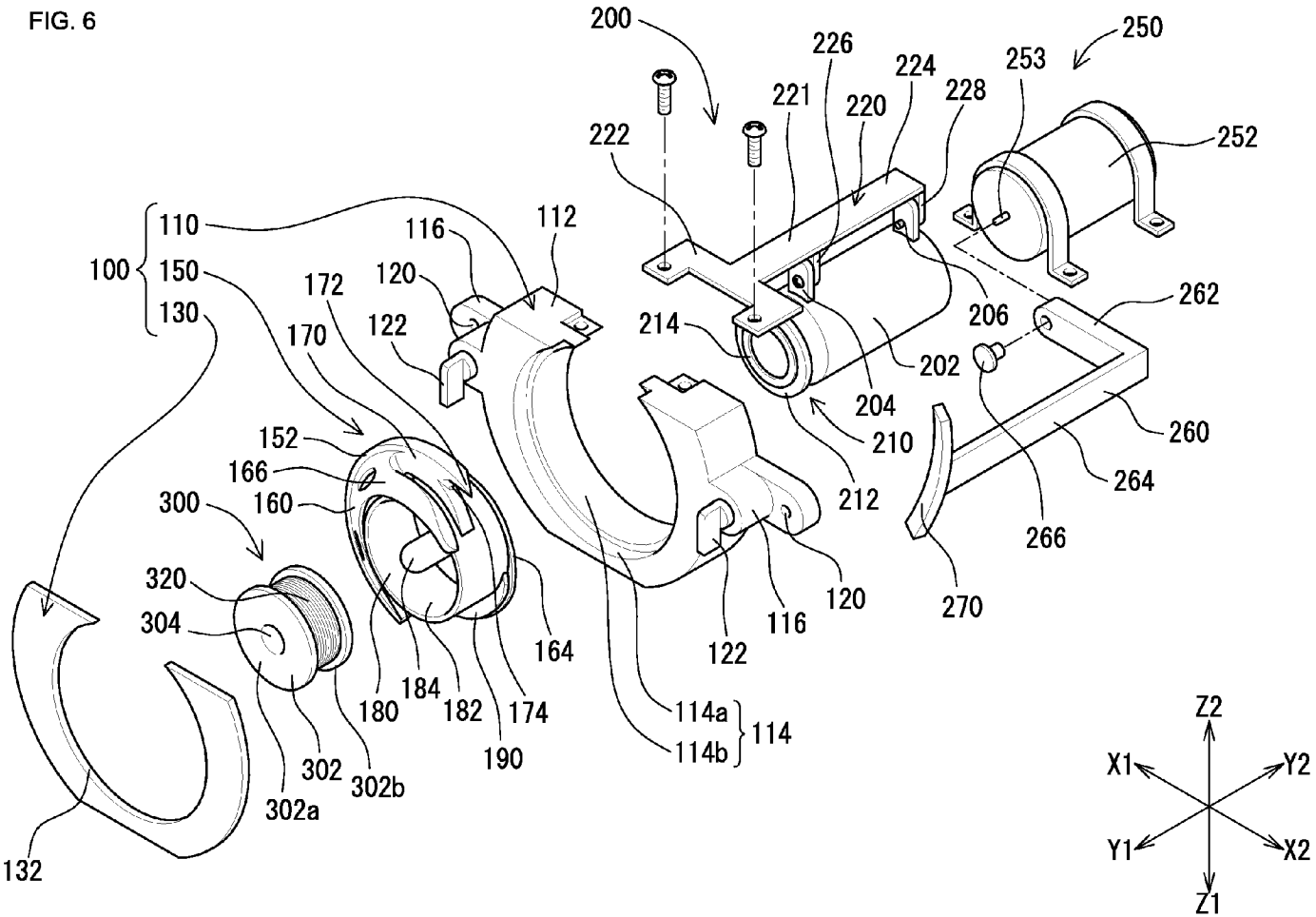
FIG. 6 It is a forward exploded perspective view of a shuttle, a bobbin thread tension control mechanism, a shuttle actuation unit, and a bobbin in the embroidery sewing machine of the first embodiment.
Figure 7:
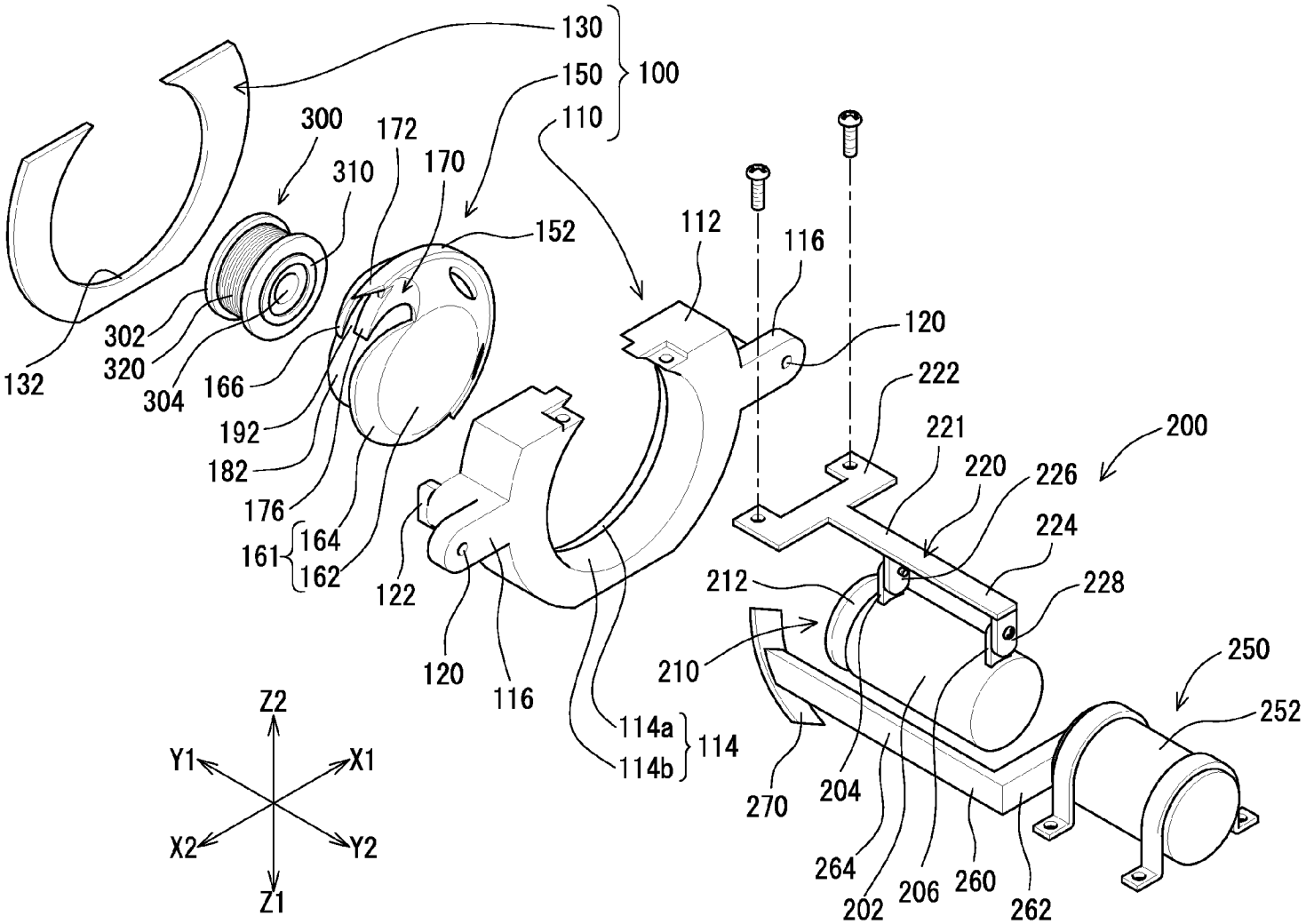
FIG. 7 It is a backward exploded perspective view of the shuttle, the bobbin thread tension control mechanism, the shuttle actuation unit, and the bobbin in the embroidery sewing machine of the first embodiment.

The sewing machine table 3 assuming a substantially flat shape includes, as shown in FIG. 4, a plate-like table body 4 and a throat plate 5 positioned in an aperture formed in the table body 4.

The embroidery heads 10-1 to **10-*n* are disposed above the sewing machine table 3, and respective embroidery heads in the embroidery heads 10-1 to 10-*n*** are arranged at predetermined intervals in a substantial linear layout. Specifically, frames (not shown) stand upright on an upper surface of the sewing machine table, and the respective embroidery heads are disposed on front sides of the frames.

Figure 2:
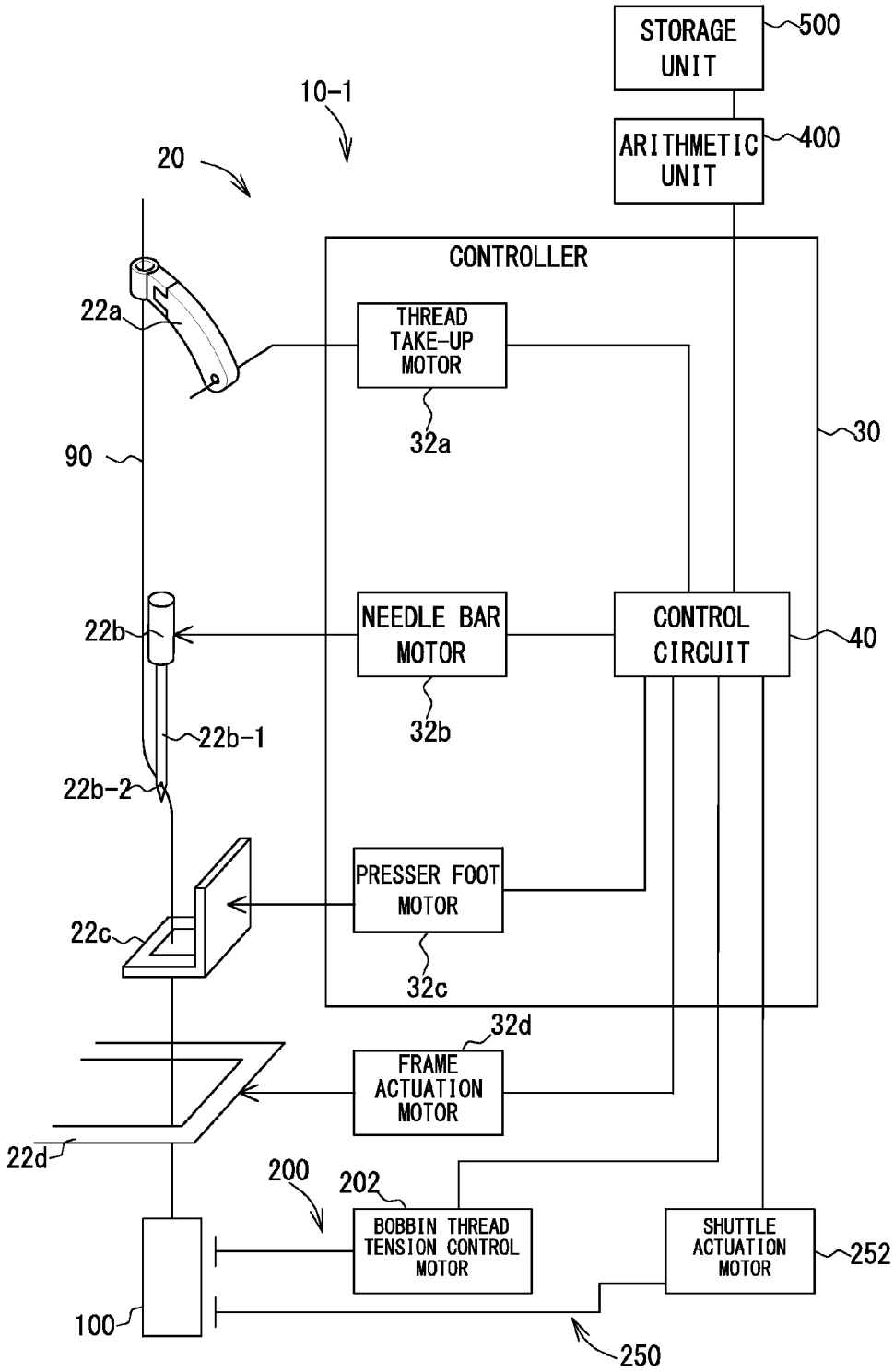
FIG. 2 It is a descriptive view of essential parts of the embroidery sewing machines of the first and second embodiments.

The respective embroidery heads in the embroidery heads 10-1 to **10-*n* assume a similar configuration. The configuration of the embroidery head is now described by means of taking the embroidery head 10-1 as an example. The embroidery head 10-1, which is configured as shown in FIG. 2, includes a machine element group 20, a controller 30**, and a case (not shown).

The machine element group 20 includes respective machine elements to be actuated by means of the respective embroidery heads. The machine elements include a thread take-up lever **22*a*, a needle bar 22*b*, and a presser foot 22*c***.

Figure 3:
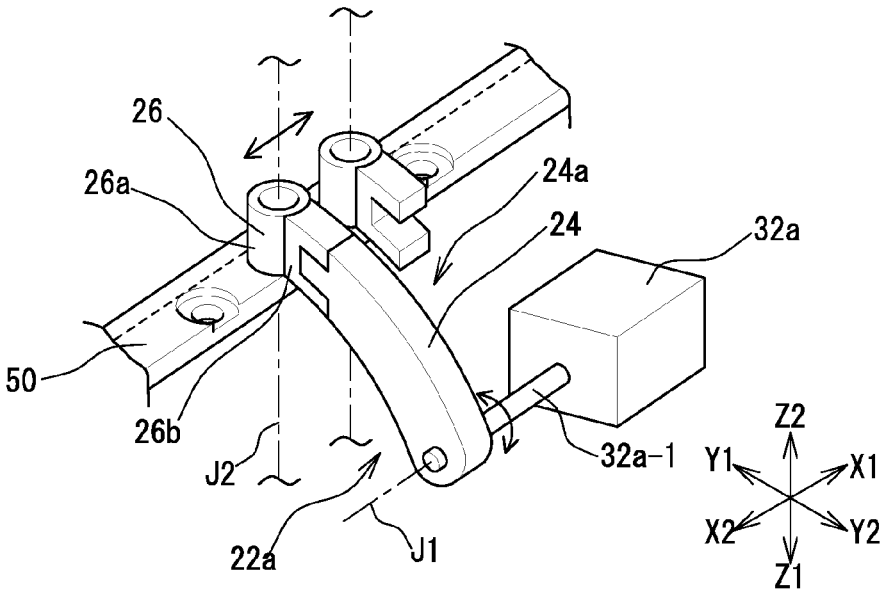
FIG. 3 It is an oblique perspective view of the essential parts of the embroidery sewing machines of the first and second embodiments.

The thread take-up lever **22*a* is formed so as to be swayable around an axial line along a horizontal direction (a direction of X1-X2) with respect to the case. Specifically, as shown in FIG. 3, a rotary shaft (a motor shaft) 32*a*-1 of a thread take-up motor 32*a* is inserted into a base end of the thread take-up lever 22*a*, and the thread take-up lever 22*a* turns around the rotary shaft 32*a*-1**.

Specifically, the thread take-up levers **22*a* have a function of pulling a needle thread 90. As shown in FIG. 3, each of the thread take-up levers 22*a* has a thread take-up arm 24 attached to the rotary shaft 32*a*-1 of the thread take-up motor 32*a* and a thread take-up lever leading end 26 disposed in correspondence with an individual needle bar of the plurality of needle bars. The plurality of thread take-up lever leading ends 26 are disposed on a support plate 50 of a needle bar case (not shown). The needle bar case is slid along its horizontal direction, whereupon the thread take-up lever leading end 26 engaged with the thread take-up arm 24 performs turning action while remaining supported by the thread take-up arm 24**.

Specifically, the thread take-up arm 24 assumes a geometry of a bow-shaped plate; namely, a shape of a plate curved downwardly with an increasing distance toward a leading end of the plate. A hole is horizontally opened in a base end of the thread take-up arm 24, and the rotary shaft **32*a*-1 is inserted into the hole. Thus, the base end is fastened to the rotary shaft 32*a*-1. Specifically, the hole opened in the base end of the thread take-up arm 24 and an axial line J1 of the rotary shaft 32*a*-1 are oriented in the horizontal direction. The leading end side of the thread take-up arm 24 is formed so as to be able to engage with the corresponding thread take-up lever leading end 26. In the embodiment shown in FIG. 3**, the leading end side is formed into a protruding shape when viewed in side elevation.

Incidentally, the thread take-up motor **32*a* is disposed on the arm side in the case. In other words, the thread take-up motor 32*a* and the thread take-up arm 24** do not perform sliding action even when the needle bar case has made horizontal sliding action.

Moreover, the plurality of thread take-up lever leading ends 26 have the same configuration. Each of the thread take-up lever leading ends 26 has a needle threader 26*a* and a connector portion 26*b* formed integrally with the needle threader 26*a*.

While remaining disengaged with the corresponding thread take-up arms 24 and unactuated, the plurality of thread take-up lever leading ends 26 are disposed on the support plate 50 placed in the needle bar case along its horizontal direction. The thread take-up lever leading ends 26 that has been engaged with the corresponding thread take-up arms 24 as a result of horizontal sliding action of the needle bar case rotate while being supported by the respective thread take-up arms 24.

The needle bar 22*b* is set such that it can be actuated in the vertical direction. A sewing needle 22*b*-1 is fastened to a lower end of the needle bar 22*b* (i.e., the needle thread is inserted into a pinhole 22*b*-2 of the sewing needle 22*b*-1), and a needle bar connecting stud (not shown) is fixedly provided on an upper end of the needle bar 22*b*. In fact, one embroidery head is provided with a plurality of needle bars 22*b*, and the plurality of needle bars 22*b* are supported by the needle bar case. A needle bar selected by horizontal sliding action of the needle bar case is vertically actuated.

The presser foot 22*c* is secured to a lower end of a lift rod (not shown). The presser foot is vertically actuated by means of vertical actuation of the lift rod. Incidentally, the presser foot 22*c* is provided for each embroidery head.

As shown in FIG. 2, the controller 30 has the thread take-up motor 32*a*, a needle bar motor 32*b*, a presser foot motor 32*c*, and a control circuit (a control section) 40.

The thread take-up motor 32*a* is a motor for swaying the corresponding thread take-up lever 22*a*. The thread take-up motor rotates forwardly and backwardly, and an axial line of the rotary shaft is directed along the horizontal direction (i.e., the direction of X1-X2). Further, the needle bar motor 32*b* is a motor for vertically actuating the corresponding needle bar 22*b*. The presser foot motor 32*c* is also a motor for vertically actuating the corresponding presser foot 22*c*.

Furthermore, the control circuit 40 is a circuit that controls operations of respective motors; namely, operation of the thread take-up motor 32*a*, that of the needle bar motor 32*b*, that of the presser foot motor 32*c*, that of the frame actuation motor 32*d*, that of a bobbin thread tension control motor 202, and that of a shuttle actuation motor 252. Pursuant to data sent from the arithmetic unit 400, the control circuit controls operations of the respective motors. Specifically, the control circuit 40 controls operation of the respective motors for the respective machine elements (e.g., the thread take-up motor 32*a*, the needle bar motor 32*b*, the presser foot motor 32*c*, the frame actuation motor 32*d*, the bobbin thread tension control motor 202, and the shuttle actuation motor 252) according to the virtual main spindle data and the data pertaining to the respective machine elements (see FIG. 11 as data for the case of the needle bar) transmitted from the arithmetic unit 400.

For instance, the control circuit 40 controls the operation of the shuttle actuation motor 252 according to the virtual main spindle data and the shuttle actuation data (see FIG. 12) transmitted from the arithmetic unit 400. Moreover, according to the virtual main spindle data and the bobbin thread tension control data (FIG. 13) transmitted from the arithmetic unit 400, the control circuit 40 controls operation of the bobbin thread tension control motor 202.

The case (not shown), which makes up an enclosure of the embroidery head 10-1, has an arm fixed to the frame and the needle bar case that performs sliding action in a horizontal direction (the direction X1-X2) with respect to the arm and that is provided on the front of the arm. The thread take-up motor 32*a*, the needle bar motor 32*b*, the presser foot motor 32*c*, and the control circuit 40 are disposed in the arm.

The sewing frame 22*d*, which is a frame-like member for holding a processed fabric under tension, is disposed at an elevated position above the sewing machine table 3 (or on an upper surface of the sewing machine table). Moreover, the frame actuation motor 32*d* is a motor for actuating the sewing frame 22*d*.

The shuttle 100 is disposed, for each embroidery head, at each of positions below the respective embroidery heads 10-1 to 10-*n* and below the upper surface of the sewing machine table 3. Specifically, the shuttles 100 are supported by respective shuttle bases 7 positioned below the sewing machine table 3. In the present embodiment, each of the shuttle bases 7 includes side surfaces 7*b* and 7*c* attached to a lower surface of the table body 4 and a bottom surface 7*a* interposed between a lower end of the side surface 7*b* and a lower end of the side surface 7*c*.

As shown in FIGS. 4 through 8, the shuttle 100 has an outer shuttle 110, a middle shuttle presser (a shuttle body presser) 130, and a middle shuttle (a shuttle body) 150.

The outer shuttle 110, which is a substantially-ring-shaped member having an open upper portion, includes an outer middle shuttle 112 and mounts 116 projecting from respective sides of the outer middle shuttle 112.

A substantially columnar cutout 114 is formed in the outer middle shuttle 112, and a transverse sectional view of the cutout 114 assumes a circular shape whose upper end is horizontally cut. The cutout 114 makes up a circular-arc inner peripheral surface. A step is formed in the cutout 114 in the form of a circumference, and a part of the cutout facing the middle shuttle presser 130 is formed so as to assume a diameter that is greater than a diameter of a remaining side of the cutout opposite to the step. The cutout 114 includes a large diameter portion (a guide groove) 114*a* facing the middle shuttle presser 130 (i.e., a front side) and a small diameter portion 114*b* that is the opposite of the large diameter portion. A race 152 of the middle shuttle 150, fitted into the large diameter portion 114*a*, makes sliding action along the large diameter portion 114*a*. Specifically, an inner diameter of the large diameter portion 114*a* is made substantially equal to or slightly larger than an outer diameter of the race 152. The smaller diameter portion 114*b* is made so as to become smaller than the outer diameter of the race 152 of the middle shuttle 150, whereby the middle shuttle 150 positioned in the outer shuttle 110 will not fall off in the direction opposite to the middle shuttle presser 130.

Levers 122 used for fastening the middle shuttle presser 130 to the outer shuttle 110 are attached to both sides of the outer shuttle 110. Further, the mounts 116 used for attaching the outer shuttle 110 to the shuttle base 7 are also projectingly formed on both sides of the outer shuttle 110. Specifically, a support hole 118 used for axially supporting the corresponding lever 122 in a turnable fashion is opened in each of the mounts 116. Further, formed outside the support hole 118 is a hole 120 for insertion of a screw 124 used for fastening the outer shuttle 110 to the shuttle base 7.

The middle shuttle presser 130 is a substantially ring shaped plate member whose upper portion is opened, and a substantially columnar cutout 132 is formed in the middle shuttle presser 130. When viewed from the front, the cutout 132 assumes a shape determined by horizontally cutting an upper end of a circle. An inner diameter of the cutout 132 formed in the middle shuttle presser 130 is made smaller than the outside diameter of the race 152 of the middle shuttle 150 and substantially equal to the inner diameter of the small diameter portion 114*b* of the outer shuttle 110. In the middle shuttle 150 placed in the outer shuttle 110, a part of the middle shuttle 150 facing the middle shuttle presser 130 is thereby covered, so that the middle shuttle 150 will not fall off toward the middle shuttle presser 130.

The middle shuttle presser 130 is brought into contact with a part of the outer shuttle 110 opposite to its part facing the bobbin thread tension control motor 202. The levers 122 are latched onto the middle shuttle presser 130. The outer shuttle 110 and the middle shuttle presser 130 are thereby integrated.

The middle shuttle 150 is placed in a rotatable manner within the outer shuttle 110 to which the middle shuttle presser 130 is attached. The middle shuttle 150 includes the race 152, a main middle shuttle 160, a leading end 170, a bobbin accommodation section 180, and a magnet (a third magnet) 190. A main body configuration section is built from a configuration except the magnet 190 in the middle shuttle 150; namely, the race 152, the main middle shuttle 160, the leading end 170, and the bobbin accommodation section 180.

The race 152 assumes a shape of a substantially circular-arc plate; namely, a shape defined by forming a circular-arc shape from a rod-shaped plate-like member. An exterior surface of the race 152 is formed so as to be slidable along the large diameter portion 114*a* of the outer shuttle 110.

The entirety of the main middle shuttle 160 is formed from a plate-like member. The main middle shuttle has a rear portion 161 and a front-side tapered portion 166. The rear portion 161 is provided so as to be continual rearwardly from an inner rear-side end of the race 152. The front-side tapered portion 166 is provided so as to be continual forwardly from an inner front-side end of the race 152.

The rear portion 161 has a rear-side body 162 assuming a circular plate-like shape and a rear-side tapered portion 164. The rear-side tapered portion 164 is provided so as to be continual from the inner rear-side end of the race 152 as well as from an edge of the rear-side body 162.

Specifically, the rear-side body 162, which has an outer diameter that is smaller than the inner diameter of the race 152, forms a plane that is at right angles with respect to a center of rotation of the middle shuttle 150. The rear-side body 162 is situated rearwardly with reference to the rear-side end of the race 152.

The rear-side tapered portion 164 is formed like a substantially tapered plate and between the rear-side inner end of the race 152 and the edge of the rear-side body 162. The rear-side tapered portion 164 also assumes a shape defined by cutting away a portion of a cone (strictly speaking, a side portion of a cone) formed between the rear-side inner end of the race 152 and the edge of the rear-side body 162. Specifically, the rear-side tapered portion 164 is made up of a first region 164*a* and a second region 164*b*. The first region 164*a* corresponds to an area that, when viewed from the front, extends from a lower end position P to a position Q which is situated in a left circumferential direction with reference to a position of a thread guard 174 (the position Q substantially matches a position of a base end of a cutout 192 situated between a pointed portion 176 of the leading end 170 and the front-side tapered portion 166, in a circumferential direction). The second region 164*b* is an area of the rear-side tapered portion except the first region 164*a*. The first region 164*a* is formed so as to extend from a peripheral end of the rear-side body 162 to the inner end of the race 152. When viewed from the front, a width of the first region is made so as to assume $\alpha$ with respect to a direction of a straight line running through a center of the rear-side body 162. The second region 164*b* is formed so as to become narrower in width than the first region 164*a*. When viewed from the front, the width of the second region is made so as to assume $\beta$ with respect to the direction of the straight line running through the center of the rear-side body 162, so that a relationship of $\alpha>\beta$ stands. The width $\beta$ is determined as a width that does not pose any hindrance when the needle thread put on the thread guard 174 departs from the thread guard 174, to thus be pulled upward, and that allows mounting of the magnet 190. The width $\beta$ is determined to be about one-half of the width $\alpha$ or less. However, the width $\beta$ makes up the following geometry. Namely, the width $\beta$ remains substantially constant in a region from the position P to a position S that is situated between a position attained through a 90-degree counterclockwise turn from the position P when viewed from the front and a position attained through a 180-degree counterclockwise turn from the position P. Further, the width $\beta$ becomes gradually smaller counterclockwise from the position S to an end of the first region 164*a* spaced counterclockwise from the position S when viewed from the front. In the embodiment shown in FIG. 8, an angle that the position P forms with the position Q when viewed from the front ranges from 140 to 150 degrees, and an angle that the position P forms with the position S ranges from 120 to 130 degrees. Substantially elliptical apertures K are opened in several positions on the rear-side tapered portion 164.

Figure 8:
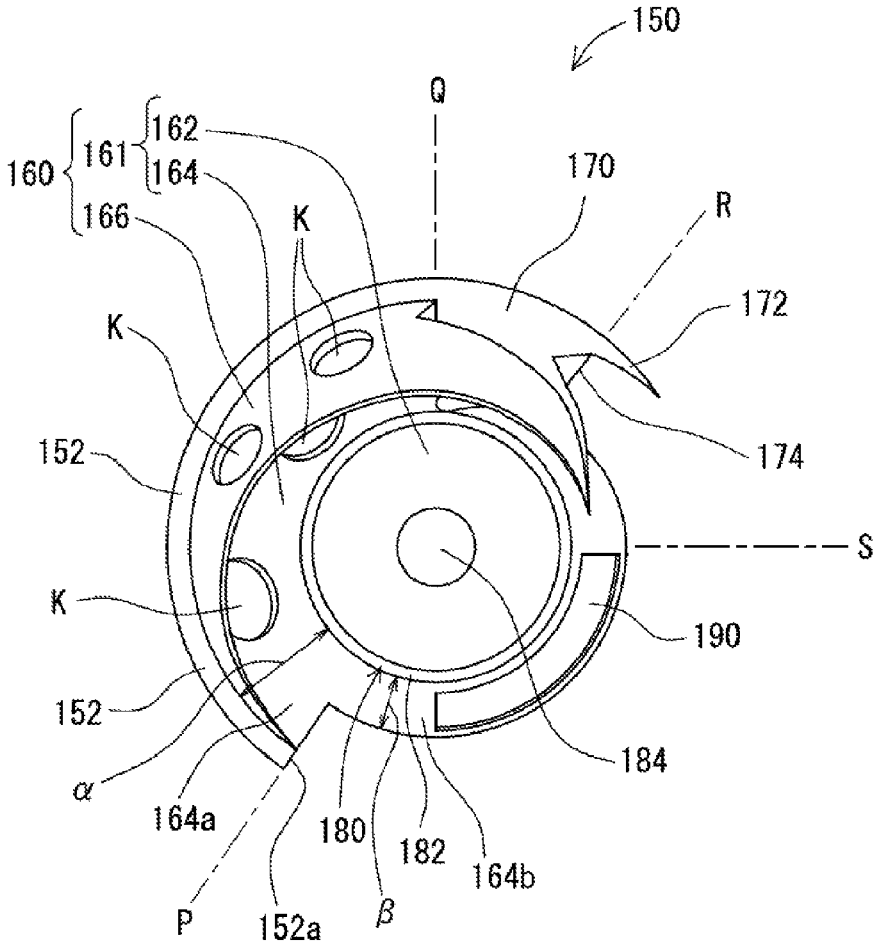
FIG. 8 It is a front view of a middle shuttle.

The front-side tapered portion 166 is formed from the inner front-side end of the race 152 toward the front side and is formed into a plate that extends, while being sloped toward the inside (i.e., toward the center of rotation). Specifically, the front-side tapered portion 166 is formed from a portion of a conical shape that is a symmetrical image of a conical shape made by the rear-side tapered portion 164. When viewed from the front, the front-side tapered portion 166 is formed so as to become narrower in the clockwise direction from the position Q. Even in the counterclockwise direction, the front-side tapered portion 166 is formed so as to become narrower toward a tail end 152*a* of the race 152 from the position Q. A clockwise end of the front-side tapered portion 166 achieved when viewed from the front is formed so as to project further outside than is a point 172 along the circumferential direction. A counterclockwise end of the front-side tapered portion 166 achieved when viewed from the front is formed up to a position of the tail end 152*a* in the circumferential direction. As shown in FIG. 8, a front-side end of the front-side tapered portion 166 is formed much outside when compared with an outer periphery of a cylindrical tubular portion 182. The front-side tapered portion 166 is formed so as not to lie in the way of the bobbin 300 when the bobbin is housed in the bobbin accommodation section 180.

The leading end 170 is formed so as to extend from an end of the race 152 (i.e., an end opposite to the tail end 152*a*) in the circumferential direction. An exterior surface of the leading end 170 is formed along an outer peripheral surface of the race 152, and the sharp point 172 is formed at an extremity of the leading end 170. The thread guard 174, forming a plane perpendicular to the circumferential direction, is provided on the inside of a base end of the point 172. The pointed portion 176, assuming a sharp geometry projecting from the thread guard 174 in the circumferential direction, is formed on the inside of the thread guard 174. The sharp cutout 192 is formed between the pointed portion 176 and the front-side tapered portion 166, so as to become bifurcated by means of the pointed portion 176 and the leading end of the front-side tapered portion 166. A rear side of the leading end 170 (i.e., an area between the rear side of the pointed portion 176 and the rear-side tapered portion 164) is formed in a smooth recess toward the end of the rear-side tapered portion 164.

The bobbin accommodation section 180 has the cylindrical tubular portion 182 and a shaft 184. The cylindrical tubular portion 182 is fixed to a front-side surface of the rear-side body 162. Specifically, an outside diameter of the tubular portion 182 is essentially identical with the diameter of the rear-side body 162. The tubular portion 182 is fixed to the front side of the rear-side body 162. The tubular portion 182 is naturally formed to a size that enables accommodation of the bobbin 300. A longitudinal direction (a direction Y1-Y2) of the tubular portion 182 is formed so as to become equal to or longer than the bobbin 300 in its longitudinal direction. The shaft 184, formed in an axial shape that can be inserted into the bobbin 300, is fixed to the front-side surface of the rear-side body 162. Namely, the shaft 184 is made in such a way that an axial center core of the shaft 184 is aligned to an axial center core of the tubular portion 182. By means of presence of the tubular portion 182, it is possible to prevent a bobbin thread 320 wound around the bobbin 300 from getting loose from the bobbin 300. In particular, it may be a case where a wound bobbin thread will bulge out of the bobbin depending on a material of the bobbin thread; for instance, where the bobbin thread is polyester. For this reason, the fall of the bobbin thread 320 from the bobbin 300 can be prevented by means of presence of the tubular portion 182.

The magnet 190, a permanent magnet, is affixed to a front-side surface of the second region 164*b* of the rear-side tapered portion 164. Specifically, the magnet 190 is provided in a region outside of the tubular portion 182 on a front-side surface of the second region 164*b* of the rear-side tapered portion 164 (to be more specific, a region having the same width as that of the second region 164*b*), so as to extend from a right end to a lower end when viewed from the front. The magnet 190, assuming a fan-shaped plate, is formed so as to make a curve matching a shape of the front-side surface of the rear-side tapered portion 164. The magnet 190 can also be fixedly provided on a rear surface of the second region 164*b* of the rear-side tapered portion 164. In other words, the magnet 190 is provided on a front side or a rear side of an outer-peripheral-side area (i.e., the rear-side tapered portion 164) of the rear portion 161 of the middle shuttle 150; more specifically, a portion (i.e., the rear-side body 162) of the rear portion 161 facing an area of the bobbin 300 where a magnet 310 is provided. A magnet 270 can be caused to approach the magnet 190 without obstructing the bobbin thread tension control mechanism 200.

A structure of the middle shuttle 150 except the magnet 190 (at least the rear portion 161 and the bobbin accommodation section 180) is made of a non-magnetic substance (e.g., aluminum and stainless steel). Specifically, the magnet 310 is provided in the bobbin 300. The structure of the middle shuttle 150 except the magnet 190 is made of a non-magnetic substance so as to prevent the magnet 310 from adhering to the rear-side body 162.

The bobbin thread tension control mechanism 200, provided at a rear of the outer shuttle 110, has the bobbin thread tension control motor 202, a rotary disc 210 attached to a rotary shaft 203 of the bobbin thread tension control motor 202, and a support 220 for supporting the bobbin thread tension control motor 202 in the outer shuttle 110.

The bobbin thread tension control motor 202 is built so as to be rotatable in both forward and backward directions and such that an axial center core of the rotary shaft 203 is aligned to an axial center core of the shaft 184 in the middle shuttle 150. Mounts 204 and 206, used for mounting the motor to the support 220, are provided at a front-side end and a rear-side end on an upper portion of the bobbin thread tension control motor 202.

Figure 9:
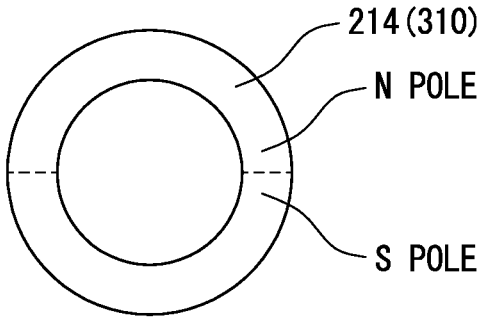
FIG. 9 It is a descriptive view showing a configuration of a magnet 214 and a magnet 310.
Figure 19:
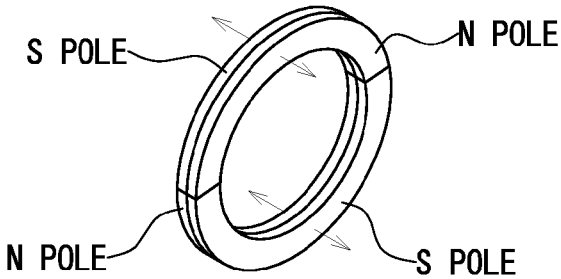
FIG. 19 It is a descriptive view showing an example magnet.
Figure 19:
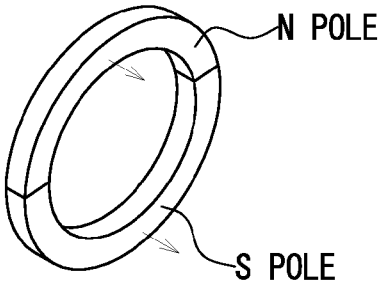
Figure 19:
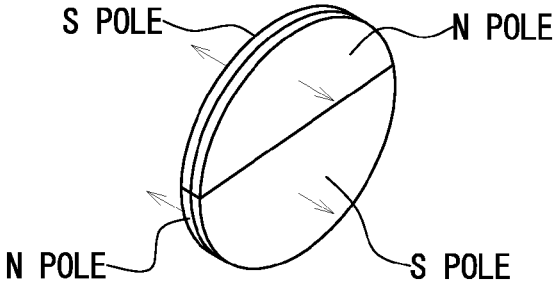
Figure 19:
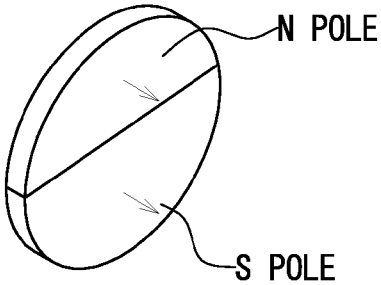

The rotary disc 210 has a circular plate-shaped rotary disc body (a rotor plate) (can also be embodied as a "rotating body") 212, a ring-shaped magnet (a second magnet) 214 attached to a front-side surface of the rotary disc body 212, and a tubular portion 216 provided on a rear surface of the rotary disc body 212. The tubular portion 216 is axially, fixedly supported by the rotary shaft 203 of the bobbin thread tension control motor 202. Thereby, as a result of the rotary shaft 203 of the bobbin thread tension control motor 202 being rotated, the rotary disc body 212 is rotated. Rotation of the rotary disc body 212 also results in rotation of the magnet 214. The magnet 214, a permanent magnet, is configured as shown in FIG. 9 such that one of partitions defined by means of a plane extending along the center of rotation comes to exhibit an N pole and that a remaining one of the partitions comes to exhibit an S pole. A direction of magnetization of the magnet 214 corresponds to a plane direction (can also correspond to a thicknesswise direction). The direction of magnetization corresponding to the plane direction means that lines of magnetic force originate principally from the magnet 214 in its thicknesswise direction [i.e., from a thicknesswise plane of the magnet 214 (a planar portion of the magnet 214) in its thicknesswise direction]. There is another meaning that, in a state of the magnet 214 being attached to the rotary disc body 212, the lines of magnetic force exit principally from the magnet 214 and substantially in parallel to the axial line of the rotary shaft 203 of the bobbin thread tension control motor 202. Specifically, the magnet 214 is a magnet both sides of which exhibit four poles, such as that shown in FIG. 19(*a*). Alternatively, the magnet 214 can also be a magnet either side of which exhibits two poles, as shown in FIG. 19(*b*). The magnet 214 does not need to assume a ring shape, so long as the magnet is magnetized in its plane direction. The magnet 214 may assume; for instance, a columnar shape. In other words, the magnet 214 can also be a magnet both sides of which exhibit four poles, such as that shown in FIG. 19(*c*). Alternatively, the magnet 214 can also be a magnet either side of which exhibits two poles, as shown in FIG. 19(*d*). The essential requirement for the magnet 214 is that at least one side of the magnet be formed so as to exhibit two poles.

The support 220 has a plate 221 and mounts 226 and 228 downwardly projecting from a lower surface of the plate 221. Specifically, the plate 221 has a substantially C-shaped portion 222 and a plate portion 224 extending from a rear-side end of the C-shaped portion 222 toward the rear side. One of a pair of leading ends on a front of the C-shaped portion 222 is fastened to one of a pair of upper ends of the outer shuttle 110, and the other of the leading ends of the C-shaped portion 222 is fastened to the other upper end of the outer shuttle 110. The mount 226 is fastened to the mount 204, and the mount 228 is fastened to the mount 206, whereby the support 220 supports the bobbin thread tension control motor 202.

In a state where the support 220 of the bobbin thread tension control mechanism 200 is fastened to the outer shuttle 110, the magnet 214 of the rotary disc 210 remains in close proximity to, at spacing, the rear surface of the rear-side body 162 of the middle shuttle 150 placed in the outer shuttle 110.

Each of the shuttle actuation units 250 includes the shuttle actuation motor 252, an arm 260 axially supported by a rotary shaft (a second rotary shaft) 253 of the shuttle actuation motor 252, and the magnet (a fourth magnet) 270 provided at a leading end of the arm 260.

The shuttle actuation motor 252 is provided at a rear of the bobbin thread tension control motor 202. An axial line of the rotary shaft 253 of the shuttle actuation motor 252 is set so as to be aligned to the axial center core of the rotary shaft 203 of the bobbin thread tension control motor 202. The shuttle actuation motor 252 is mounted on the bottom surface 7*a* of the shuttle base 7.

The arm 260, assuming a substantially L-shaped geometry as a whole, has a substantially rod-shaped base end 262 and a leading end 264 continually extending from an extremity of the base end 262. The base end 262 is positioned in a direction orthogonal to the axial line of the rotary shaft 253 of the shuttle actuation motor 252, whereas the leading end 264 is positioned in parallel to the axial line of the rotary shaft 253 of the shuttle actuation motor 252. A length of the base end 262 is set such that the leading end 264 does not contact the shuttle actuation motor 252 and that the magnet 270 attached to an extremity of the leading end 264 is located at a rear of the magnet 190. Likewise, a length of the leading end 264 is also set such that the magnet 270 comes close to the back of the rear-side tapered portion 164.

The magnet 270, a permanent magnet, assumes the geometry of a fan-shaped plate. The magnet 270 is curved in agreement with the geometry of the rear surface of the rear-side tapered portion 164, so as to come as much close as possible to the rear surface of the rear-side tapered portion 164 of the middle shuttle 150.

The magnet 270 and the magnet 190 are configured so as to attract each other. When a surface of the magnet 270 facing the rear-side tapered portion 164 of the middle shuttle 150 exhibits either the N pole or the S pole, a surface of the magnet 190 facing the rear-side tapered portion 164 is set so as to exhibit the remaining pole. When the shuttle actuation motor 252 is driven, the rotary shaft 253 of the shuttle actuation motor 252 is thereby rotated. The arm 260 then rotates as a result of rotation of the rotary shaft 253, whereupon the magnet 270 rotates in a circumferential direction. Since the magnet 270 and the magnet 190 attract each other, the middle shuttle 150 rotates in conjunction with rotation of the magnet 270.

The bobbin 300 has the bobbin body 302 and the magnet (a first magnet) 310 disposed on a rear surface of the bobbin body 302 (the rear surface opposes the rear portion 161 of the middle shuttle 150 when the bobbin is axially supported on the shaft 184).

Each of the bobbin bodies 302 has a similar configuration as that of an ordinary bobbin. The bobbin body 302 has a circular plate 302*a* a center of which is opened in the form of a circular aperture; another plate 302*b* equal to the plate 302*a* in both a size and a shape; and a cylindrical portion 302*c* interposed between the aperture of the plate 302*a* and an aperture of the plate 302*b*. A bobbin thread can be wound in a space existing between the plate 302*a* and the plate 302*b*. A hole 304 in the cylindrical portion 302*c* acts as a hole into which the shaft 184 of the middle shuttle 150 is to be inserted.

The magnet 310, a permanent magnet, has a configuration similar to that of the magnet 214 of the bobbin thread tension control mechanism 200. The magnet 310 is configured such that one of partitions defined by means of a plane extending along the center of rotation comes to exhibit an N pole and that a remaining one of the partitions comes to exhibit an S pole. A direction of magnetization of the magnet 310 matches a plane direction. The direction of magnetization corresponding to the plane direction means that lines of magnetic force originate principally from the magnet 310 in its thicknesswise direction [i.e., from a thicknesswise plane of the magnet 310 (a planar portion of the magnet 310) in its thicknesswise direction]. Further, there is another meaning that, in a state of the magnet 310 being attached to the bobbin body 302, the lines of magnetic force exit principally from the magnet 310 and substantially in parallel to the axial line of the bobbin 300 (the axial line passing through the center of rotation). Specifically, the magnet 310 is a magnet both sides of which exhibit four poles, such as that shown in FIG. 19(*a*). Alternatively, the magnet 310 can also be a magnet either side of which exhibits two poles, as shown in FIG. 19(*b*). In other words, the magnet 310, assuming a ring shape, is a magnet that is formed such that at least one side of the magnet exhibits two poles. The magnet 310 is formed so as to become substantially identical with the magnet 214 in terms of a size and a shape. Further, an outside diameter of the magnet 310 is substantially equal to the outside diameter of the magnet 214. When the bobbin thread tension control motor 202 is activated, the rotary shaft 203 of the bobbin thread tension control motor 202 is thereby rotated, which in turn rotates the rotary disc 210 and the magnet 214. By means of rotation of the magnet 214, the N poles and the S poles in the magnets 214 and 310 attract each other, whereupon the bobbin 300 is also rotated.

The sewing frame 22*d*, the middle shuttle 150, and the bobbin 300 also become machine elements in much the same way as the machine elements (the thread take-up levers 22*a*, the needle bars 22*b*, and the presser feet 22*c*).

The shuttle 100, the bobbin thread tension control mechanism 200, the shuttle actuation unit 250, and the bobbin 300 make up a shuttle-related mechanism.

The shuttle 100, the bobbin thread tension control mechanism 200, the shuttle actuation unit 250, the bobbin 300, and the control circuit 40 for controlling operation of the bobbin thread tension control motor 202 and the shuttle actuation motor 252 make up a "sewing-machine bobbin thread tension controller."

According primarily to embroidery data stored in the storage unit 500, the arithmetic unit 400 transmits to the control circuits 40 data used for controlling the respective motors. Specifically, the arithmetic unit 400 prepares virtual main spindle data. As shown in FIG. 10, the virtual main spindle data are data that represent the correspondence between a time and main spindle angles. In contrast with a related art embroidery sewing machine, the embroidery sewing machine 1 of the present embodiment is not provided with one main spindle mechanically linked to machine elements in each of the embroider heads. However, in order to synchronize operations of the respective machine elements, main spindle data for a virtual main spindle are prepared. Operations of the respective machine elements are controlled according to correspondence data corresponding to the virtual main spindle data and the machine elements (e.g., thread take-up lever data, needle bar data, presser foot data, bobbin thread tension control data, and shuttle actuation data). Here, a main spindle angle represents a virtual main spindle angle; namely, a position of a virtual main spindle in its rotating direction.

The storage unit 500 stores embroidery data used for performing embroidery. The embroidery data include data that pertain to; for instance, a stitch width, a stitch direction, and thread types and that are provided for each stitch. The storage unit 500 stores, for each machine element, angle correspondence data (can also be taken as position pattern data) specifying correspondence between main spindle angles and the angles of the machine element (e.g., thread take-up lever data, needle bar data, presser foot data, bobbin thread tension control data, and shuttle actuation data).

For instance, the needle bar data (the angle correspondence data for a needle bar) (see FIG. 11) specify main spindle angles and needle bar angles corresponding to the respective main spindle angles. The needle bar angle represents a position of the needle bar motor 32*b* in its rotating direction.

The shuttle actuation data stores the angle correspondence data that specify the correspondence between main spindle angles and middle shuttle angles (see FIG. 12). The bobbin thread tension control data include angle-torque correspondence data that specify the correspondence between main spindle angles and torque values (see FIG. 13). The middle shuttle angle represents a position of the shuttle actuation motor 252 in its rotating direction. Torque in the bobbin thread tension control data represents toque of the bobbin thread tension control motor 202.

Operation of the embroidery sewing machine 1 having the foregoing configuration; in particular, operation of the bobbin thread tension controller, is now described by reference to FIGS. 14 to 16.

First, the arithmetic unit 400 prepares virtual main spindle data according to the embroidery data stored in the storage unit 500. Since the storage unit 500 stores information, such as a stitch width, a stitch direction, and a thread type, for each stitch in relation to embroidery to be prepared, virtual main spindle data are prepared according to the stitch width, the stitch direction, and the thread type of each stitch. The virtual main spindle data pertain to a virtual main spindle angle achieved at each time. For instance, when a stitch width is large, a change in virtual main spindle angle is reduced. When the stitch width is small, the change in virtual main spindle angle is increased. When a stitch direction is opposite to a previous stitch direction, the change in virtual main spindle angle is reduced.

The arithmetic unit 400 prepares virtual main spindle data that precede, by several stitches, a stitch actually made by the respective machine elements (the needle bar, the thread take-up lever, the shuttle, the presser foot, and the like) to perform embroidery. Thus, actual embroidery is performed while virtual main spindle data are being prepared. Alternatively, the arithmetic unit 400 can also prepare, in advance, virtual main spindle data pertaining to the entirety of certain embroidery data.

The arithmetic unit 400 transmits the thus-prepared virtual main spindle data to the control circuits 40. On top of this, the arithmetic unit 400 transmits to the control circuits 40 angle correspondence data (machine element data) that specify, on a per-machine-element-basis, the correspondence between main spindle angles and angles of a machine element (e.g., thread take-up lever data, needle bar data, presser foot data, bobbin thread tension control data, and shuttle actuation data stored in the storage unit 500).

Pursuant to the data from the arithmetic unit 400, each of the control circuits 40 controls operations of the respective motors. Specifically, each of the control circuits 40 controls operations of the motors for the respective machine elements (e.g., the thread take-up motor 32*a*, the needle bar motor 32*b*, the presser foot motor 32*c*, the frame actuation motor 32*d*, the bobbin thread tension control motor 202, and the shuttle actuation motor 252) according to the virtual main spindle data and the data pertaining to the respective machine elements transmitted from the arithmetic unit 400.

For instance, each of the control circuits 40 controls operation of the shuttle actuation motor 252 according to the virtual main spindle data and the shuttle actuation data transmitted from the arithmetic unit 400 (see FIG. 12). Each of the control circuits 40 also controls operation of the bobbin thread tension control motor 202 according to the virtual main spindle data and the bobbin thread tension control data transmitted from the arithmetic unit 400 (see FIG. 13).

When the rotary shaft 253 of the shuttle actuation motor 252 is rotated pursuant to operation control of the shuttle actuation motor 252, the arm 260 is rotated by means of rotation of the rotary shaft 253. The magnet 270 then rotates in a circumferential direction. Since the magnet 270 and the magnet 190 attract each other, the middle shuttle 150 comes to rotate in conjunction with rotation of the magnet 270. Specifically, since the middle shuttle 150 of the embodiment is a half-turn middle shuttle, the middle shuttle is controlled so as to rotate back and forth within a range of half-turn rotation.

Specific operation of the middle shuttle 150 is now described by reference to FIG. 14. The middle shuttle 150 rotates back and forth between a state where the middle shuttle stays at one end of the rotation range shown in FIG. 14(*a*) and a state where the middle shuttle stays at the other end of the rotation range shown in FIG. 14(*e*). When the middle shuttle makes a right rotation in the state shown in FIG. 14(*a*) when viewed from the front, the point 172 is inserted into the needle thread 90 as shown in FIG. 14(*b*). FIG. 14(*b*) shows a state in which the thread guard 174 stays at a top dead center (the highest position with respect to the center of rotation). When the middle shuttle 150 makes an additional right rotation when viewed from the front, the needle thread 90 hooked on the thread guard 174 is pulled as shown in FIG. 14(*c*), to thus come into a state shown in FIG. 14(*e*) by way of a state shown in FIG. 14(*d*). FIG. 14(*d*) shows a case where the thread guard 174 stays at a bottom dead center (the lowest position with respect to the center of rotation). When the state shown in FIG. 14(*e*) is achieved, the sewing frame is actuated, and the thread take-up lever 22*a* simultaneously ascends, whereby the needle thread 90 hooked on the thread guard 174 is upwardly pulled and sewed along with the bobbin thread 320.

Figure 14:
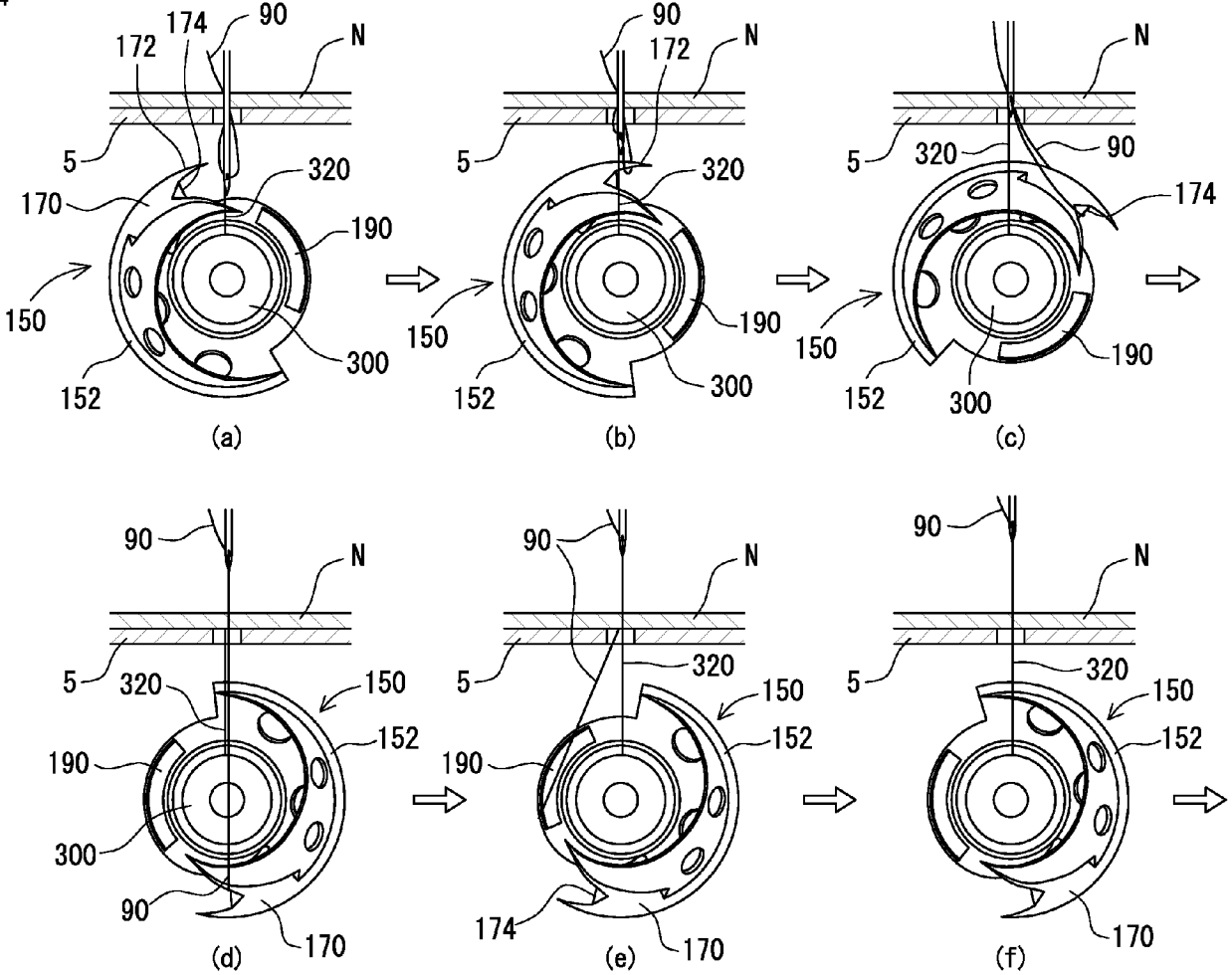
FIG. 14 It is a descriptive view showing operation of the middle shuttle of the first embodiment.
Figure 15:
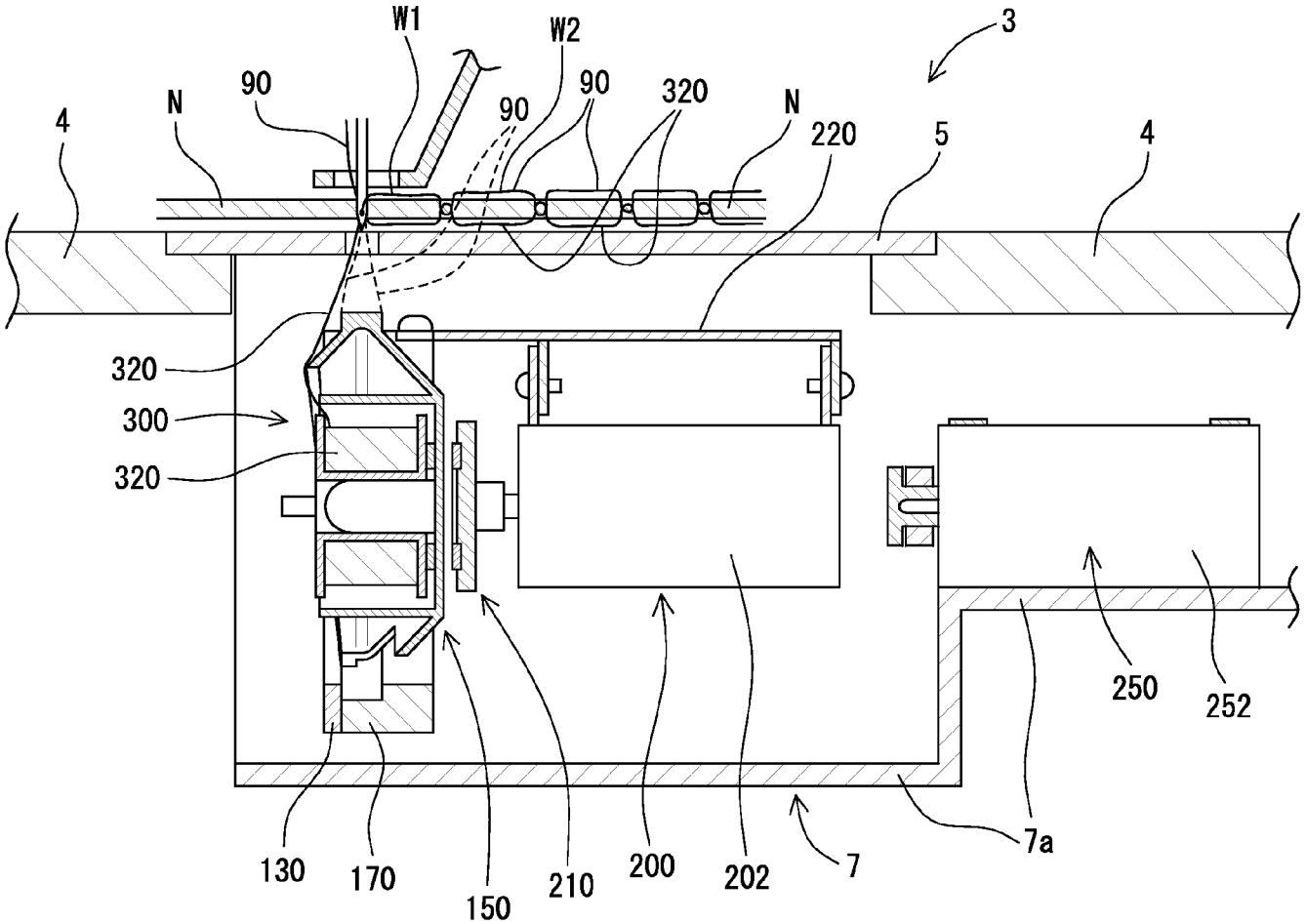
FIG. 15 It is a longitudinal sectional view showing operation of the middle shuttle of the first embodiment.

During the operation, one end of the looped needle thread 90 passes by the rear side of the rear-side body 162 (see FIG. 14(*d*)). Since space exists between the rotary disc 210 and the rear-side body 162 of the middle shuttle 150, the needle thread is not obstructed when passing by the rear side of the rear-side body 162.

Figure 16:
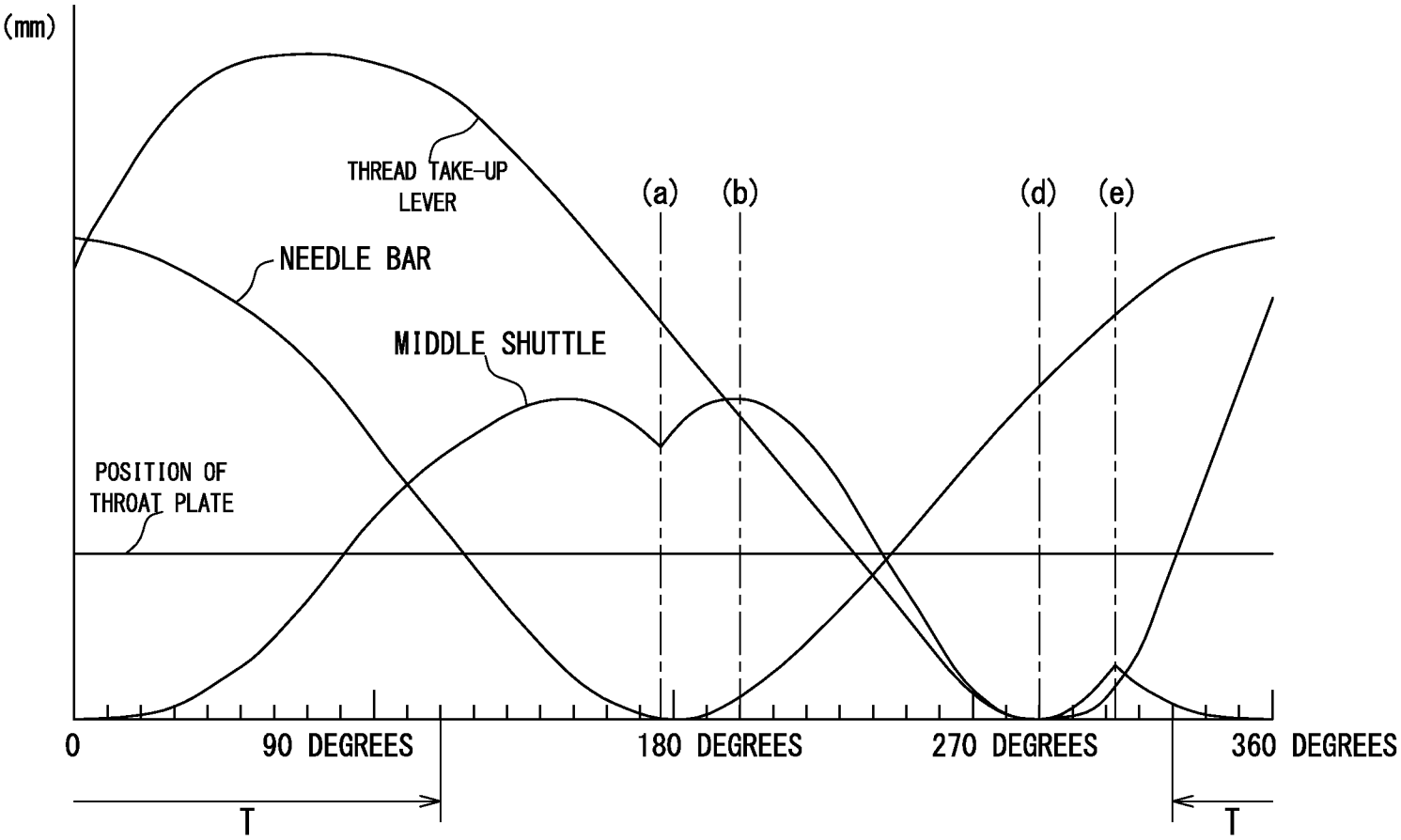
FIG. 16 It is a descriptive view showing operation of the embroidery sewing machine of the first embodiment.

FIG. 16 shows a motion diagram for a period of one stitch pertaining to the middle shuttle, the needle bar, and the thread take-up lever. Positions denoted by (a) in FIG. 16 correspond to the state shown in FIG. 14(*a*). Positions denoted by (b) in FIG. 16 correspond to the state shown in FIG. 14(*b*). Positions denoted by (d) in FIG. 16 correspond to the state shown in FIG. 14(*d*). Positions denoted by (e) in FIG. 16 correspond to the state shown in FIG. 14(*e*). The sewing frame 22*d* moves at least when the needle bar is positioned above the position of the throat plate.

When the rotary shaft 203 of the bobbin thread tension control motor 202 rotates according to control operation of the bobbin thread tension control motor 202, the rotary disc 210 rotates, and the magnet 214 then rotates. When the magnet 214 rotates, the N poles and the S poles of the magnet 214 and the magnet 310 attract each other, whereupon the bobbin 300 also rotates.

A method for controlling operation of the bobbin thread tension control motor 202 includes rotating the rotary disc 210 in a direction opposite to a direction of rotation of the bobbin 300 (i.e., a forward direction) achieved when the bobbin thread 320 is withdrawn, whereby a twine between the needle thread 90 and the bobbin thread 320 can be strongly tightened. When the twine is strongly tightened to produce tighter finished embroidery, a value of the electric current flowing into the bobbin thread tension control motor 202 is increased, whereby torque of the bobbin thread tension control motor 202 is increased. Specifically, when the bobbin thread is strongly tightened, a torque value in the bobbin thread tension control data is increased in advance. In other words, the torque of the bobbin thread tension control motor 202 is controlled at timing at which tension is imparted to a bobbin thread, thereby imparting rotational force to the bobbin 300 in a direction opposite to the forward direction.

Specific timing at which the torque of the bobbin thread tension control motor 202 is to be controlled is set to; for instance, a period T (see FIG. 16) from when a sewing needle has penetrated through a processed fabric until when the sewing needle reaches the top dead center of the thread take-up lever 22*a*; at least, a period from an intermediate point between the bottom dead center to the top dead center of the thread take-up lever 22*a* to the top dead center of the thread take-up lever 22*a*. Specifically, during a period from when a sewing needle has penetrated through the processed fabric until when the thread take-up lever 22*a* ascends, the thread take-up lever 22*a* pulls up the needle thread 90, to thus tighten the twine between the needle thread 90 and the bobbin thread 320. Hence, the torque of the bobbin thread tension control motor 202 is controlled during the period, whereby a degree of tightening of the twine can be controlled. Thus, the degree of tightening of the needle thread and the bobbin thread can be controlled. Specifically, it is possible to produce tighter finished embroidery by means of increasing a torque value for torque control of the bobbin thread tension control motor 202 performed during the period. In the meantime, it is also possible to produce soft finished embroidery by reducing the torque value for torque control of the bobbin thread tension control motor 202 performed during the period.

In the embodiment, the embroidery sewing machine 1 is a multi-head type embroidery sewing machine including the embroidery heads 10-1 to 10-*n*. So long as each of the embroidery heads performs bobbin thread tension control in the same manner, each of the embroidery heads can equally control tension of the bobbin thread. Specifically, the bobbin thread tension control data to be applied are made uniform, whereby each of the embroidery heads can equally control the bobbin thread tension. In contrast, when the bobbin thread tension control data applied to the respective embroidery heads are caused to differ from each other, each of the embroidery heads can perform different bobbin thread tension control.

When the bobbin 300 is replaced on occasion of use of the embroidery sewing machine 1, the bobbin 300 is held in the bobbin accommodation section 180 by means of attractor force of the magnet 310 and the magnet 214. Therefore, the bobbin 300 is withdrawn against the attractor force stemming from the middle shuttle presser 130. Further, in order to let the bobbin accommodation section 180 accommodate a new bobbin 300, the bobbin 300 is put into the bobbin accommodation section 180 from the direction of the middle shuttle presser 130. The magnet 310 and the magnet 214 resultantly attract each other, whereby the bobbin 300 can be readily put into the bobbin accommodation section 180.

As mentioned above, in the embroidery sewing machine 1 of the present embodiment, the bobbin thread tension control motor 202 can freely control the tension of the bobbin thread 320 in the course of operation of the embroidery sewing machine 1.

Further, the tension of the bobbin thread 320 is controlled by means of the magnet 214 attached to the rotary disc 210 whose rotation is controlled by the bobbin thread tension control motor 202 and the magnet 310 of the bobbin 300. When compared with the case where tension is controlled by means of the friction between the bobbin thread and another member, tension control can be performed more accurately. In particular, when bobbin thread tension is imparted by means of the friction between the bobbin thread and another member as in the related art, frictional force varies for reasons of humidity, or the like, so that the frictional force cannot be controlled with superior accuracy. In contrast, in the present embodiment, it becomes possible to control the tension of the bobbin thread with high accuracy.

The tension imparted to the bobbin thread 320 is controlled by means of a value of the electric current applied to the bobbin thread tension control motor 202. The bobbin thread tension is proportional to a current value; hence, bobbin, thread tension can be elaborately controlled by elaborate control of the current value.

Further, when the embroidery sewing machine is a multi-head embroider sewing machine including a plurality of embroidery heads, bobbin thread tension has hitherto been controlled by means of the friction between the bobbin thread and another member. Therefore, the respective embroidery heads cannot equally control the bobbin thread tension. However, in the present embodiment, the bobbin thread tension control data to be applied are made uniform; hence, the respective embroidery heads can equally control the bobbin thread tension.

Since the middle shuttle 150 has the bobbin accommodation section 180, the bobbin 300 accommodated in the bobbin accommodation section 180 remains stably accommodated in the bobbin accommodation section 180 as a result of the magnet 310 being attracted by the magnet 214 of the rotary disc 210. Therefore, there is no necessity to additionally provide the middle shuttle 150 with a mechanism for attaching a bobbin. Specifically, the related art configuration includes putting a bobbin in a bobbin case and attaching to a middle shuttle the bobbin case accommodating the bobbin. In contrast, the present embodiment obviates a necessity for the bobbin case. In the present embodiment, the bobbin 300 can be readily removably attached to the bobbin accommodation section 180. Specifically, the bobbin 300 can be easily accommodated in the bobbin accommodation section 180 by means of the attractor force of the magnet 310 and the magnet 214.

In the embroidery sewing machine 1 of the present embodiment, the middle shuttle 150 is actuated by means of the corresponding shuttle actuation unit 250, and the magnet 270 and the magnet 190 attract each other. The middle shuttle 150 rotates in conjunction with circumferential rotation of the magnet 270; hence, actuation sound stemming from actuation of the middle shuttle can be lessened. More specifically, in the related art, a half-turn middle shuttle is rotationally actuated by means of a driver that contacts both sides of the middle shuttle. During the course of the middle shuttle repeatedly performing forward rotations and backward rotations, sound is generated as a result of occurrence of a contact between the driver and the middle shuttle. In the present embodiment; however, a driver is not employed, and rotational control of the middle shuttle is performed by utilization of the attractor force of the two magnets; hence, the sound does not arise.

Second Embodiment

An embroidery sewing machine of a second embodiment is substantially analogous to its counterpart of the first embodiment in terms of a configuration, but they differ from each other in that the middle shuttle is configured so as to make a full rotation. Specifically, the middle shuttle of the first embodiment is of a half-turn type, whereas a middle shuttle of the second embodiment is of a full-turn type. The embroidery sewing machine of the present embodiment differs from its counterpart described in connection with the first embodiment in terms of the configuration of the bobbin thread tension control mechanism and the configuration of the shuttle actuation unit.

Figure 17:
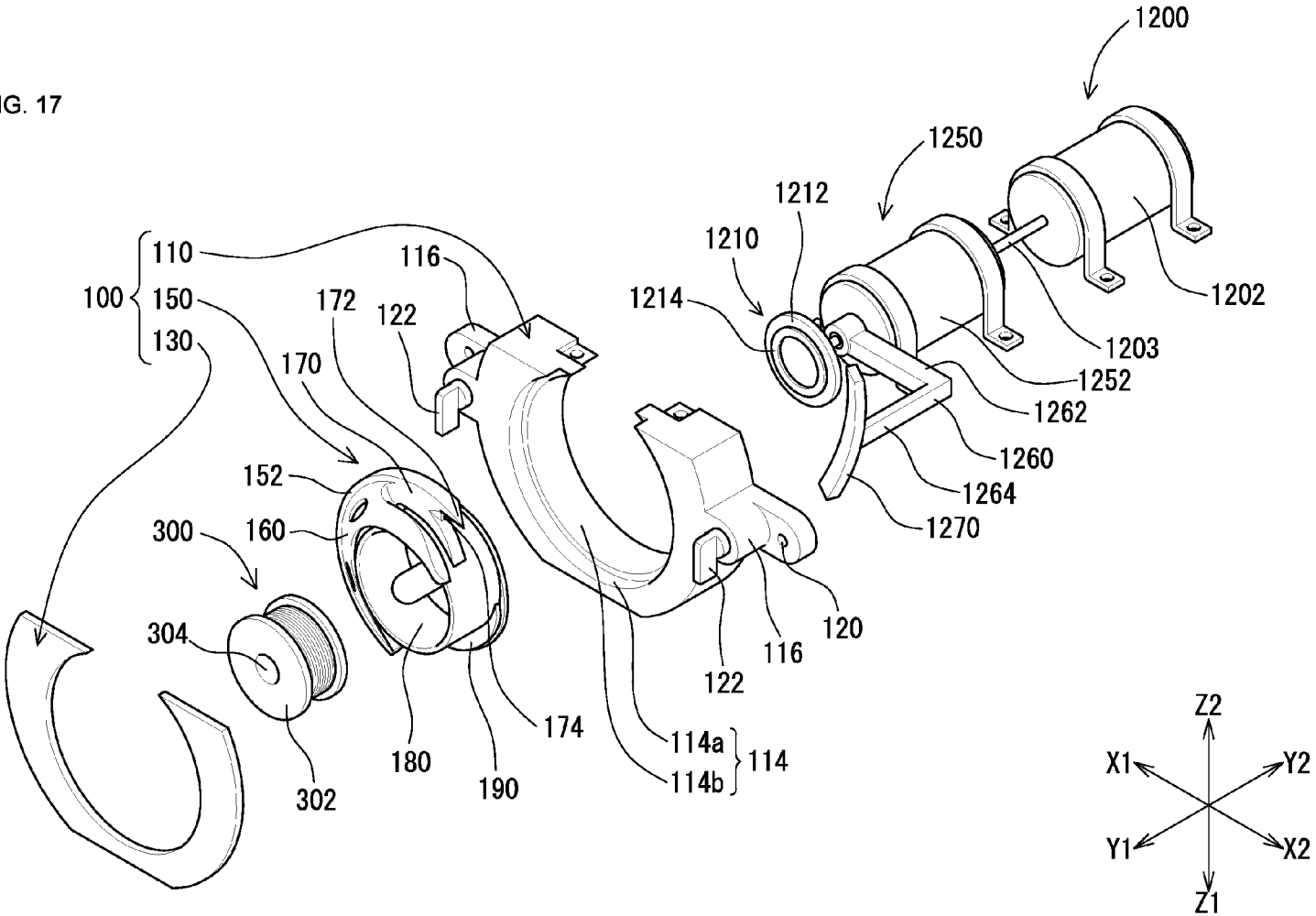
FIG. 17 It is a forward exploded perspective view of a shuttle, a bobbin thread tension control mechanism, a shuttle actuation unit, and a bobbin in the embroidery sewing machine of the second embodiment.

The shuttle 100, a bobbin thread tension control mechanism 1200, and a shuttle actuation unit 1250, which will be described in connection with the present embodiment, are configured as shown in FIG. 17. The shuttle 100 is analogous, in configuration, to the shuttle 100 described in connection with the first embodiment.

The bobbin thread tension control mechanism 1200 has a bobbin thread tension control motor 1202 and a rotary disc 1210 attached to a rotary shaft 1203 of the bobbin thread tension control motor 1202.

The bobbin thread tension control motor 1202 is configured so as to be rotatable forwardly and backwardly. The rotary shaft 1203 is configured such that its axial center core is aligned to an axial center core of the shaft 184 in the middle shuttle 150. In contrast with the first embodiment, the bobbin thread tension control motor 1202 is disposed at a rear of a shuttle actuation motor 1252. The rotary shaft 1203 of the bobbin thread tension control motor 1202 is made so as to become longer than the rotary shaft 203 of the first embodiment. The rotary shaft 1203 runs through an insert hole formed in the shuttle actuation motor 1252 and a tubular rotary shaft of the shuttle actuation motor 1252, to thus project to the front side of the shuttle actuation motor 1252. The bobbin thread tension control motor 1202 is anchored to the shuttle base.

The rotary disc 1210 is analogous, in configuration, to the rotary disc 210 of the first embodiment. The rotary disc 1210 has a circular-plate-shaped rotary disc body 1212 and a ring-shaped magnet (a second magnet) 1214 attached to a front-side surface of the rotary disc body 1212. The rotary disc body 1212 is analogous, in configuration, to the rotary disc body 212 of the first embodiment. The magnet 1214 is also analogous, in configuration, to the magnet 214 of the first embodiment. Accordingly, their repeated, detailed explanations are omitted for brevity. A tubular portion analogous, in configuration, to the tubular portion 216 of the first embodiment is disposed on the back of the rotary disc body 1212. The tubular portion is axially supported on and fastened to the rotary shaft 1203 of the bobbin thread tension control motor 1202. In a state in which the shuttle 100 and the bobbin thread tension control mechanism 1200 are anchored to the shuttle base, the magnet 1214 of the rotary disc 1210 remains in close proximity to, at spacing, a rear surface of the rear-side body 162 of the middle shuttle 150 placed in the outer shuttle 110.

Each of the shuttle actuation units 1250 includes the shuttle actuation motor 1252, an arm 1260 axially supported on a rotary shaft of the shuttle actuation motor 1252, and a magnet 1270 (a fourth magnet) placed at an extremity of the arm 1260.

The shuttle actuation motor 1252 is made in a tubular shape, and a columnar insert hole is opened in the shuttle actuation motor 1252 along its axial line. The rotary shaft of the shuttle actuation motor 1252 is also made in a tubular shape, and the axial line of the rotary shaft of the shuttle actuation motor 1252 is aligned to the axial center core of the rotary shaft 1203 of the bobbin thread tension control motor 1202. The shuttle actuation motor 1252 is also anchored to the shuttle base in much the same way as the bobbin thread tension control motor 1202. Since the middle shuttle 150 is of a full turn type, a unidirectional turn suffices for the shuttle actuation motor 1252. However, the shuttle actuation motor may also be configured so as to turn forwardly and backwardly.

The arm 1260, assuming a substantial shape of the letter L as a whole, has a substantially rod-shaped base end 1262 and a leading end 1264 continually extending from an extremity of the base end 1262. The base end 1262 is disposed at a direction orthogonal to an axial line of the rotary shaft of the shuttle actuation motor 1252. The leading end 1264 is disposed parallel to the axial line of the rotary shaft of the shuttle actuation motor 1252. A length of the base end 1262 is set such that the leading end 1264 does not contact the rotary disc 1210 and that the magnet 1270 attached to the extremity of the leading end 1264 is situated at a rear of the magnet 190. Likewise, a length of the leading end 1264 is also set such that the magnet 1270 comes close to the rear side of the rear-side tapered portion 164.

The magnet 1270 is analogous, in configuration, to the magnet 270 of the first embodiment and assumes the shape of a fan-shaped plate. The magnet is curved in agreement with the geometry of the rear surface of the rear-side tapered portion 164, so as to come as closely as possible to the rear surface of the rear-side tapered portion 164 of the middle shuttle 150.

The magnet 1270 and the magnet 190 are configured so as to attract each other. When a surface of the magnet 1270 facing the rear-side tapered portion 164 of the middle shuttle 150 exhibits either the N pole or the S pole, a surface of the magnet 190 facing the rear-side tapered portion 164 is set so as to assume the remaining pole. By means of the configuration, a rotary shaft of the shuttle actuation motor 1252 is rotated as a result of actuation of the shuttle actuation motor 1252. Rotation of the rotary shaft in turn induces rotation of the arm 1260, whereupon the magnet 1270 makes a circumferential rotation. Since the magnet 1270 and the magnet 190 attract each other, the middle shuttle 150 rotates in conjunction with rotation of the magnet 1270.

The bobbin thread tension control mechanism 1200 and the shuttle actuation unit 1250 are configured as mentioned above. In particular, the bobbin thread tension control motor 1202 is disposed at a rear of the shuttle actuation motor 1252. Further, a surrounding area of the rotary disc 1210 is opened, and hence the arm 1260 can make a full rotation.

The embroidery sewing machine of the present embodiment is analogous to its counterpart described in connection with the first embodiment except the bobbin thread tension control mechanism 1200 and the shuttle actuation unit 1250 (e.g., the shuttle 100 and the bobbin 300 are identical, in configuration, to their counterparts described in connection with the first embodiment), and hence their detailed explanations are omitted here for brevity.

Operation of the embroidery sewing machine of the present embodiment is analogous to the operation of the embroidery sewing machine 1 of the first embodiment. Each of the control circuits 40 controls operations of the respective motors according to data delivered from the arithmetic unit 400. Namely, according to the virtual main spindle data and the respective pieces of machine element data sent from the arithmetic unit 400, the control circuit 40 controls operations of the motors for the respective machine elements (e.g., the thread take-up motor 32*a*, the needle bar motor 32*b*, the presser foot motor 32*c*, the frame actuation motor 32*d*, the bobbin thread control motor 1202, and the shuttle actuation motor 1252).

For instance, each of the control circuits 40 controls operation of the shuttle actuation motor 1252 according to the virtual spindle data and the shuttle actuation data transmitted from the arithmetic unit 400 (see FIG. 12). Each of the control circuits 40 also controls operation of the bobbin thread tension control motor 1202 according to the virtual main spindle data and the bobbin thread tension control data transmitted from the arithmetic unit 400 (see FIG. 13).

When the rotary shaft of the shuttle actuation motor 1252 is rotated pursuant to operation control of the shuttle actuation motor 1252, the arm 1260 is rotated by means of rotation of the rotary shaft. The magnet 1270 then rotates in a circumferential direction. Since the magnet 1270 and the magnet 190 attract each other, the middle shuttle 150 comes to rotate in conjunction with rotation of the magnet 1270. Specifically, since the middle shuttle 150 of the embodiment is a full-turn middle shuttle, the shuttle actuation motor 1252 rotates in one direction.

The middle shuttle 150 performs specific operations as shown in FIGS. 14(*a*) to 14(*e*). Subsequently, the middle shuttle 150 rotates in one direction, to thus come to a state shown in FIG. 14(*a*). The middle shuttle makes an additional rotation without hooking the bobbin thread 90, to thus enter the state shown in FIG. 14(*a*). Thus, operation for one stitch is performed.

Figure 18:
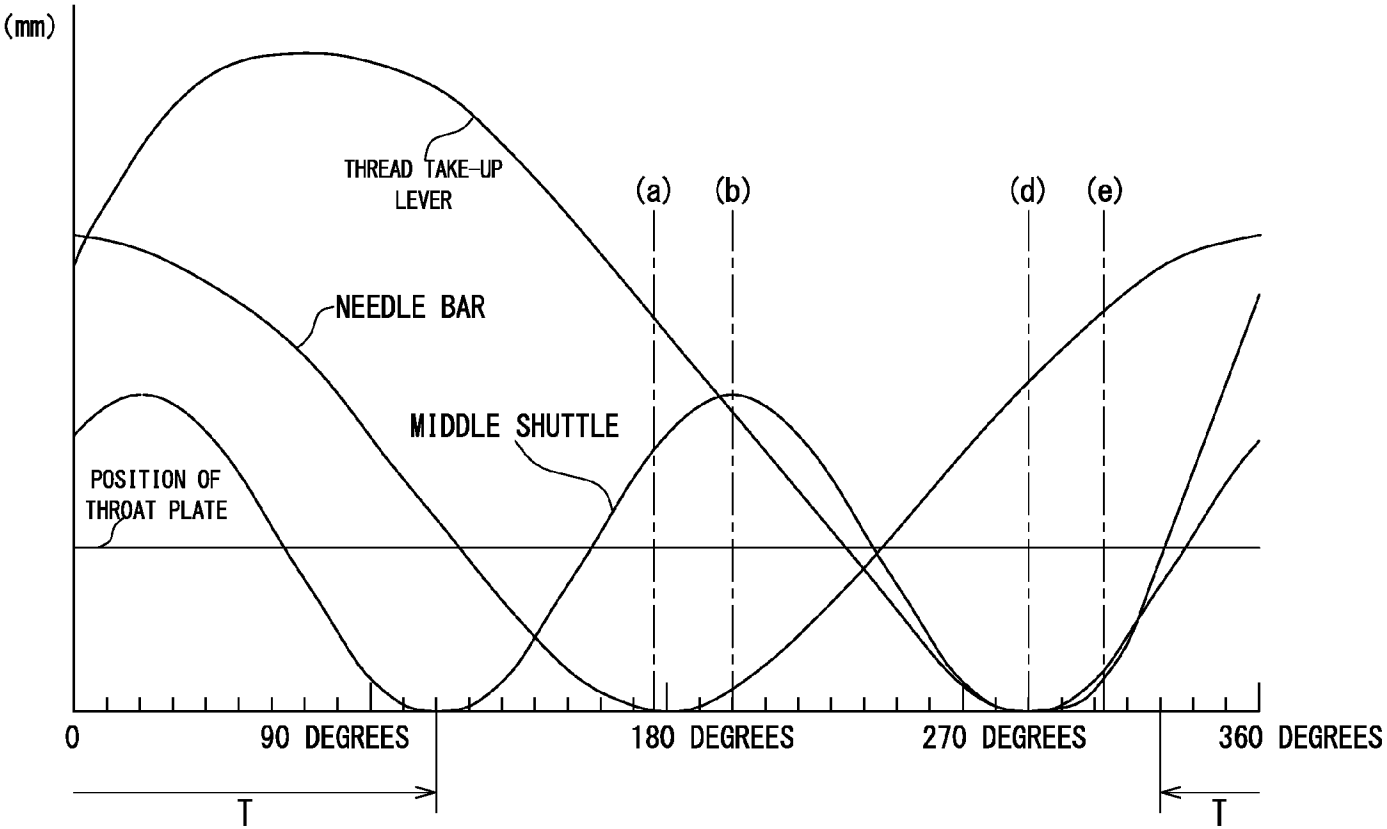
FIG. 18 It is a descriptive view showing operation of the embroidery sewing machine of the second embodiment.

FIG. 18 shows a motion diagram for a period of one stitch pertaining to the middle shuttle, the needle bar, and the thread take-up lever, and the middle shuttle 150 makes two rotations during a period of one stitch. Positions denoted by (a) in FIG. 18 correspond to the state shown in FIG. 14(*a*). Positions denoted by (b) in FIG. 18 correspond to the state shown in FIG. 14(*b*). Positions denoted by (d) in FIG. 18 correspond to the state shown in FIG. 14(*d*). Positions denoted by (e) in FIG. 18 correspond to the state shown in FIG. 14(*e*). The sewing frame 22*d* moves at least when the needle bar is positioned above the position of the throat plate.

When the rotary shaft 1203 of the bobbin thread tension control motor 1202 rotates according to control operation of the bobbin thread tension control motor 1202, the rotary disc 1210 rotates, and the magnet 1214 then rotates. When the magnet 1214 rotates, the N poles and the S poles of the magnet 1214 and the magnet 310 attract each other, whereupon the bobbin 300 also rotates.

A method for controlling operation of the bobbin thread tension control motor 1202 includes rotating the rotary disc 1210 in a direction opposite to a direction of rotation (i.e., the forward direction) achieved when the bobbin thread 320 of the bobbin 300 is withdrawn as in the case with the first embodiment, whereby the twine between the needle thread 90 and the bobbin thread 320 can be strongly tightened.

In other words, specific timing at which the torque of the bobbin thread tension control motor 1202 is to be controlled is set to; for instance, the period T (see FIG. 18) from when the sewing needle has penetrated through a processed fabric until when the sewing needle reaches a position past the top dead center of the thread take-up lever 22*a* (or the top dead center) as in the case of the first embodiment; at least, the period from a substantial intermediate point between the bottom dead center to the top dead center of the thread take-up lever 22*a* until the top dead center of the thread take-up lever 22*a*. Specifically, it is possible to produce tighter finished embroidery by means of increasing a torque value for torque control of the bobbin thread tension control motor 1202 during the period. In the meantime, it is also possible to produce soft finished embroidery by reducing the torque value for torque control of the bobbin thread tension control motor 1202 during the period.

As mentioned above, the embroidery sewing machine of the present embodiment can yield the same advantage as that yielded by the embroidery sewing machine 1 of the first embodiment.

Specifically, the bobbin thread tension control motor 1202 can freely control the tension of the bobbin thread 320 in the course of operation of the embroidery sewing machine 1.

Further, the tension of the bobbin thread 320 is controlled by means of the magnet 1214 attached to the rotary disc 1210 whose rotation is controlled by the bobbin thread tension control motor 1202 and the magnet 310 of the bobbin 300. When compared with the case where tension is controlled by means of the friction between the bobbin thread and another member, tension control can be performed more accurately. In particular, when bobbin thread tension is imparted by means of the friction between the bobbin thread and another member as in the related art, frictional force varies for reasons of humidity, or the like, so that the frictional force cannot be controlled with superior accuracy. In contrast, in the present embodiment, it becomes possible to control the tension of the bobbin thread with high accuracy.

The tension imparted to the bobbin thread 320 is controlled by means of the value of the electric current applied to the bobbin thread tension control motor 1202. The bobbin thread tension is proportional to a current value, and hence bobbin thread tension can be elaborately controlled by elaborate control of the current value.

Further, when the embroidery sewing machine is a multi-head embroider sewing machine including a plurality of embroidery heads, bobbin thread tension has hitherto been controlled by means of the friction between the bobbin thread and another member. Therefore, the respective embroidery heads cannot equally control the bobbin thread tension. However, in the present embodiment, the bobbin thread tension control data to be applied are made uniform; hence, the respective embroidery heads can equally control the bobbin thread tension.

Since the middle shuttle 150 has the bobbin accommodation section 180, the bobbin 300 accommodated in the bobbin accommodation section 180 remains stably accommodated in the bobbin accommodation section 180 as a result of the magnet 310 being attracted by the magnet 1214 of the rotary disc 1210. Therefore, there is no necessity to additionally provide the middle shuttle 150 with a mechanism for attaching a bobbin. In the present embodiment, the bobbin 300 can be readily removably attached to the bobbin accommodation section 180.

In the descriptions; namely, the descriptions described in connection with the first and second embodiments, an explanation has been provided by means of taking the embroidery sewing machine as an example sewing machine. However, another sewing machine; namely, a sewing machine other than the embroidery sewing machine, can also be used.

Third Embodiment

Referring primarily to an embroidery sewing machine of a third embodiment, descriptions are now provided by reference to FIGS. 20 to 28. Although the embroidery sewing machine of the third embodiment is essentially analogous to its counterpart of the first embodiment, they differ from each other in terms of the configuration of the middle shuttle 150 and the configuration of the rotary disc 210 of the bobbin thread tension control mechanism 200.

Specifically, as shown in FIGS. 20 to 25, the rear portion 161 of the main middle shuttle 160 in the middle shuttle 150 is made up of the rear-side body 162 and the rear-side tapered portion 164. However, the rear-side body 162 differs, in configuration, from its counterpart described in connection with the first embodiment.

Namely, as shown in FIGS. 20 to 22 and FIG. 24, the rear-side body 162 has a ring-like flat-plate portion (a rear plate-like portion) 162*a* and a recess (a rear recess) 162*b* formed in the center of the flat-plate portion 162*a*.

Namely, the flat-plate portion 162*a* assumes the shape of a circular plate having a circular opening formed in its center. The flat-plate portion 162*a* continually extends from an interior edge of the rear-side tapered portion 164. The flat-plate portion 162*a* makes up a plane perpendicular to a center of rotation of the middle shuttle 150 and has an outer diameter that is smaller than an inner diameter of the race 152. The flat-plate portion 162*a* is situated on a rear side than is the rear-side end of the race 152.

Figure 20:
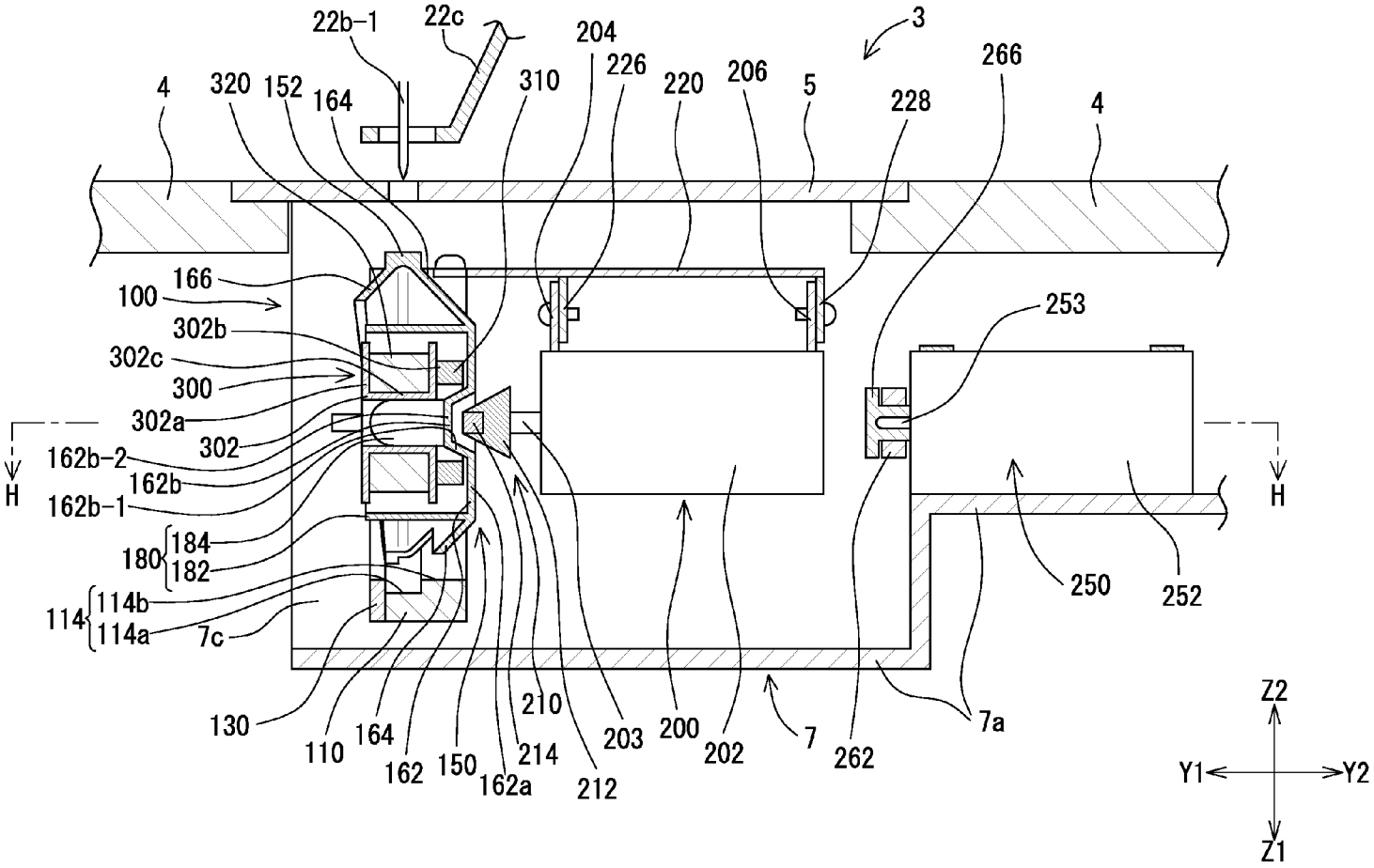
FIG. 20 It is a longitudinal sectional view of an embroidery sewing machine of a third embodiment.
Figure 21:
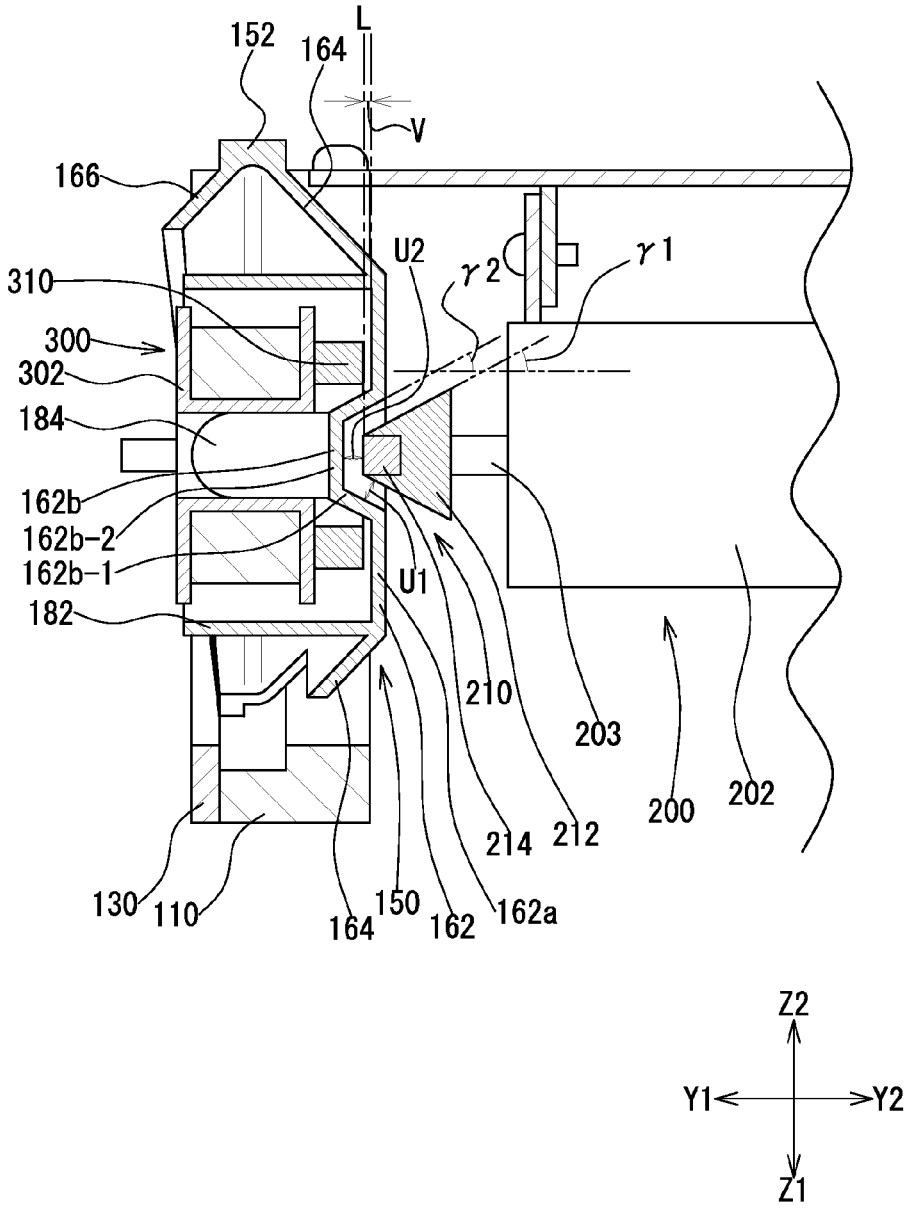
FIG. 21 It is an enlarged view of an essential part of the magnet shown in FIG. 19.
Figure 22:
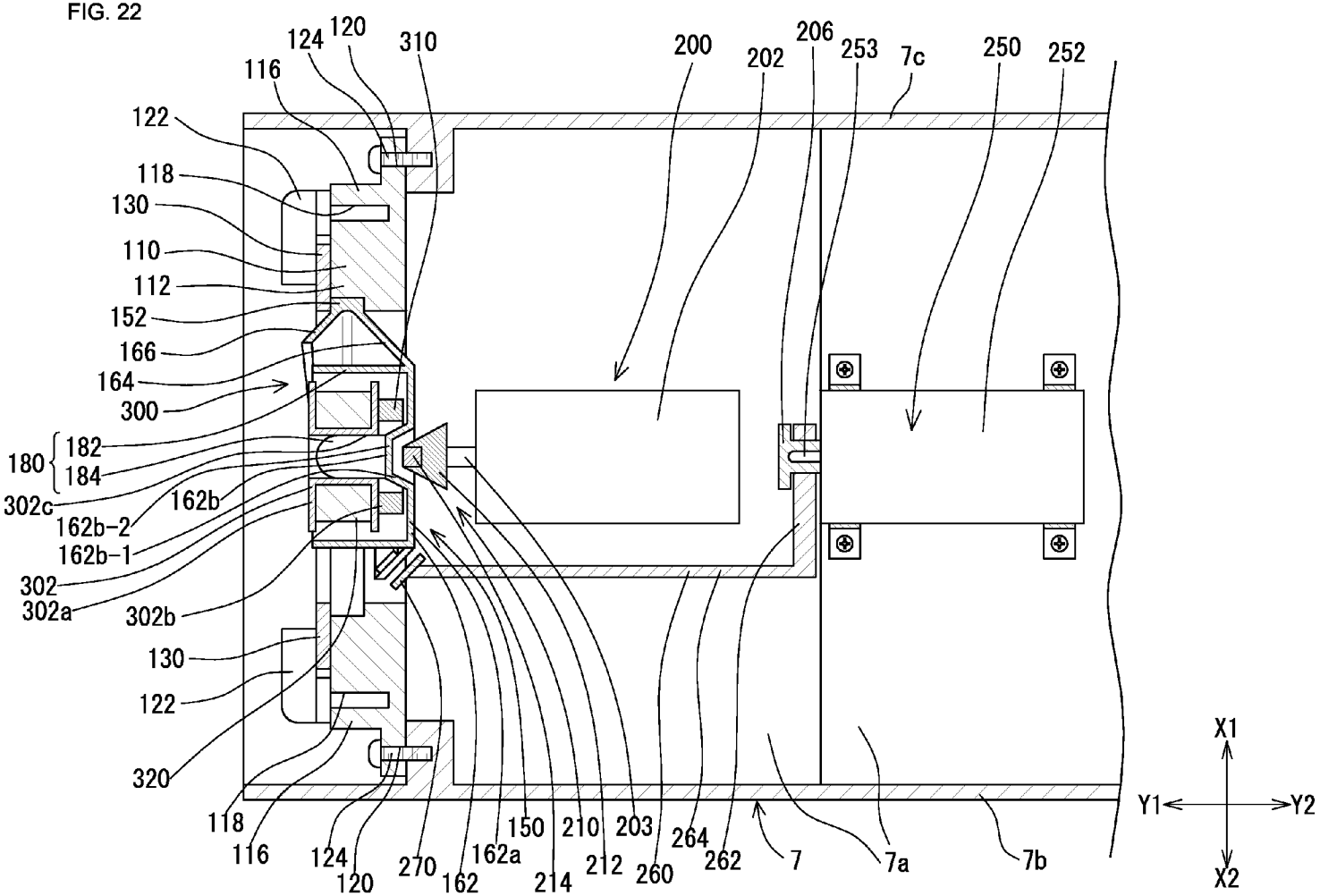
FIG. 22 It is a transverse sectional view of the embroidery sewing machine of the third embodiment; namely, a cross sectional view of the same taken along line H-H shown in FIG. 20.
Figure 23:
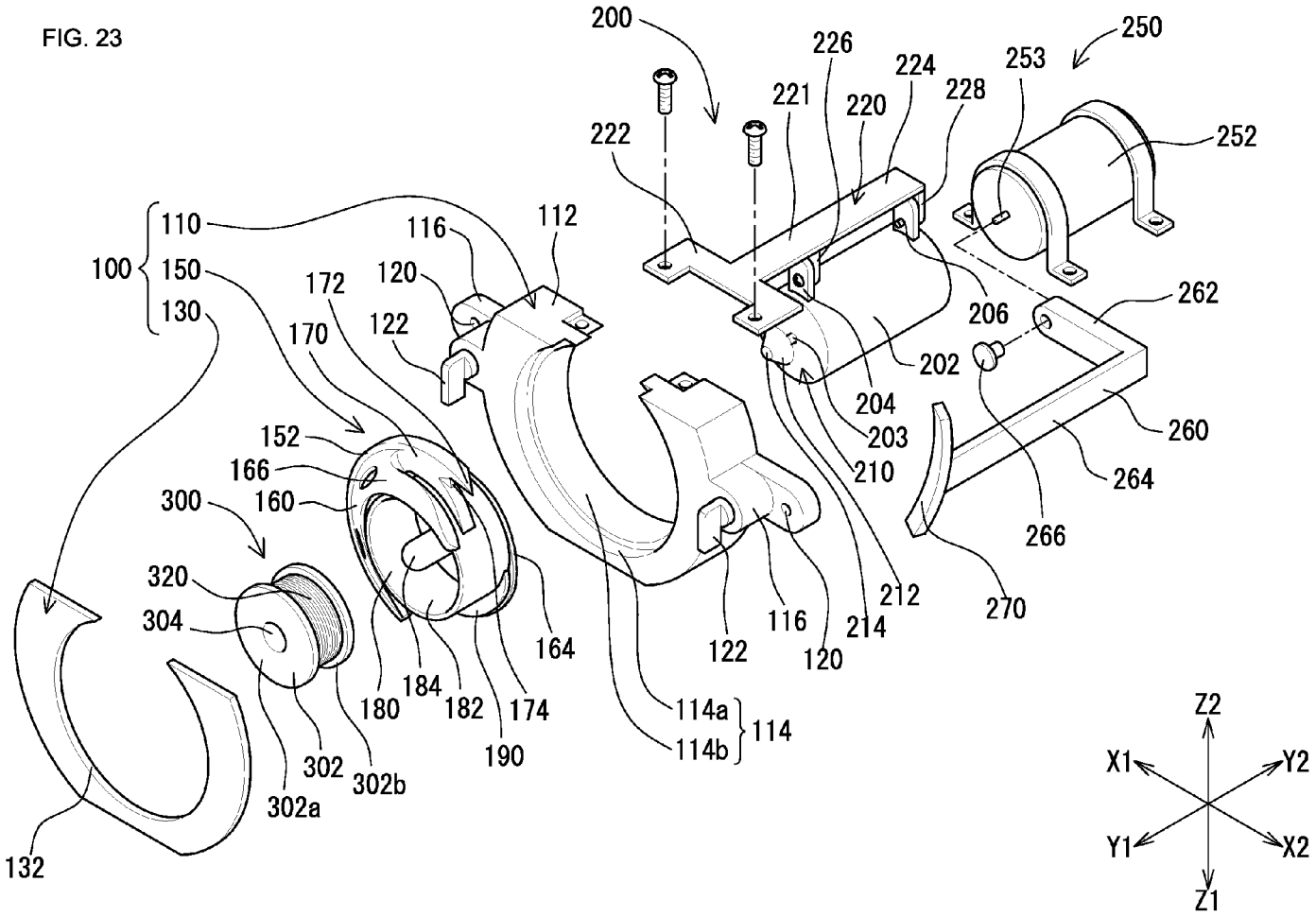
FIG. 23 It is a forward exploded perspective view of the shuttle, the bobbin thread tension control mechanism, the shuttle actuation unit, and the bobbin in the embroidery sewing machine of the third embodiment.
Figure 24:
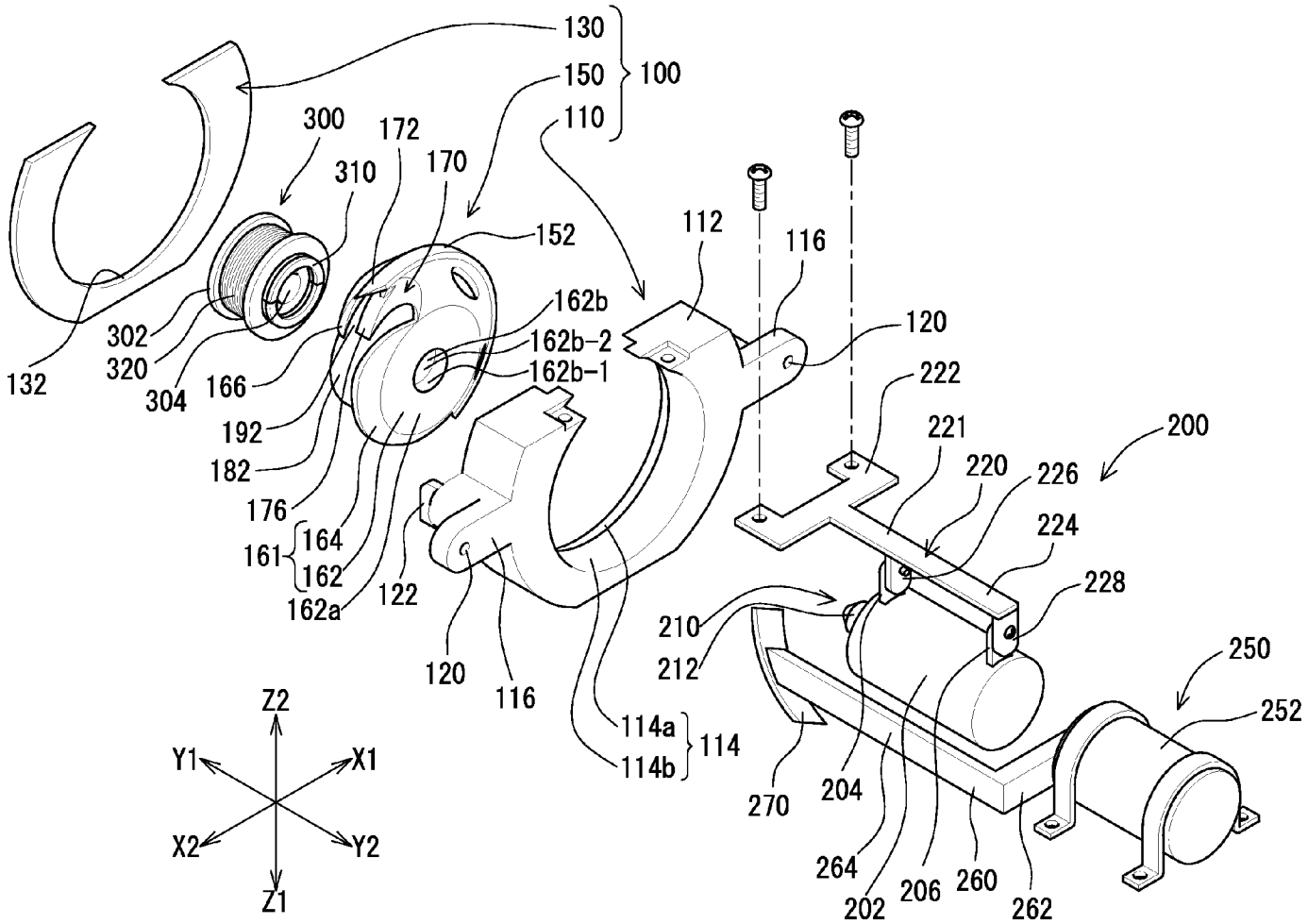
FIG. 24 It is a backward exploded perspective view of the shuttle, the bobbin thread tension control mechanism, the shuttle actuation unit, and the bobbin in the embroidery sewing machine of the third embodiment.
Figure 25:
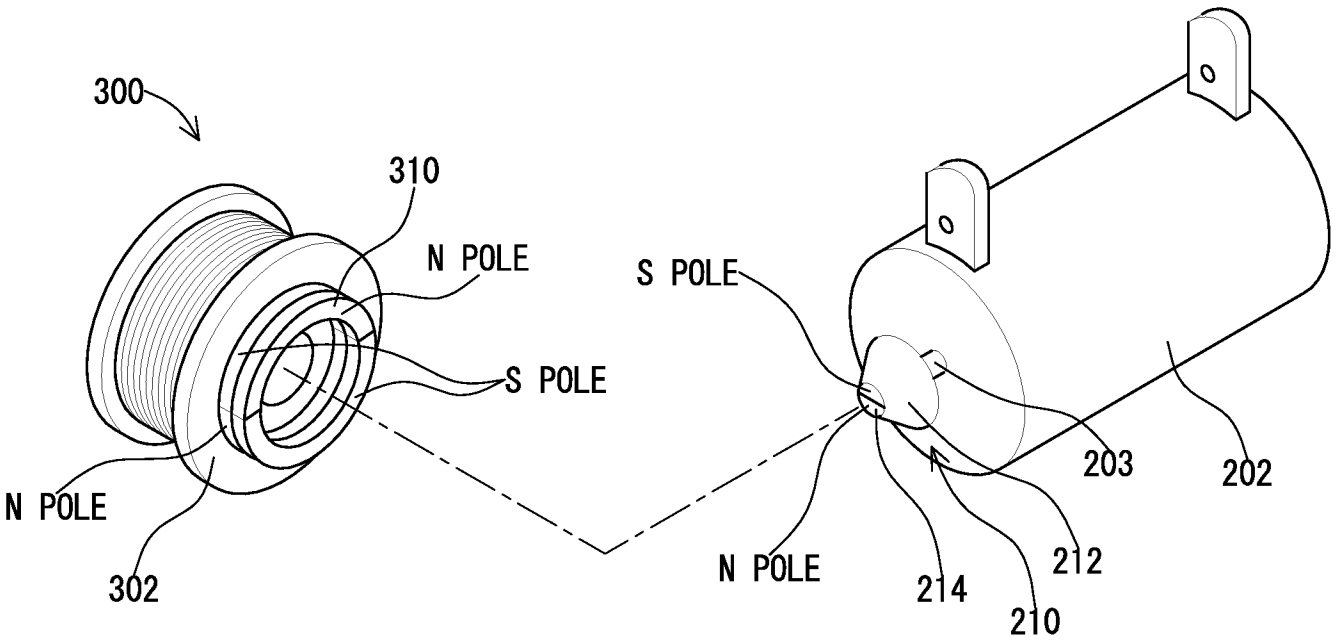
FIG. 25 It is an exploded perspective view of the essential parts of the embroidery sewing machine of the third embodiment; in particular, an exploded perspective view of essential parts of the bobbin thread tension control mechanism and a configuration of the bobbin.

The recess 162*b* is formed in the circular aperture of the flat-plate portion 162*a* and in the form of a recess, so as to face the front side (a Y1 side in FIGS. 20 to 22). The recess 162*b* has a recessed periphery (can also be referred to as a "recessed tubular portion") 162*b*-1 that continually extends from the inner edge of the flat-plate portion 162*a* to the front and a recessed depth 162*b*-2 provided at a front end of the recessed periphery 162*b*-1 (can also be referred to as a "recessed plate-like portion").

The recessed periphery 162*b*-1 assumes a tapered, tubular shape having a smaller diameter toward its front side. The recessed depth 162*b*-2 is formed so as to close a front aperture of the recessed periphery 162*b*-1, assuming the shape of a disc. A rear surface of the recessed depth 162*b*-2 is situated further toward the front than is a front surface of the flat-plate portion 162*a*. A gap exists, in a longitudinal direction (an axial direction) (the direction Y1-Y2) passing through the center of rotation, between the front surface of the flat-plate portion 162*a* and the rear surface of the recessed depth 162*b*-2. The front surface of the magnet 214 provided on the rotary disc 210 of the bobbin thread tension control mechanism 200 can be situated further toward the front than is the front surface of the flat-plate portion 162*a*.

The shaft 184 of the bobbin accommodation section 180 is disposed on the front surface of the recessed depth 162*b*-2.

Since the middle shuttle 150 is analogous, in configuration, to its counterpart described in connection with the first embodiment except the rear-side body 162, its detailed explanations are omitted. The shuttle 100 is analogous, in configuration, to its counterpart described in connection with the first embodiment except the middle shuttle 150; hence, the detailed descriptions of the shuttle are omitted.

The rotary disc 210 (can also be taken as a "magnet unit") of the bobbin thread tension control mechanism 200 is attached to the rotary shaft 203 of the bobbin thread tension control motor 202. The rotary disc 210 has the rotary disc body (the "rotating body") 212 (can also be taken as a "unit body") fixedly attached to the rotary shaft 203 and the magnet 214 fixedly attached to the recess provided in the front side of the rotary disc body 212.

The rotary disc body 212, assuming the shape of a substantially circular truncated cone as a whole, has a columnar aperture on its front side (its extremity side). A peripheral surface of the rotary disc body 212 assumes a tapered shape and is formed parallel to an inner peripheral surface of the recessed periphery 162*b*-1 of the recess 162*b* of the rear-side body 162 in the middle shuttle 150. Specifically, an angle γ1 that the peripheral surface of the rotary disc body 212 forms with an axial line passing through the center of rotation of the peripheral surface is substantially identical with an angle γ2 that the inner peripheral surface of the recessed periphery 162*b*-1 forms with an axial line passing through the center of rotation of the middle shuttle 150. Gap existing between the peripheral surface of the rotary disc body 212 and the inner peripheral surface of the recessed periphery 162*b*-1 is formed so as to assume a substantially equal width U1. A diameter of the front end of the rotary disc body 212 (substantially equal to a radius of the magnet 214) is made smaller than a diameter of the recessed depth 162*b*-2. The width U1 of the gap existing between the peripheral surface of the rotary disc body 212 and the inner peripheral surface of the recessed periphery 162*b*-1 is made substantially equal to a width U2 of a gap existing between the magnet 214 and the recessed depth 162*b*-2.

The magnet 214, fixedly disposed in a front hole of the rotary disc body 212, assumes a substantially columnar shape. A longitudinal length of the magnet 214 is essentially identical with a longitudinal length of the hole of the rotary disc body 212. The magnet 214 remains in a state in which only a circular front surface of the magnet is exposed. By means of the configuration, rotation of the rotary shaft 203 of the bobbin thread tension control motor 202 induces rotation of the rotary disc body 212. Further, rotation of the rotary disc body 212 in turn induces rotation of the magnet 214.

Figure 28:
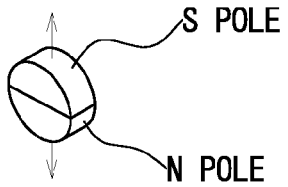
FIG. 28 It is a descriptive view showing an example magnet.
Figure 28:
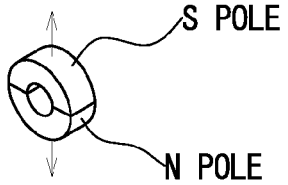
Figure 28:
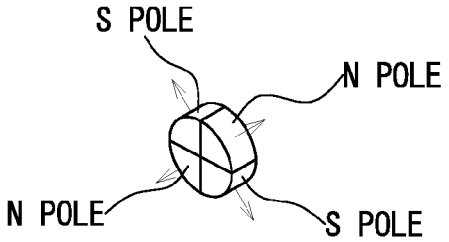
Figure 28:
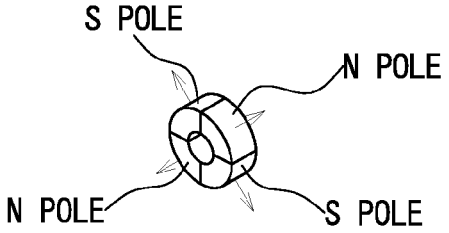

The magnet 214, a permanent magnet, is configured such that one of partitions defined by means of a plane extending along the center of rotation (i.e., an axial line passing through the center of rotation) comes to exhibit an N pole and that a remaining one of the partitions comes to exhibit an S pole. The direction of magnetization of the magnet 124 lies in a radial direction. Now, the direction of magnetization corresponding to the radial direction means that lines of magnetic force originate principally from the magnet 214 in its radial direction [i.e., originate from the peripheral surface of the magnet 214 in its radial direction (in perpendicular direction to the axial line from axial line of the magnet 214)]. There is another meaning that, in a state of the magnet 214 being attached to the rotary disc body 212, the lines of magnetic force exit principally from the magnet 214 at substantially right angles to the axial line of the rotary shaft 203 of the bobbin thread tension control motor 202. The magnet 214 of the third embodiment specifically is a magnet exhibiting two poles in its radial direction as shown in FIG. 28(*a*). Alternatively, the magnet 214 can also assume a shape other than the substantially columnar shape, so long as the magnet is magnetized in its radial direction. The magnet 214 may also assume; for instance, a ring shape. In other words, the magnet 214 can also be a magnet whose outer periphery exhibits two poles as shown in FIG. 28(*b*). The magnet 214 specifically exhibits at least two poles at the circumference.

A longitudinal positional relationship between the rotary disc 210 and the middle shuttle 150 is set such that a front surface of the magnet 214 comes to a front side (i.e., a depth side of the recess 162*b*) than is a front surface of the flat-plate portion 162*a* of the rear-side body 162 in the middle shuttle 150. The front surface of the magnet 214 is spaced an interval from the rear surface of the recessed depth 162*b*-2. In the rear-side body 162 of the middle shuttle 150, the flat-plate portion 162*a* and the recess 162*b* are spaced apart from the rotary disc 210.

Like the first embodiment, the middle shuttle 150 except the magnet 190 (at least the rear portion 161 and the bobbin accommodation section 180) is formed from a non-magnetic substance (e.g., aluminum or stainless steel) except the magnet 190. Specifically, since the bobbin 300 is provided with the magnet 310, the middle shuttle 150 is formed from a non-magnetic substance except the magnet 190 so as to prevent occurrence of a hindrance to control of rotation of the bobbin 300 by means of rotation of the bobbin thread tension control motor 202, which would otherwise be caused when the magnet 310 attracts the rear-side body 162.

Since the bobbin thread tension control mechanism 200 is analogous, in configuration, to its counterpart described in connection with the first embodiment except the rotary disc 210, its detailed descriptions are omitted.

The bobbin 300 is analogous, in configuration, to the bobbin 300 described in connection with the first embodiment. However, a thickness (a longitudinal thickness) of the magnet 310 is made greater than the thickness of the magnet 310 of the bobbin 300 described in connection with the first embodiment such that the rear surface of the magnet 310 substantially comes into alignment with the front surface of the magnet 214 along its longitudinal direction. Specifically, the thickness of the magnet 310 is determined in such a way that, when a balance between the magnetic force of the magnet 310 and the magnetic force of the magnet 214 is attained and when the rear surface of the magnet 310 and the front surface of the magnet 214 are substantially aligned to each other in their longitudinal direction, a rear end of the bobbin body 302 is aligned to the front surface of the recessed depth 162*b*-2 in their longitudinal direction or the rear end of the bobbin body 302 is situated further toward the front than is the front surface of the recessed depth 162*b*-2. In a case where the rear surface of the magnet 310 and the front surface of the magnet 214 are substantially aligned to each other in their longitudinal direction, when the rear end of the bobbin body 302 is situated at the rear end of the shaft 184 and when the rear end of the bobbin body 302 comes into contact the recess 162*b*, friction occurs between the bobbin body 302 and the recess 162*b*. It is preferable to set the thickness of the magnet such that, when the rear surface of the magnet 310 and the front surface of the magnet 214 are substantially aligned to each other in their longitudinal direction as a result of occurrence of a balance between the magnetic force of the magnet 310 and the magnetic force of the magnet 214, the rear end of the bobbin body 302 does not reach the front end of the recess 162*b* (see FIGS. 20 to 22).

Figure 27:
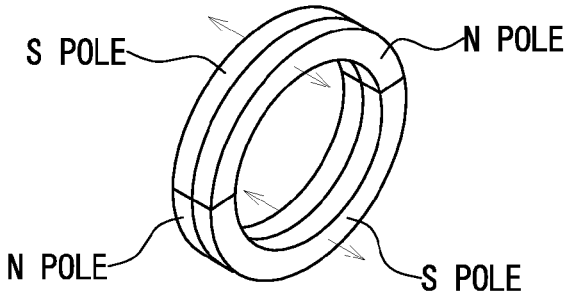
FIG. 27 It is a descriptive view showing an example magnet.
Figure 27:
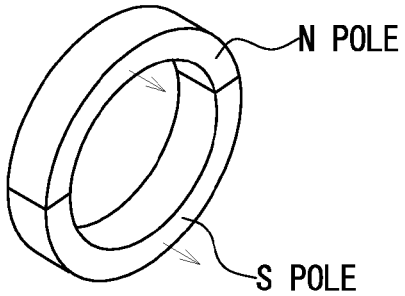
Figure 27:
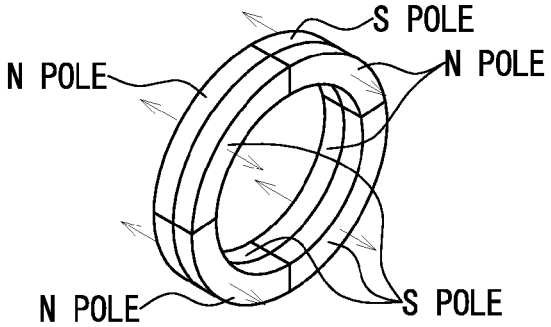
Figure 27:
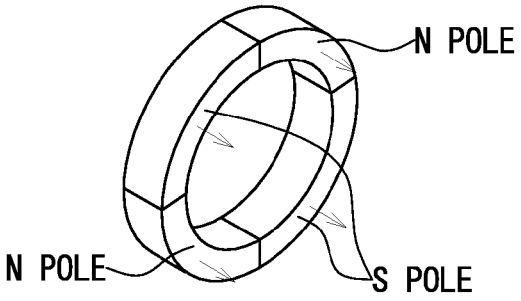

As in the case of the first embodiment, the magnet 310 of the third embodiment, a permanent magnet, assumes a ring shape. The magnet 310 is also formed such that one of partitions defined by a plane extending along the center of rotation (i.e., an axial line passing through the center of rotation) comes to exhibit an N pole and that a remaining one of the partitions comes to exhibit an S pole. A direction of magnetization of the magnet 310 corresponds to a plane direction (can also match a thicknesswise direction). The direction of magnetization corresponding to the plane direction means that lines of magnetic force originate principally from the magnet 310 in its thicknesswise direction [i.e., from a thicknesswise plane of the magnet 310 (a planar portion of the magnet 310) in its thicknesswise direction]. There is another meaning that, in a state of the magnet 310 being attached to the bobbin body 302, the lines of magnetic force exit principally from the magnet 310 substantially parallel to the axial line (the axial line passing through the center of rotation) of the bobbin 300. The plane direction is a direction substantially orthogonal to the radial direction. Specifically, the magnet 310 is a magnet both sides of which exhibit four poles, such as that shown in FIG. 27(*a*). Alternatively, the magnet 310 can also be a magnet either side of which exhibits two poles, as shown in FIG. 27(*b*). In other words, the essential requirement for the magnet 310 is that at least one side of the magnet be formed so as to exhibit two poles.

As shown in FIGS. 20 and 21, an inner diameter of the magnet 310 is made greater than an outer diameter of the magnet 214. In particular, the inner diameter of the magnet 310 and the outer diameter of the magnet 214 are set in such a way that, even when the rear-side body 162 of the middle shuttle 150 exists between the magnet 310 and the magnet 214, the rear surface of the magnet 310 and the front surface of the magnet 214 are substantially aligned to each other in the longitudinal direction and that gap is defined between the rear-side body 162 of the middle shuttle 150 and the rotary disc 210 as shown in FIGS. 20 and 21.

Since the bobbin 300 is analogous, in configuration, to its counterpart described in connection with the first embodiment except the above-mentioned configuration, its detailed explanation is omitted.

Elements of the configuration of the sewing machine of the third embodiment except those mentioned above; for instance, the sewing machine table 3, the embroidery heads 10-1 to 10-*n*, the sewing frame 22*d*, the frame actuation motor 32*d*, the shuttle actuation unit 250, the arithmetic unit 400, and the storage unit 500, is analogous to its counterpart described in connection with the first embodiment; hence, its detailed descriptions are omitted.

Operation of the embroidery sewing machine of the third embodiment; in particular, operation of the bobbin thread tension controller, is now described.

Operation of the bobbin thread tension controller of the embroidery sewing machine of the third embodiment is analogous to operation of the bobbin thread tension controller described in connection with the first embodiment. Each of the control circuits 40 controls operation of the shuttle actuation motor 252 according to the virtual main spindle data and the shuttle actuation data transmitted from the arithmetic unit 400. Each of the control circuits 40 also controls operation of the bobbin thread tension control motor 202 according to the virtual main spindle data and the bobbin thread tension control data transmitted from the arithmetic unit 400.

When the rotary shaft 203 of the bobbin thread tension control motor 202 rotates according to control operation of the bobbin thread tension control motor 202, the rotary disc 210 rotates, and the magnet 214 then rotates. When the magnet 214 rotates, the N poles and the S poles of the magnet 214 and the magnet 310 attract each other, whereupon the bobbin 300 also rotates.

A method for controlling operation of the bobbin thread tension control motor 202 includes rotating the rotary shaft 203 in the direction opposite to the rotating direction of the bobbin 300 (the forward direction) achieved when the bobbin thread 320 is withdrawn, to thus rotate the rotary disc 210, whereby the twine between the needle thread 90 and the bobbin thread 320 can be strongly tightened. When the twine is strongly tightened to produce tighter finished embroidery, a value of the electric current flowing into the bobbin thread tension control motor 202 is increased, whereby torque of the bobbin thread tension control motor 202 is increased. Specifically, when the bobbin thread is strongly tightened, a torque value in the bobbin thread tension control data is increased in advance. In other words, the torque of the bobbin thread tension control motor 202 is controlled at timing at which tension is imparted to a bobbin thread, thereby imparting rotational force to the bobbin 300 in a direction opposite to the forward direction.

Specific timing at which the torque of the bobbin thread tension control motor 202 is to be controlled is set to; for instance, the period T (see FIG. 16) from when the sewing needle has penetrated through the processed fabric until when the sewing needle reaches a position past the top dead center of the thread take-up lever 22*a* (or the top dead center) in much the same way in the first embodiment. Specifically, the timing is set to at least a period from a substantially intermediate point—between the bottom dead center and the top dead center of the thread take-up lever 22*a*—to the top dead center of the thread take-up lever 22*a*. Specifically, tighter finished embroidery can be produced by means of increasing a torque value for torque control of the bobbin thread tension control motor 202 performed during the period. In the meantime, it is also possible to produce softer finished embroidery by reducing the torque value for torque control of the bobbin thread tension control motor 202 performed during the period.

Figure 26:
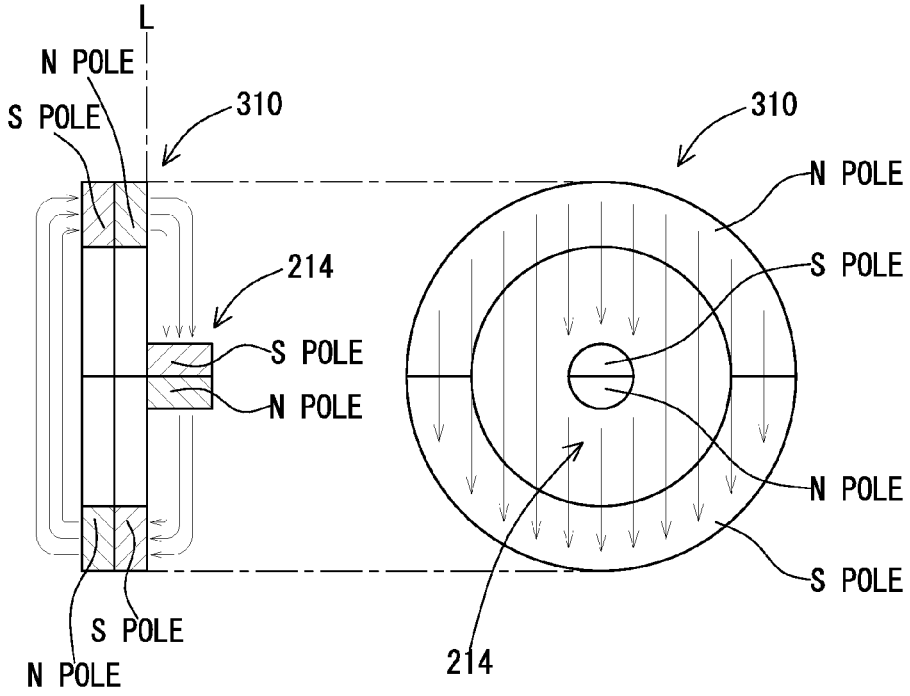
FIG. 26 It is a descriptive view for describing operation of the magnet 214 and operation of the magnet 310 in the embroidery sewing machine of the third embodiment.

On this occasion, the direction of magnetization of the magnet 310 lies in a plane direction, and the direction of magnetization of the magnet 214 lies in a radial direction. The inner diameter of the magnet 310 is made greater than the outer diameter of the magnet 214. Therefore, as shown in FIG. 26, the N pole of the magnet 310 opposes the S pole of the magnet 214, and the S pole of the magnet 310 opposes the N pole of the magnet 214. Thus, a balance of magnetic force between the magnets is achieved in a state of the rear surface of the magnet 310 and the front surface of the magnet 214 being aligned to each other in their longitudinal direction (i.e., the surfaces lie within a single plane) (or at least in substantial agreement with each other). In the longitudinal direction, the rear surface of the magnet 310 and the front surface of the magnet 214 are aligned to each other at the position of the line L shown in FIGS. 21 and 26. When the magnet 214 rotates in this state, the bobbin 300 starts rotating while the magnet 310 and the magnet 214 maintain their longitudinal positional relationship and attract each other in such a way that the N poles and the S poles of the magnets oppose each other. Since the front surface of the magnet 214 is set so as to come to the front side than is the front surface of the flat-plate portion 162*a* of the rear-side body 162 in the middle shuttle 150. Therefore, gap V is defined between the magnet 310 of the bobbin 300 and the flat-plate portion 162*a* of the middle shuttle 150. The magnet 310 of the bobbin 300 does not contact the front surface of the flat-plate portion 162*a* of the middle shuttle 150, so that it is possible to prevent occurrence of friction, which would otherwise arise when the magnet 310 contacts the flat-plate portion 162*a* of the middle shuttle 150.

When the rotary shaft 253 of the shuttle actuation motor 252 is rotated pursuant to operation control of the shuttle actuation motor 252, the arm 260 is rotated by means of rotation of the rotary shaft 253. The magnet 270 then rotates in a circumferential direction. Since the magnet 270 and the magnet 190 attract each other, the middle shuttle 150 comes to rotate in conjunction with rotation of the magnet 270. Since the middle shuttle 150 of the third embodiment is a half-turn middle shuttle, the middle shuttle is controlled so as to rotate back and forth within a range of half-turn rotation.

The middle shuttle 150 performs specific operation, such as that illustrated in FIG. 14, in the same way as in the first embodiment. One end of the looped needle thread 90 passes by the rear side of the rear-side body 162 (see FIG. 14(*d*)). Since space exists between the rotary disc 210 and the rear-side body 162 of the middle shuttle 150, the needle thread is not obstructed when passing by the rear side of the rear-side body 162. In particular, since the peripheral surface of the rotary disc 210 and a peripheral surface of the recessed periphery 162*b*-1 of the recess 162*b* are tapered, the needle thread can smoothly travel in the course of passing by the rear side of the rear-side body 162.

As mentioned above, in the embroidery sewing machine of the third embodiment, the bobbin thread tension control motor 202 can freely control the tension of the bobbin thread 320 in the middle of operation of the embroidery sewing machine 1 as in the case of the first embodiment.

The tension of the bobbin thread 320 is controlled by means of the magnet 214 provided on the rotary disc 210 whose rotation is controlled by the bobbin thread tension control motor 202 and the magnet 310 provided in the bobbin 300 in the same way as in the first embodiment. Therefore, when compared with a case where tension is controlled by means of a friction developing between a bobbin thread and another member, the tension can be controlled with superior accuracy.

The tension imparted to the bobbin thread 320 is controlled by means of a value of an electric current applied to the bobbin thread tension control motor 202 in the same way as in the first embodiment. The bobbin thread tension is proportional to a current value; hence, bobbin thread tension can be elaborately controlled by elaborate control of the current value.

In particular, in the case of the third embodiment, the direction of magnetization of the magnet 310 lies in a plane direction, and the direction of magnetization of the magnet 214 lies in a radial direction. The inner diameter of the magnet 310 is made greater than the outer diameter of the magnet 214. The front surface of the magnet 214 is set so as to come to the front side than is the front surface of the flat-plate portion 162*a* of the rear-side body 162 in the middle shuttle 150. Hence, a balance of magnetic force between the magnets is achieved in a state of the rear surface of the magnet 310 and the front surface of the magnet 214 being aligned to each other in their longitudinal direction. The magnet 310 of the bobbin 300 does not contact the front surface of the flat-plate portion 162*a* of the middle shuttle 150, so that it is possible to prevent occurrence of friction, which would otherwise arise when the magnet 310 contacts the flat-plate portion 162*a* of the middle shuttle 150. Therefore, rotation of the bobbin 300 can be made smooth, and bobbin thread tension can be controlled in a more elaborate manner.

When the embroidery sewing machine is a multi-head type embroidery sewing machine including the plurality of embroidery heads in the same way as in the first embodiment, bobbin thread tension has hitherto been controlled by means of friction developing between the bobbin thread and another member. Therefore, the respective embroidery heads cannot equally control the bobbin thread tension. However, in the present embodiment, the bobbin thread tension control data to be applied are made uniform; hence, the respective embroidery heads can equally control the bobbin thread tension.

Since the middle shuttle 150 has the bobbin accommodation section 180 in the same way as in the first embodiment, the bobbin 300 accommodated in the bobbin accommodation section 180 remains stably accommodated in the bobbin accommodation section 180 as a result of the magnet 310 being attracted by the magnet 214 of the rotary disc 210. Therefore, there is no necessity to additionally provide the middle shuttle 150 with a mechanism for attaching a bobbin. Specifically, the related art configuration includes putting a bobbin in a bobbin case and attaching to a middle shuttle the bobbin case accommodating the bobbin. In contrast, the present embodiment obviates a necessity for the bobbin case. In the present embodiment, the bobbin 300 can be readily removably attached to the bobbin accommodation section 180. Specifically, the bobbin 300 can be easily accommodated in the bobbin accommodation section 180 by means of the attractor force of the magnet 310 and the magnet 214.

In the same way as in the first embodiment, in the embroidery sewing machine of the present embodiment, the middle shuttle 150 is actuated by means of the corresponding shuttle actuation unit 250, and the magnet 270 and the magnet 190 attract each other, whereby the middle shuttle 150 rotates in conjunction with circumferential rotation of the magnet 270; hence, actuation sound stemming from actuation of the middle shuttle can be lessened. More specifically, in the related art, the half-turn middle shuttle is rotationally actuated by means of a driver remaining in contact with both sides of the middle shuttle. During the course of the middle shuttle repeatedly performing forward rotations and backward rotations, sound is generated as a result of occurrence of a contact between the driver and the middle shuttle. However, in the present embodiment, the driver is not provided, and rotational control of the middle shuttle is performed by utilization of the attractor force of the two magnets; hence, the sound does not occur.

The configuration formed from the middle shuttle 150, the rotary disc 210, and the bobbin 300 in the third embodiment can also be applied to the configuration described in connection with the second embodiment. Specifically, the middle shuttle described in connection with the third embodiment is applied in place of the middle shuttle 150 described in connection with the second embodiment. Further, the rotary disc 210 of the third embodiment is applied in lieu of the rotary disc 1210 described in connection with the second embodiment. Moreover, the bobbin described in connection with the third embodiment is applied in lieu of the bobbin 300 described in connection with the second embodiment.

As a result of adoption of such a configuration, the direction of magnetization of the magnet 310 lies in a plane direction, and the direction of magnetization of the magnet 214 lies in a radial direction. The inner diameter of the magnet 310 is made greater than the outer diameter of the magnet 214. The front surface of the magnet 214 is set so as to come to the front side than is the front surface of the flat-plate portion 162*a* of the rear-side body 162 in the middle shuttle 150. Hence, a balance of magnetic force between the magnets is achieved in a state of the rear surface of the magnet 310 and the front surface of the magnet 214 being aligned to each other in their longitudinal direction. The magnet 310 of the bobbin 300 does not contact the front surface of the flat-plate portion 162*a* of the middle shuttle 150, so that it is possible to prevent occurrence of friction, which would otherwise arise when the magnet 310 contacts the flat-plate portion 162*a* of the middle shuttle 150. Therefore, bobbin thread tension can be controlled in a more elaborate manner.

In the descriptions of the third embodiment, at least one side of the magnet 310 is formed so as to exhibit two poles, and the peripheral surface of the magnet 214 is formed so as to exhibit two poles. However, so long as the magnet 310 is magnetized in its plane direction, a plurality of poles can be caused to develop on at least one side of the magnet, and the peripheral surface of the magnet 214 can also be made so as to exhibit a plurality of poles. More specifically, the number of poles on one side of the magnet 310 is taken as "m" ["m is the "n" power of 2 ("n" is an integer of one or more)], and the number of poles of the magnet 214 is also taken as "m" ["m is the "n" power of 2 ("n" is an integer of one or more)]. For instance, the magnet 310 can be formed so as to exhibit a plurality of poles on both sides as shown in FIG. 27(*c*) or on a single side as shown in FIG. 27(*d*). Moreover, the magnet 214 can also be formed so as to exhibit a plurality of poles along its radial direction as shown in FIG. 28(*c*) or along an outer periphery as shown in FIG. 28(*d*). FIG. 27(*c*) specifically shows eight poles on both sides of the magnet, and FIG. 27(*d*) shows four poles on one side. FIG. 28(*c*) specifically shows four poles in the radial direction, and FIG. 28(*d*) shows four poles along an outer periphery.

When the magnets are formed so as to exhibit a plurality of poles as mentioned above, the number of poles developing from one side of the magnet 310 must be made equal to the number of poles developing from the magnet 214. For instance, when four poles develop from one side of the magnet 310, the magnet 214 is formed so as to exhibit four poles along its radial direction or along its outer periphery.

Even in the first embodiment and the second embodiment, at least one side of the magnet 310 is formed so as to exhibit two poles, and at least one side of the magnet 214 is formed so as to exhibit two poles. However, so long as the magnet 310 and the magnet 214 are magnetized along their plane directions, at least one side of each of the magnets can also be formed so as to exhibit a plurality of poles. Specifically, the number of poles developing from one side of the magnet 310 and one side of the magnet 214 is taken as "m" ["m" denotes the "n" power of 2 ("n" denotes an integer of one or more)]. For instance, the magnet 310 and the magnet 214 can also be formed as a double-sided multipole magnet shown in FIG. 27(*c*) or a single-sided multipole magnet shown in FIG. 27(*d*). Incidentally, the magnet 214 can also be formed into a double-sided or single-sided multipole columnar shape rather than the ring shape as illustrated in FIGS. 27(*c*) and 27(*d*). When the magnet is formed into a multipole magnet, the number of poles on one side of the magnet 310 must be made equal to the number of poles on one side of the magnet 214.

In the descriptions; namely, the descriptions about the first through third embodiments, the virtual main spindle data are prepared according to embroidery data, and the motors for the respective machine elements are controlled according to the virtual main spindle data and the machine element data. However, the motors for the respective machine elements can also be directly controlled according to the embroidery data.

In the descriptions; namely, the descriptions about the third embodiment, the invention has been described by means of taking the embroidery sewing machine as an example. However, another sewing machine; namely, a sewing machine other than the embroidery sewing machine, can also be taken.

DESCRIPTIONS OF THE REFERENCE NUMERALS AND SYMBOLS

1 EMBROIDERY SEWING MACHINE
10-1 TO 10-*n* EMBROIDERY HEAD
20 MACHINE ELEMENT GROUP
22*a* THREAD TAKE-UP LEVER
22*b* NEEDLE BAR
22*c* PRESSER FOOT
30 CONTROLLER
32*a* THREAD TAKE-UP MOTOR
32*b* NEEDLE BAR MOTOR
32*c* PRESSER FOOT MOTOR
40 CONTROL CIRCUIT
100 SHUTTLE
110 OUTER SHUTTLE
130 MIDDLE SHUTTLE PRESSER
150 MIDDLE SHUTTLE
152 RACE
160 MAIN MIDDLE SHUTTLE
161 REAR PORTION
162 REAR-SIDE BODY
162*a* FLAT-PLATE PORTION
162*b* RECESS
162*b*-1 RECESSED PERIPHERY
162*b*-2 RECESSED DEPTH
164 REAR-SIDE TAPERED PORTION
164*a* FIRST REGION
164*b* SECOND REGION
166 FRONT-SIDE TAPERED PORTION
170 LEADING END
172 POINT
174 THREAD GUARD
180 BOBBIN ACCOMMODATION SECTION
182 TUBULAR PORTION

184 SHAFT
190, 214, 270, 310, 1214, 1270 MAGNET
200, 1200 BOBBIN THREAD TENSION CONTROL MECHANISM
202, 1202 BOBBIN THREAD TENSION CONTROL MOTOR
210, 1210 ROTARY DISC
212, 1212 ROTARY DISC BODY
220 SUPPORT
250, 1250 SHUTTLE ACTUATION UNIT
252, 1252 SHUTTLE ACTUATION MOTOR
260, 1260 ARM
300 BOBBIN
302 BOBBIN BODY
400 ARITHMETIC UNIT
500 STORAGE UNIT

The invention claimed is:

1. A sewing-machine bobbin thread tension controller, comprising:

an outer shuttle that has a circular-arc inner peripheral surface and includes a guide groove formed on a front side which is one side of the inner peripheral surface in an axial direction;

a middle shuttle that rotates along the guide groove of the outer shuttle, to thus hook a needle thread, and that includes a race formed into a circular arc along a circumferential edge of the middle shuttle and slidably supported by the guide groove, a rear portion continually extending from a rear-side edge of an inner circumferential edge of the race, and a shaft formed on a front surface of the rear portion and along a center of rotation of the rear portion, wherein at least the rear portion and the shaft are made of a non-magnetic substance;

a middle shuttle presser that is provided on a front side of the outer shuttle in order to prevent the middle shuttle accommodated in the outer shuttle from falling from the outer shuttle;

a bobbin that has a hole through which the shaft of the middle shuttle passes, that is axially supported in the middle shuttle as a result of the shaft being inserted into the hole, and that has a first magnet provided on a rear surface which is a surface opposing a rear portion of the middle shuttle when the bobbin is axially supported by the shaft; and a bobbin thread tension control mechanism that includes a bobbin thread tension control motor which is provided at a rear of the middle shuttle, which has a rotary shaft concentric to the center of rotation of the middle shuttle, and which rotates the rotary shaft in a direction opposite to a rotating direction of the bobbin achieved when a bobbin thread wound around the bobbin is withdrawn and a second magnet which is rotated by the bobbin thread tension control motor, which is disposed in close proximity to the rear portion of the middle shuttle, and which rotates the first magnet.

2. The sewing-machine bobbin thread tension controller according to claim 1, further comprising:

a third magnet that is put on an outer periphery side of a portion of the rear of the middle shuttle opposing the surface of the bobbin provided with the first magnet; and a shuttle actuation unit that has a fourth magnet disposed in close proximity to the third magnet and a shuttle actuation motor for rotating the fourth magnet around an axial line that is to serve as a center of rotation of the middle shuttle.

3. The sewing-machine bobbin thread tension controller according to claim 2, wherein the rear portion of the middle shuttle has a substantially circular plate-like rear-side body that is perpendicular to the axial line serving as the center of rotation of the middle shuttle and that has an outer diameter smaller than an inner diameter of the race; and a rear-side tapered portion that is formed between a surrounding area of the rear-side body and the race and that is tapered so as to have a smaller diameter from the race toward the rear-side body; and wherein the third magnet is disposed on a front surface or a rear surface of the rear-side tapered portion.

4. The sewing-machine bobbin thread tension controller according to claim 2, wherein there is provided a control section for controlling rotation of the shuttle actuation motor in such a way that the middle shuttle makes substantially half forward and backward rotations; and wherein the shuttle actuation unit includes a shuttle actuation motor coaxially disposed at a rear of the bobbin thread tension control motor, a substantially L-shaped arm that is provided on a second rotary shaft which is a rotary shaft of the shuttle actuation motor, and that has a base end perpendicular to an axial center core of the second rotary shaft and also a leading end continually extending from the base end and provided in parallel to the axial center core of the second rotary shaft; and wherein the fourth magnet is disposed at an extremity of the arm.

5. The sewing-machine bobbin thread tension controller according to claim 2, wherein there is provided a control section for controlling rotation of the shuttle actuation motor in such a way that the middle shuttle makes a full rotation; wherein the shuttle actuation motor is interposed between the bobbin thread tension control motor and the middle shuttle and has an insert hole that enables insertion of a rotary shaft of the bobbin thread tension control motor; wherein a second rotary shaft, which is a rotary shaft of the shuttle actuation motor, is formed into a tubular shape so as to enable insertion of the rotary shaft of the bobbin thread tension control motor; wherein an axial line of the second rotary shaft is concentric to an axial line of the rotary shaft of the bobbin thread tension control motor; wherein there are provided on the second rotary shaft a substantially L-shaped arm including a base end perpendicular to an axial center core of the second rotary shaft and a leading end that continually extends from the base end and that is provided parallel to the axial center core of the second rotary shaft; and wherein the fourth magnet is disposed at an extremity of the arm.

6. The sewing-machine bobbin thread tension controller according to claim 1, wherein a cylindrical tubular portion is provided on a front surface of the rear portion of the middle shuttle in order to accommodate the bobbin axially supported on the shaft.

7. The sewing-machine bobbin thread tension controller according to claim 1, wherein a plate-like rotor plate is disposed on the rotary shaft of the bobbin thread tension control motor and in close proximity to the rear portion of the middle shuttle, and the second magnet is disposed on a front of a rotor plate.

8. A sewing-machine bobbin thread tension controller, comprising:

an outer shuttle that includes a guide groove formed on an inner peripheral surface thereof;

a middle shuttle that rotates along the guide groove of the outer shuttle, to thus hook a needle thread, and that includes a race formed into a circular arc along a circumferential edge of the middle shuttle and slidably supported by the guide groove, a main middle shuttle that continually extends from an inner end of the race and that includes a rear portion continually extending from a rear-side end which is one end of an inner circumferential edge of the race achieved in an axial direction, and a front-side tapered portion which continually extends from a front-side end which is a remaining end of the inner circumferential edge of the race, and which is tapered so as to have a smaller diameter toward the front, wherein the rear portion further includes a substantially circular plate-like rear-side body which is perpendicular to an axial line serving as a center of rotation of the middle shuttle and whose outer diameter is smaller than an inner diameter of the race and a rear-side tapered portion which is formed between a surrounding area of the rear-side body and the race and which is tapered so as to have a smaller diameter from the race toward the rear-side body, a bobbin accommodation section that is formed in a front surface of the rear-side body and that includes a shaft formed so as to extend from a center of the rear-side body along the center of rotation of the middle shuttle and a cylindrical tubular portion provided on a front surface of the rear-side body, and a third magnet disposed on a front or rear surface of the rear-side tapered portion, wherein the middle shuttle except the third magnet is made of a non-magnetic substance;

a middle shuttle presser that is disposed on a front side of the outer shuttle in order to prevent the middle shuttle accommodated in the outer shuttle from falling from the outer shuttle;

a bobbin that is accommodated in the bobbin accommodation section of the middle shuttle and that has a first magnet disposed on a plane perpendicular to an axial line serving as a center of rotation;

a bobbin thread tension control mechanism that includes a bobbin thread tension control motor which is disposed at a rear of the middle shuttle, which has a rotary shaft concentric to the center of rotation of the middle shuttle, and which rotates the rotary shaft in a direction opposite to a rotating direction of the bobbin achieved when a bobbin thread wound around the bobbin is withdrawn, and a rotary disc which is attached to a rotary shaft of the bobbin thread tension control motor and positioned in close proximity to the rear portion of the middle shuttle and which has a second magnet for rotating the first magnet as a result of rotation of the rotary disc;

a shuttle actuation unit that includes a shuttle actuation motor which is provided at a rear of the bobbin thread tension control motor and which has a second rotary shaft serving as a rotary shaft concentric to the center of rotation of the middle shuttle, a substantially L-shaped arm attached to the second rotary shaft and including a base end attached to the secondary shaft and perpendicular to an axial center core of the second rotary shaft and a leading end continually extending from the base end in parallel to the axial center core of the second rotary shaft, and a fourth magnet attached to an extremity of the arm and in close proximity to the third magnet; and a control section for controlling rotation of the shuttle actuation motor such that the middle shuttle makes substantially half forward and backward rotations.

9. A sewing-machine bobbin thread tension controller, comprising:

an outer shuttle that includes a guide groove formed on an inner peripheral surface thereof;

a middle shuttle that rotate along the guide groove of the outer shuttle, to thus hook a needle thread, and that includes a race formed into a circular arc along a circumferential edge of the middle shuttle and slidably supported by the guide groove, a main middle shuttle that continually extends from an inner end of the race and that includes a rear portion continually extending from a rear-side end which is one end of an inner circumferential edge of the race achieved in an axial direction, and a front-side tapered portion which continually extends from a front-side end which is a remaining end of the inner circumferential edge of the race, and which is tapered so as to have a smaller diameter toward the front, wherein the rear portion further includes a substantially circular plate-like rear-side body, perpendicular to an axial line serving as a center of rotation of the middle shuttle, that has an outer diameter which is smaller than an inner diameter of the race and a rear-side tapered portion that is formed between a surrounding area of the rear-side body and the race and that is tapered so as to have a smaller diameter from the race toward the rear-side body, a bobbin accommodation section formed in a front surface of the rear-side body and that includes a shaft formed so as to extend from a center of the rear-side body along the center of rotation of the middle shuttle and a cylindrical tubular portion provided on a front surface of the rear-side body, and a third magnet disposed on a front or rear surface of the rear-side tapered portion, wherein the middle shuttle except the third magnet is made of a non-magnetic substance;

a middle shuttle presser disposed on a front side of the outer shuttle in order to prevent the middle shuttle accommodated in the outer shuttle from falling from the outer shuttle;

a bobbin that is accommodated in the bobbin accommodation section of the middle shuttle and that has a first magnet disposed on a plane perpendicular to an axial line serving as a center of rotation;

a bobbin thread tension control mechanism that includes a bobbin thread tension control motor which is disposed at a rear of the middle shuttle, which has a rotary shaft concentric to the center of rotation of the middle shuttle and which rotates the rotary shaft in a direction opposite to a rotating direction of the bobbin achieved when a bobbin thread wound around the bobbin is withdrawn, and a rotary disc which is attached to a rotary shaft of the bobbin thread tension control motor and positioned in close proximity to the rear portion of the middle shuttle and which has a second magnet for rotating the first magnet as a result of rotation of the rotary disc;

a shuttle actuation unit that includes a shuttle actuation motor which is interposed between the bobbin thread tension control motor and the middle shuttle and which has an insert hole enabling insertion of a rotary shaft of the bobbin thread tension control motor and a second rotary shaft, which is a rotary shaft of the shuttle actuation motor, is formed into a tubular shape so as to enable insertion of the rotary shaft of the bobbin thread tension control motor; wherein an axial line of the second rotary shaft is concentric to an axial line of the rotary shaft of the bobbin thread tension control motor, a substantially L-shaped arm which is attached to the second rotary shaft and which includes a base end attached to the secondary rotary shaft perpendicular to an axial center core of the second rotary shaft and a leading end continually extending from the base end in parallel to the axial center core of the second rotary shaft, and a fourth magnet attached to an extremity of the arm and in close proximity to the third magnet; and a control section for controlling rotation of the shuttle actuation motor such that the middle shuttle makes a full rotation.

10. The sewing-machine bobbin thread tension controller according to claim 1, wherein the first magnet is a permanent magnet that assumes a ring shape and that is magnetized in a plane direction substantially perpendicular to a radial direction; and wherein the second magnet is a permanent magnet that assumes a ring shape or a columnar shape and that is magnetized in the plane direction.

11. The sewing-machine bobbin thread tension controller according to claim 1, wherein the rear portion of the middle shuttle includes a circular rear plate-like portion that continually extends from a rear-side end of the inner circumferential edge of the race and that has an aperture formed at a center thereof and a rear recess formed in the aperture of the rear plate-like portion; wherein the first magnet provided in the bobbin is a permanent magnet that assumes a ring shape and that is magnetized in a plane direction substantially perpendicular to a radial direction; and wherein the second magnet provided in the bobbin thread tension control mechanism is a permanent magnet that has an outer diameter smaller than an inner diameter of the first magnet, that is magnetized in the radial direction, and that is placed in the rear recess and spaced apart from the rear recess such that a front-side end of the second magnet is situated at a front side than is a front surface of the rear plate-like portion of the rear portion of the middle shuttle.

12. The sewing-machine bobbin thread tension controller according to claim 11, wherein the rear recess includes a tapered tubular recessed periphery that continually extends from the aperture of the rear plate-like portion and that has a gradually smaller diameter toward a front side and a recessed depth that closes an end of the recessed periphery opposite to the rear plate-like portion; wherein a rotating body has a substantially-circular-truncated-cone-shaped peripheral surface substantially parallel to a peripheral surface of the recessed periphery and, on a front side thereof, a recess for attachment of the second magnet and is attached to the rotary shaft of the bobbin thread tension control motor; and wherein the second magnet is provided in the recess of the rotating body.

13. The sewing-machine bobbin thread tension controller according to claim 11, wherein the shaft provided in the middle shuttle is situated on a front side of the corresponding recess and that the first magnet is formed to a thickness such that there is achieved a balance between magnetic force of the first magnet and magnetic force of the second magnet and that, in a state where a rear surface of the first magnet and a front surface of the second magnet are substantially aligned to each other in a longitudinal direction, a rear-side end of the part except the first magnet in the bobbin, is situated further toward the front than is a rear-side end of the shaft.

14. A sewing machine having the sewing-machine bobbin thread tension controller defined in claim 1, wherein, in a certain period that is a period including a duration from when a sewing needle has penetrated through a processed fabric until when a thread take-up lever ascends to a top dead center or at least a part of the period, the control section controls rotation of the bobbin thread tension control motor in such a way that the second magnet rotates in a direction opposite to a rotating direction achieved when a bobbin thread is withdrawn from the bobbin, thereby imparting rotational force to the bobbin in the opposite direction.

15. The sewing-machine bobbin thread tension controller according to claim 3, wherein there is provided a control section for controlling rotation of the shuttle actuation motor in such a way that the middle shuttle makes substantially half forward and backward rotations; and wherein the shuttle actuation unit includes a shuttle actuation motor coaxially disposed at a rear of the bobbin thread tension control motor, a substantially L-shaped arm that is provided on a second rotary shaft which is a rotary shaft of the shuttle actuation motor, and that has a base end perpendicular to an axial center core of the second rotary shaft and also a leading end continually extending from the base end and provided in parallel to the axial center core of the second rotary shaft; and wherein the fourth magnet is disposed at an extremity of the arm.

16. The sewing-machine bobbin thread tension controller according to claim 3, wherein there is provided a control section for controlling rotation of the shuttle actuation motor in such a way that the middle shuttle makes a full rotation; wherein the shuttle actuation motor is interposed between the bobbin thread tension control motor and the middle shuttle and has an insert hole that enables insertion of a rotary shaft of the bobbin thread tension control motor; wherein a second rotary shaft, which is a rotary shaft of the shuttle actuation motor, is formed into a tubular shape so as to enable insertion of the rotary shaft of the bobbin thread tension control motor; wherein an axial line of the second rotary shaft is concentric to an axial line of the rotary shaft of the bobbin thread tension control motor; wherein there are provided on the second rotary shaft a substantially L-shaped arm including a base end perpendicular to an axial center core of the second rotary shaft and a leading end that continually extends from the base end and that is provided parallel to the axial center core of the second rotary shaft; and wherein the fourth magnet is disposed at an extremity of the arm.

17. The sewing-machine bobbin thread tension controller according to claim 8, wherein the first magnet is a permanent magnet that assumes a ring shape and that is magnetized in a plane direction substantially perpendicular to a radial direction; and wherein the second magnet is a permanent magnet that assumes a ring shape or a columnar shape and that is magnetized in the plane direction.

18. The sewing-machine bobbin thread tension controller according to claim 9, wherein the first magnet is a permanent magnet that assumes a ring shape and that is magnetized in a plane direction substantially perpendicular to a radial direction; and wherein the second magnet is a permanent magnet that assumes a ring shape or a columnar shape and that is magnetized in the plane direction.

19. The sewing-machine bobbin thread tension controller according to claim 8, wherein the rear portion of the middle shuttle includes a circular rear plate-like portion that continually extends from a rear-side end of the inner circumferential edge of the race and that has an aperture formed at a center thereof and a rear recess formed in the aperture of the rear plate-like portion; wherein the first magnet provided in the bobbin is a permanent magnet that assumes a ring shape and that is magnetized in a plane direction substantially perpendicular to a radial direction; and wherein the second magnet provided in the bobbin thread tension control mechanism is a permanent magnet that has an outer diameter smaller than an inner diameter of the first magnet, that is magnetized in the radial direction, and that is placed in the rear recess and spaced apart from the rear recess such that a front-side end of the second magnet is situated at a front side than is a front surface of the rear plate-like portion of the rear portion of the middle shuttle.

20. The sewing-machine bobbin thread tension controller according to claim 9, wherein the rear portion of the middle shuttle includes a circular rear plate-like portion that continually extends from a rear-side end of the inner circumferential edge of the race and that has an aperture formed at a center thereof and a rear recess formed in the aperture of the rear plate-like portion; wherein the first magnet provided in the bobbin is a permanent magnet that assumes a ring shape and that is magnetized in a plane direction substantially perpendicular to a radial direction; and wherein the second magnet provided in the bobbin thread tension control mechanism is a permanent magnet that has an outer diameter smaller than an inner diameter of the first magnet, that is magnetized in the radial direction, and that is placed in the rear recess and spaced apart from the rear recess such that a front-side end of the second magnet is situated at a front side than is a front surface of the rear plate-like portion of the rear portion of the middle shuttle.

* * * * *